US009044090B2

(12) United States Patent
Drake et al.

(10) Patent No.: US 9,044,090 B2
(45) Date of Patent: Jun. 2, 2015

(54) RACK SYSTEM AND BRACKET

(75) Inventors: Trevor Drake, Sydney (AU); Nicolle Drake, Sydney (AU)

(73) Assignee: SOLID RACKS PTY LIMITED, Brookvale (AU)

( * ) Notice: Subject to any disclaimer, the term of this patent is extended or adjusted under 35 U.S.C. 154(b) by 0 days.

(21) Appl. No.: 13/582,764

(22) PCT Filed: Mar. 10, 2011

(86) PCT No.: PCT/AU2011/000268
§ 371 (c)(1),
(2), (4) Date: Nov. 15, 2012

(87) PCT Pub. No.: WO2011/109868
PCT Pub. Date: Sep. 15, 2011

(65) Prior Publication Data

US 2013/0062300 A1 Mar. 14, 2013

(30) Foreign Application Priority Data

| | | |
|---|---|---|
| Mar. 10, 2010 | (AU) | 2010900999 |
| Jun. 15, 2010 | (AU) | 2010902611 |
| Nov. 10, 2010 | (AU) | 2010904997 |

(51) Int. Cl.
*A47F 5/08* (2006.01)
*A47H 1/00* (2006.01)
(Continued)

(52) U.S. Cl.
CPC . *A47B 96/06* (2013.01); *A47F 5/08* (2013.01); *A47F 5/0823* (2013.01);
(Continued)

(58) Field of Classification Search
CPC ..... A47F 5/0823; A47F 5/0876; A47F 5/08; A47F 5/0807; A47F 5/0815; A47F 5/083; A47F 5/0884; A47F 5/103; A47F 5/101; A47F 5/0068; A47F 7/143; A47B 96/067; A47B 96/061; A47B 96/14; A47B 96/1408; A47B 96/1458; A47B 96/1475; A47B 96/068; A47B 96/06; A47B 2096/1491; A47B 95/008; A47B 57/40; A47B 57/32; A47B 57/30; A47B 57/42; A47B 57/52; A47B 57/56; A47B 57/562; A47B 57/46; A47B 57/045; A47B 57/34; A47B 57/485; A47B 47/022; F16B 21/09
USPC ..... 211/13.1, 85.7, 18, 70.6, 60.1, 103, 211/187, 190, 193, 57.1, 59.1, 87.01; 248/220.31, 220.41, 220.42, 220.43, 248/221.12, 223.21, 225.11
See application file for complete search history.

(56) References Cited

U.S. PATENT DOCUMENTS

| | | | | |
|---|---|---|---|---|
| 919,526 | A * | 4/1909 | Belcher | 108/108 |
| 2,053,119 | A * | 9/1936 | Sturtevant | 248/223.21 |

(Continued)

FOREIGN PATENT DOCUMENTS

| | | |
|---|---|---|
| EP | 1443292 | 8/2004 |
| EP | 1665954 | 6/2006 |

(Continued)

*Primary Examiner* — Jennifer E Novosad
(74) *Attorney, Agent, or Firm* — Gordon & Jacobson, PC

(57) ABSTRACT

A bracket or support member (119.771) including a body (119.770), at least one arm or hook extending away from the body that can be inserted through an aperture (104.704) in a support (104.700), the at least one arm or hook (119.722) including an end portion (119.720) which is adapted to be received into a recess (104.702) on a rear surface of the support (104.700). A support system (FIG. 124) is also disclosed which utilizes the bracket or support member (119.771) in combination with an apertured panel (124.700).

25 Claims, 67 Drawing Sheets

(51) Int. Cl.

| | |
|---|---|
| ***A47B 96/06*** | (2006.01) |
| ***A47B 57/34*** | (2006.01) |
| *A47B 57/48* | (2006.01) |
| *A47B 96/14* | (2006.01) |

(52) U.S. Cl.
CPC ..... *A47F 5/0884* (2013.01); *A47B 57/34* (2013.01); *A47B 57/485* (2013.01); *A47B 96/061* (2013.01); *A47B 2096/1491* (2013.01)

(56) References Cited

U.S. PATENT DOCUMENTS

| | | | | | |
|---|---|---|---|---|---|
| 2,336,604 | A | * | 12/1943 | Edward et al. | 248/243 |
| 2,933,196 | A | | 4/1960 | Childs | |
| 3,279,620 | A | * | 10/1966 | Nesbitt | 211/106.01 |
| 3,368,784 | A | * | 2/1968 | Peterson | 248/245 |
| 3,640,497 | A | | 2/1972 | Waki | |
| 4,205,815 | A | * | 6/1980 | Sauer et al. | 248/243 |
| 4,228,906 | A | | 10/1980 | Jones | |
| 4,444,323 | A | * | 4/1984 | Travis | 211/193 |
| 4,676,469 | A | * | 6/1987 | Rotermund et al. | 248/243 |
| 4,932,538 | A | | 6/1990 | Gambello | |
| 4,972,783 | A | | 11/1990 | Crissman et al. | |
| 5,092,546 | A | * | 3/1992 | Wolfbauer | 248/49 |
| 5,170,898 | A | * | 12/1992 | Katz et al. | 211/193 |
| 5,185,971 | A | * | 2/1993 | Johnson, Jr. | 52/36.6 |
| 5,379,976 | A | | 1/1995 | DeGirolamo | |
| 5,388,796 | A | * | 2/1995 | Sullivan | 248/246 |
| 6,082,690 | A | * | 7/2000 | Durin et al. | 248/241 |
| 6,131,746 | A | * | 10/2000 | Huang | 211/41.11 |
| 6,302,283 | B1 | | 10/2001 | Yeh | |
| 6,390,309 | B1 | * | 5/2002 | Tucker | 211/85.7 |
| 6,422,523 | B1 | * | 7/2002 | Weshler | 248/222.52 |
| 6,581,788 | B1 | * | 6/2003 | Winig et al. | 211/90.01 |
| 6,848,589 | B2 | * | 2/2005 | Wood | 211/189 |
| 7,201,282 | B1 | * | 4/2007 | Alderman | 211/60.1 |
| 7,311,828 | B2 | * | 12/2007 | Miles et al. | 210/232 |
| 2005/0109901 | A1 | | 5/2005 | Stitchick et al. | |
| 2007/0241070 | A1 | | 10/2007 | Maheu et al. | |
| 2008/0217271 | A1 | | 9/2008 | Walter | |
| 2010/0213149 | A1 | * | 8/2010 | Shaha | 211/87.01 |
| 2013/0062300 | A1 | * | 3/2013 | Drake | 211/183 |

FOREIGN PATENT DOCUMENTS

| | | | |
|---|---|---|---|
| FR | 1569920 | | 6/1969 |
| FR | 2454013 | | 11/1980 |
| FR | 2676513 | | 11/1992 |
| FR | 2919167 | | 1/2009 |
| GB | 1360118 | | 7/1974 |
| GB | 1396662 | | 6/1975 |
| GB | 2374518 | | 5/2004 |
| WO | WO92/09222 | | 6/1992 |
| WO | WO 03/055360 | A1 | 7/2003 |
| WO | WO 03/101251 | | 12/2003 |
| WO | WO 2005/044061 | A1 | 5/2005 |
| WO | WO 2009/073990 | A1 | 6/2009 |
| WO | WO2009103544 | A2 | 8/2009 |

* cited by examiner 34.002
34.083
34.059

35.002
35.059

36.002
35.059
36.086
36.085

37.002
36.084
36.086
37.059

38.002
38.093
38.090
37.082
37.089
38.059
38.093

RACK SYSTEM AND BRACKET

CROSS-REFERENCE TO RELATED APPLICATIONS

This application claims priority from PCT Appl. No. PCT/AU/2011/000268 filed on Mar. 10, 2011, AU 2010900999 filed on Mar. 10, 2010, Australian Patent Appl. No. 2010902611 filed on Jun. 15, 2010, and Australian Patent Appl. No. 2010904997 filed on Nov. 10, 2010, all of which are hereby incorporated by reference in their entireties.

FIELD OF THE INVENTION

The present invention relates to racking systems that involve the cantilevering of support brackets and brackets that can be mounted to a wall or be free standing.

BACKGROUND OF THE INVENTION

There has been a long felt need for a racking system for use with marine and other sporting equipment, in the hardware industry, general building industry and in garden centres which provides flexibility of application and rearrangement of the components to suit a variety of items to be stored.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a support member including a body, at least one arm or hook extending away from the body that can be inserted through an aperture in a support means, the at least one arm or hook including an end portion which is adapted to be received into a recess on a rear surface of the support means.

The support member can include a recess to receive a structural member.

The structural member can have a formation which engages a portion of the recess to prevent movement in a disassembling direction.

The support member can include: two arms or hooks; two arms or hooks to respectively pass into two separate apertures in the support means; one arm or hook and a stabilising projection; one arm or hook and a stabilising projection to respectively pass into two separate apertures in the support means.

Means can be provided to do one or more than one of the following: secure the location of the structural member onto the support members; secure the location of an article attached to the structural member with respect to the panel; secure the support member to the panel.

The structural member can be one of a beam; a bracket; a beam or bracket or other part of or attached to one of the following: furniture; a cabinet; a vanity cabinet; a cupboard; a shelf; a dressing table; a seat; a chest of drawers; a chair; a work bench; a building element; a stair tread; a beam; an art work; electrical switch boards; electrical cabinets; television set; computer racks or any appropriate article.

The support member can include two arms or hooks which can move towards each other so that the arms or hooks can pass through the aperture of the support means.

The support member can further include one or more of the following: a securing member passing through the arms or hooks to move the arms or hooks relative to each other; a first arm or hook is provided on a first portion being insertable into a second portion on which is provided a second arm or hook, and wherein the first and second portions are adapted to move with respect to each other; the support member includes two arms or hooks, which are pivoted with respect to each other; a tubular portion to receive a structural member such as a beam; a support to receive a bracket; the at least one arm or hook include outwardly radiused or curved regions.

The support member can include means to move or secure the structural member and has one or more of the following: provides for movement or securement in a horizontal direction; provides movement or securement in a vertical direction; provides movement or securement in both a vertical direction or a horizontal direction; is able to be locked.

The at least one arm or hook and or the end portion can engages one or more walls of the recess to thereby resist twisting forces applied to the support member.

The support member can include a portion which will engage a recess or channel on a front surface of the panel.

The support member can be formed from one or more of the following: fabricated from side plates; cast steel; composite materials; aluminium; in a generally rectangular format; in a generally triangular format; from sheet metals leaves forming the arms or hooks; open box sections; closed box sections; extrusion.

The previously described support member and a support pane can form a system whereby the panel includes a front face and a rear face and at least one aperture extending through the panel between the front face and the rear face; the rear face including a recess adjacent to the aperture, the recess having a base surface which in side view is located between the front face and the rear face, The base surface can intersect with a wall of the aperture.

The recess can be located relative to the aperture in one of the following locations: on one side of the aperture; on two sides of the aperture; on opposed sides of the aperture; in a line on opposed sides of the aperture; fully surrounds the aperture; in a circle around the aperture.

The recess can be in the form of a rebate, formed as a channel formation having opposed side walls and a base.

The panel can have one or more of the following features: multiple apertures are provided; multiple apertures are provided in an array; multiple apertures are provided such that the recess is formed by a rebate which extends between at least two apertures; the front face can include a recess associated with the at least one aperture which does not intersect with a wall of the aperture or does intersect with a wall of the aperture.

The present invention also provides a support panel having a front face and a rear face and at least one aperture extending through the panel between the front face and the rear face; the rear face including a recess adjacent to the aperture, the recess having a base surface which in side view is located between the front face and the rear face, The base surface can intersect with a wall of the aperture.

The recess can be one or more of the following: located relative to the aperture in one of the following locations: on one side of the aperture; on two sides of the aperture; on opposed sides of the aperture; in a line on opposed sides of the aperture; fully surrounds the aperture; in a circle around the aperture; recess is in the form of a rebate, formed as a channel formation having opposed side walls and a base.

The panel can have one or more of the following features: multiple apertures are provided; multiple apertures are provided in an array; multiple apertures are provided such that the recess is formed by a rebate which extends between at least two apertures; the front face can include a recess associated with the at least one aperture which does not intersect with a wall of the aperture or does intersect with a wall of the aperture.

The present invention further provides a racking system for supporting objects, the system including at least one support flange having at least one slot adapted to receive a bracket support and a bracket connected to or engageable with the bracket support, whereby the bracket extends away from the support flange and or the bracket support.

During assembly the bracket support can first engage at least one support flange and then the bracket engages the bracket support.

The bracket support can be a pin or rod means.

There can be at least two flanges at spaced locations on the bracket support.

Between the at least two flanges the bracket support can have a length equal to the width of the support flange.

The at least two flanges can be at the ends of the bracket support.

The bracket can engage the bracket support between the at least two flanges.

The bracket can have a bifurcated part or includes at least two spaced bracket portions.

The width of space between the bifurcated parts of the bracket, or between the at least two bracket portions, is approximately the same as the width or thickness of the support flange, so that the support flange can be received therebetween.

The bracket can pivot around the bracket support and a portion of the bracket engages a wall means or a support plate to which the support flange is mounted and from which the support flange extends.

The bracket and the support flange and or the bracket support cooperate to provide resistance, or bearing capability of the racking system, to forces applied laterally to the bracket.

The racking system can include two support flanges which are one or more of the following features: extending from a common support plate to form a set of support flanges; mounted to a wall means to form a set of support flanges; one of the support flanges of includes a slot, while the other does not include a slot; both of the support flanges of the set includes a slot; the spacing between support flanges of the set is approximately the same dimension as the thickness or width of the bracket.

One or more than one of the following provides elasticity, or suspension, or damping means, for the racking system: the support flange, the bracket, the location of engagement of the bracket support to the support flange and or the bracket; is provided by the bracket and is achieved by means of the shape of the bracket at a portion of the bracket which is remote from the support flange; is achieved at or near to the location of the mounting of the bracket to the bracket support; is achieved by a spring or leaf spring formation formed with or as part of the bracket.

The slot can include an entrance passage and a terminus to limit the travel of the bracket and or the bracket support relative to the support flange.

The entrance passage can be one of the following: inclined so that the bracket support moves downwardly to the terminus; is inclined so that the bracket support moves horizontally then downwardly to the terminus; is inclined so that the bracket support moves upwardly then downwardly to the terminus.

The racking system can be secured to a wall means through the support flange or through the support plate.

The wall means can be one of the following: a stationary wall; part of a frame or stand.

The bracket support can be one or more of the following: formed separate from the bracket but is secured or is securable to the bracket; is releasably secured to the bracket; is integrally formed with the bracket; extends from one side of the bracket; extends from both sides of the bracket; extends between two portions of the bracket; a telescoping pin means; extendable and or retractable with respect to the bracket.

There can be multiple slots spaced along the support flange.

The racking system can further include at least two sets of support flanges spaced apart on the wall means from each other.

The support flange can include a flexible wall section or a wall section having sufficient elasticity, so that when engaged by the bracket or the bracket support the application of load to the wall section will be compressed allowing the brackets to flex upon loading.

The support flanges can be held together at their upper and lower extremities by respective mounting plates.

The present invention also provides a racking system for supporting objects on a wall means, the system including at least one support flange having at least one slot adapted to receive a bracket support and a bracket connected to or engageable with the bracket support to mount the bracket to the at least one support flange characterised in that the racking system includes a means of elasticity, or suspension or damping means so that load applied to the bracket by an object to be supported on the bracket will be such that the system will increase the time to bring the load to rest as compared with the bracket and its mount to the support flange being rigid.

The present invention further provides a racking system for supporting objects on a wall means, the system including at least one support flange having at least one slot and at least bracket support located between the slot and a free end of the support flange, a bracket connectable to or engageable with the bracket support to mount the bracket to the at least one support flange characterised in that the racking system includes a means of elasticity, or suspension or damping means so that load applied to the bracket by an object to be supported on the bracket will increase the time to bring the load to rest as compared with the bracket and its mount to the support flange being rigid.

The system can include one or more of the following: the support flange has at least two bracket supports; the bracket support is removable; the rear of the bracket makes contact with a rear support plate or wall means to which the support flange is attached; the at least one slot contributes to elasticity, or suspension or damping means; the at least one slot can receive a bracket support; a twin support flange arrangement, with the bracket support extending between the twin support flanges; bracket support is integrally formed or permanently attached to the support flange or flanges.

The present invention also provides a racking system for supporting objects on a wall or wall means, the system including at least one support formation formed integrally with the wall or wall means to which the rack system is to cooperate; or formed separately from the wall or wall means and attachable thereto; the at least one support formation has at least one support slot through an external face and a space between a rear face of the slot and a rear panel or the wall or the wall means.

The system can include at least one bracket having a bracket slot formed therein which is able to enter the support slot and having a rear portion which can enter into the space leaving a portion of the bracket slot on the external side of the support formation, the rear of the bracket engaging the rear panel or the wall or the wall means thereby allowing the bracket to provide a means of elasticity, or suspension or damping means so that load applied to the bracket by an object to be supported on the bracket so that the bracket will increase the time to bring the load to rest as compared with the bracket being rigid.

The system can include a removable support means, the removable support means including at least one support flange, a support plate, a support hook able to be removably engaged with the wall means and a slot in the removable support means which opens on at least two faces, wherein two of the at least two faces are perpendicular to each other.

The support hook can be removably engageable with the slot in the support formation wherein at least a portion of the support hook lies in the space between a rear face of the slot and a rear panel or the wall or the wall means.

The removable support means can engage with a bracket.

A bracket for supporting watercraft for use in a system described above wherein the bracket can include a back load bearing edge, a top edge, a bottom edge, a front edge and a bracket support proximate the back edge; including at least a medial region where the top edge includes a concave or recessed portion; wherein a suspension means spans across the concave or recessed portion, the suspension means being fixed to the bracket at the proximal and distal ends of the concave or recessed portion along the top edge.

The suspension means can be a strap and the bracket includes one or more of the following: at least one slot at an entrance to the concave or recessed portion; the slot extends into an aperture larger than the slot; the concave or recessed portion includes at least two slots, with at least one on both entrances to the concave or recessed portion extending into the bracket ending in an aperture larger than the slot; the strap is connected on at least one end to a strap engaging pin; wherein the strap engaging pin engages with the aperture and is restrained from movement in the directions along the length of the bracket by the slot; and wherein the strap lies in the slot; the strap wraps around a strap engaging pin and exits the slot; wherein the strap engaging pin engages with the aperture and is restrained from movement in the directions along the length of the bracket by the slot; and wherein the strap lies in the slot and is adjustable to vary its length across the concave or recessed portion; the strap is of a fixed length; the strap is of an adjustable length; the strap of bracket includes a lock mechanism must first be released to adjust the length of the strap; the bracket being angularly adjustable in relation to a support member on which the bracket is to be mounted.

The suspension means can be the top edge of the bracket and the bracket has one or more of the following features: the top edge contours to the hull of a to be supported watercraft; the bracket is angularly adjustable in relation to a support member on which the bracket is to be mounted, by means of the use of a support means engageable with the support member; the bracket is angularly adjustable in relation to a support member on which the bracket is to be mounted, by means of the use of a support means such as pins engageable with apertures at varying lengths along the bracket.

The suspension means can be an inflatable bladder and the bracket has one or more of the following features: the bladder is fixed to the top edge of the bracket along the entire length of the concave or recessed portion; the bladder is fixed in at least one point at the entrance to the concave or recessed portion; the bladder is connected by at least one end to a strap engaging pin, wherein the strap engaging pin engages with the aperture and is restrained from movement in the directions along the length of the bracket by the slot, and wherein the strap lies in the slot.

BRIEF DESCRIPTION OF THE DRAWINGS

An embodiment or embodiments of the present invention will now be described, by way of example only, with reference to the accompanying drawings.

Figure 1:
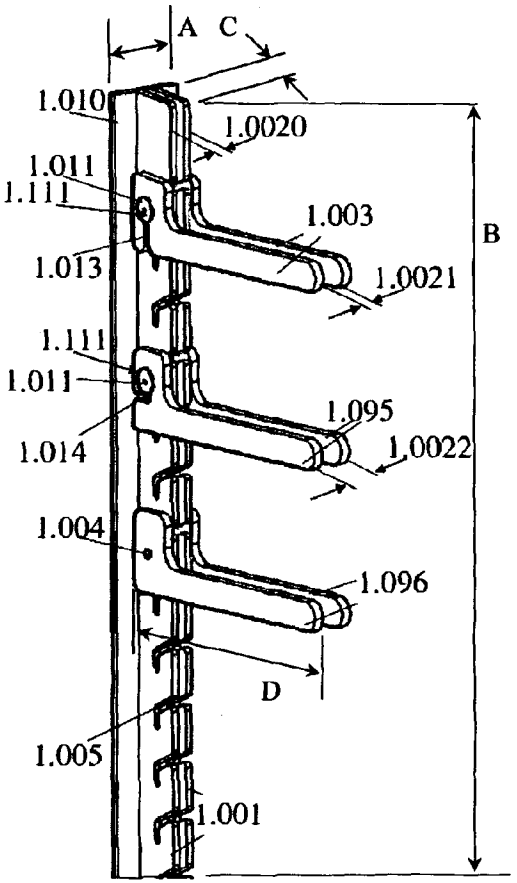
FIG. 1 illustrates a perspective view of a racking system including two support flanges, a bracket support slot and a bifurcated bracket.

The numbering convention used in the drawings is that the digits in front of the full stop indicate the drawing number, and the digits after the full stop are the element reference numbers. Where possible, the same element reference number is used in different drawings to indicate corresponding elements.

DETAILED DESCRIPTION OF THE EMBODIMENT OR EMBODIMENTS

Figures 6, 7, 8A, 8B:
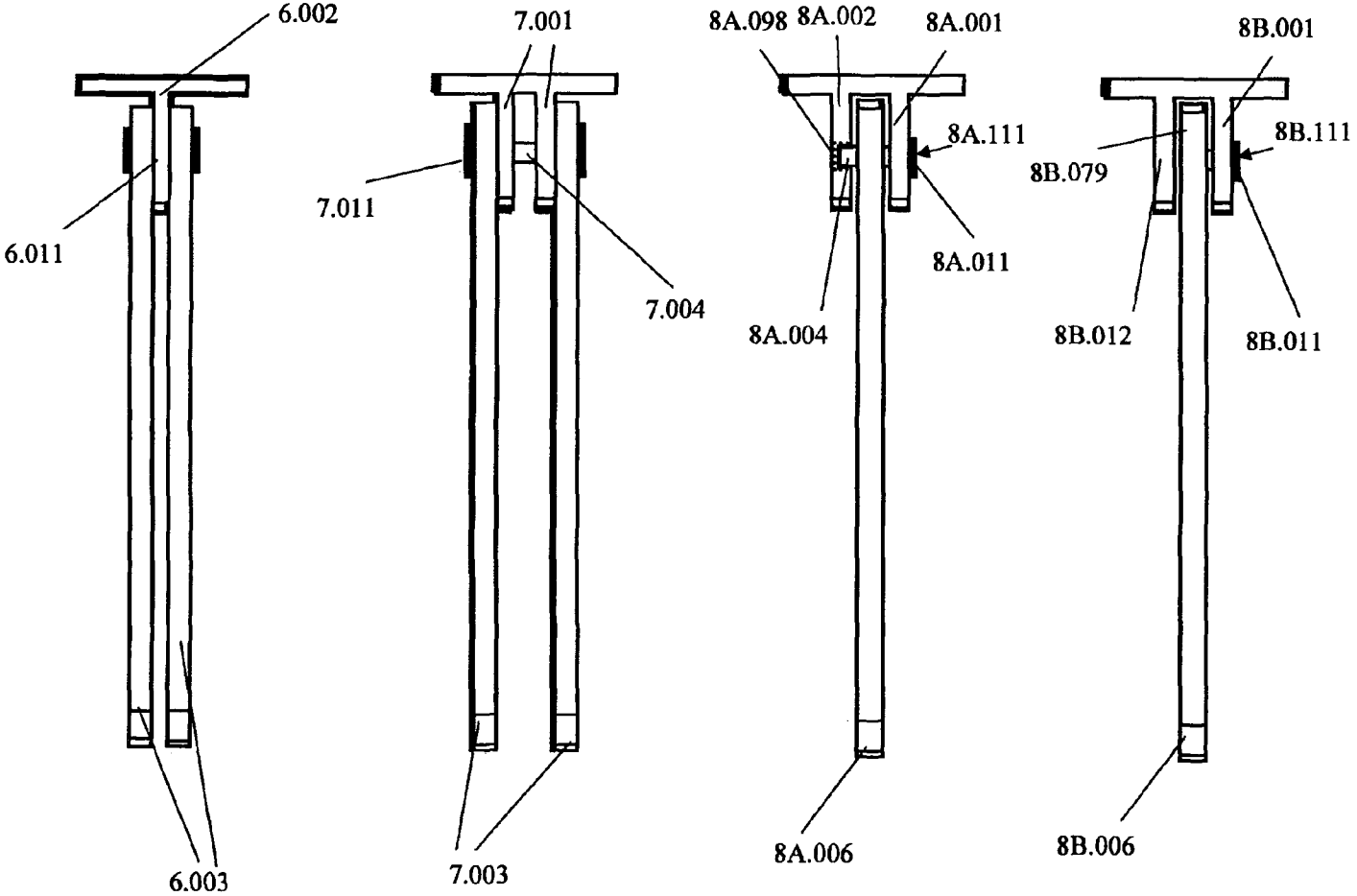
FIG. 6 is a top down view of a rack system illustrating a single support flange, a bifurcated bracket and the disc flanges of a bracket support.
FIG. 7 is a top down view of a racking system illustrating two support flanges, a bifurcated bracket and a bracket support engaged with said bifurcated bracket and two support flanges.
FIG. 8*a* is a top down view of a racking system illustrating a support flange, wherein one of said support flanges comprises of a blind slot, a bracket and a bracket support engaged with said bracket and two support flanges.
FIG. 8*b* is a bottom up view of the racking system of FIG. 8*a;*
Figure 57:
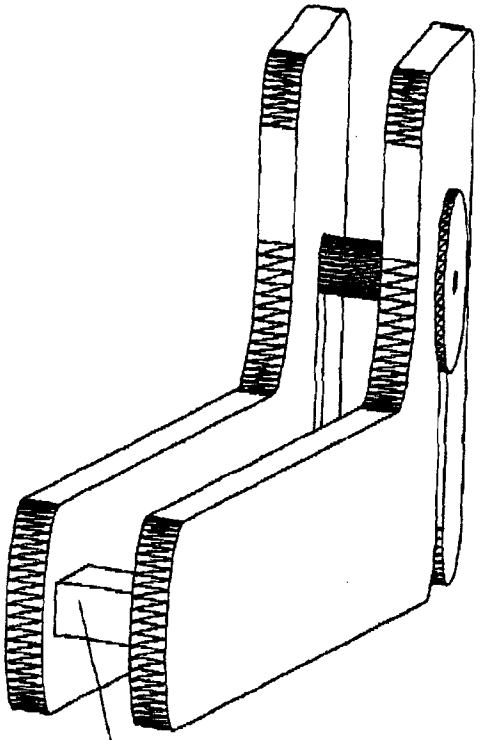

FIGS. 1 and 7 illustrate a racking system including two support flanges 1.001, with two different types of bracket support 1.004, 1.111 and three different types of bifurcated bracket 1.003, 1.095 and 1.096 each having a different engaging means 1.013, 1.014 and 1.004. The bifurcated brackets 1.003, 1.095 and 1.096 differ from each other by the manner in which they engage the support flanges 1.001, which will be further described below in the description of FIG. 9. Illustrated in FIG. 57 is a perspective view of the bracket 1.003, showing how the two arms of the bracket are joined by means of struts or joining pieces 57.456.

In FIG. 1 the support flanges 1.001 extend generally perpendicularly from a support plate 1.010, with the support flanges being fixed to the support plate 1.010, to make a structure which in cross section resembles a $\pi$ shape. The space 1.0020 between the outward surfaces of the two flanges 1.001 is approximately the same as the space 1.0021 between the inward surfaces of the arms on the bifurcated brackets 1.003, 1.095 and 1.096 so that each arm of a respective bracket sits on the outside of the two flanges. This arrangement, in combination with the bracket support used, assists in the ability of the bracket assembly to resist lateral forces applied to the brackets.

Figure 21:
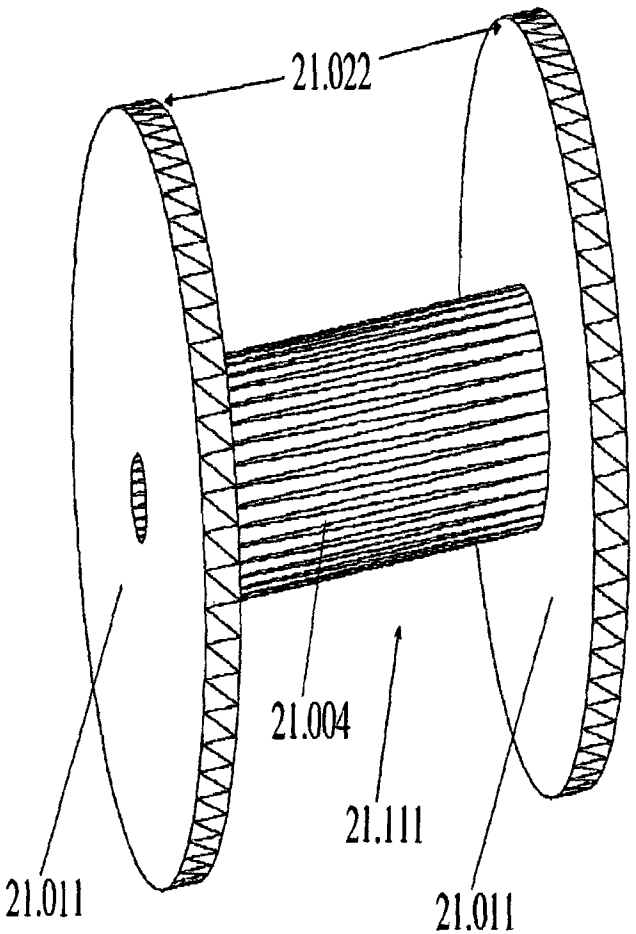
FIG. 21 illustrates a releasable bracket support.

The upper two brackets 1.003 and 1.095 in the illustration of FIG. 1 are the same type of bracket support 1.111, which is also illustrated in FIG. 21. The bracket supports 1.111 or 21.111 include a pin or rod sections 7.004, 21.004 which are provided at their ends with flanges 1.011, in this instance a disc shaped. The disc shaped flanges 1.011, 7.011, 21.011 are fixed to the pin 7.004, 21.004 (which will be further described at FIGS. 7, 8 and 9) and may be removably connected by a thread system, integrally formed therewith, permanently fixed to the pin by thread and glue, simply glued or attached by any other appropriate means. As can be seen from FIGS. 7 and 21, the perpendicular distance or space 21.022 between the inward surfaces of the discs 21.011 is approximately the same as the perpendicular distance or space 1.0022 between the outward surface of the arms of the brackets 1.003 and 1.095. By this geometry the arms of the bifurcated bracket can be removable from the bracket support 1.111 and the disc flanges 1.011 act as additional reinforcement against lateral forces placed on the brackets 1.003 and 1.095.

With respect to the bracket 1.096, the disc flange 1.011 is absent and in this bracket arrangement the arms of the bracket 1.096 must be fixed, affixed or mounted to the bracket support 1.004(in the illustrated case a pin), so that together with the geometry of the space 1.0020 and 1.0021, lateral reinforcement is provided for the bracket assembly.

Figure 4:
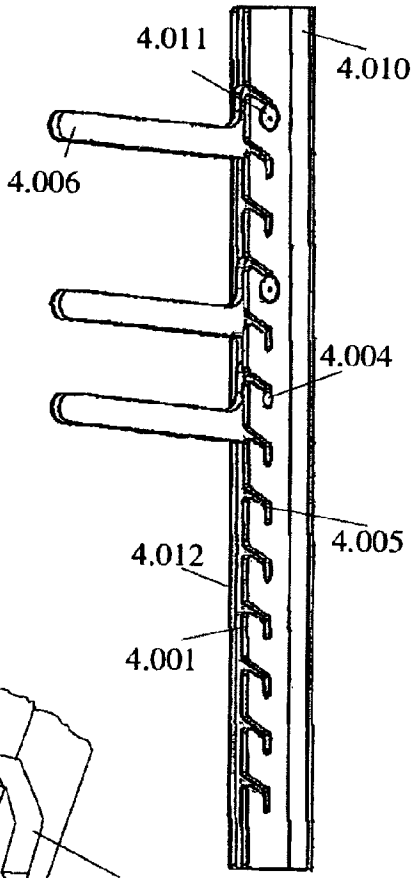
FIG. 4 illustrates a reverse perspective view of the racking system from FIG. 3, including two support flanges wherein only one support flange comprises of a slot, a bracket support slot and a bracket.
Figure 3:
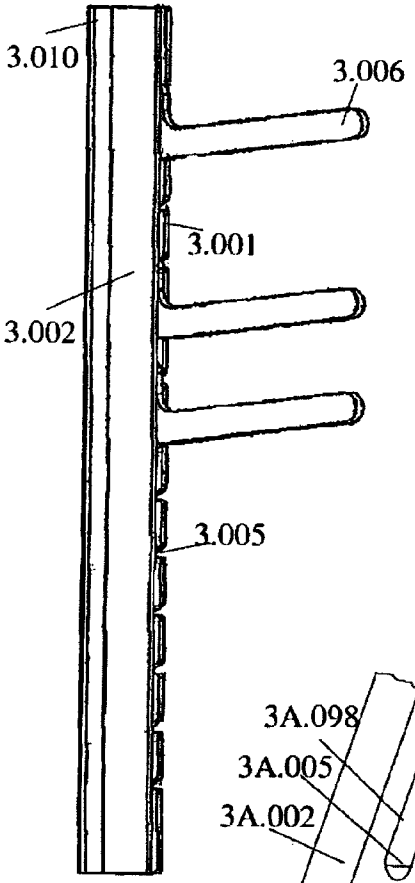
FIG. 3 illustrates a perspective view of a racking system including two support flanges wherein only one support flange comprises of a slot and a bracket.
Figure 3A:
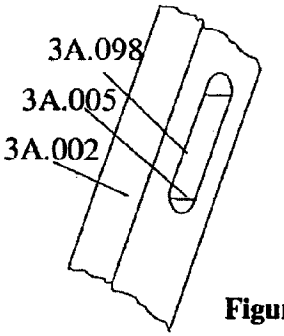
FIG. 3A is an enlarged view of a section of the support flange of FIG. 3.

Along the length or height of the support flanges 1.001 are a plurality of slots 1.005 which are preferably equi-spaced there along. Each slot 1.005 opens to three surfaces of the support flange 1.001, namely the front and two side faces. Whereas in other embodiments described below the slots open through two faces where the slots do not extend through the flange but open to the front face, and only one surface where the flange contains a blind slot as in FIGS. 3, 4 and 8.

Each slot 1.005 is shaped or profiled so that from the front face the slot angles downwardly from the horizontal and away from the opening in the front face of the flange and continues so until approximately the middle of the support flange 1.001. Then the slot 1.005 proceeds downwardly in a vertical direction to the terminus of slot 1.005 which is preferably of a radiused or semi-circular shape. This is described in more detail with respect to FIGS. 22, 23 and 34 to 38.

The slots 1.005 are dimensioned so that the width of the slot 1.005 is apt to receive the pin portion 7.004, 1.004 which comes to rest in the terminus of the slot as mentioned above, so that once a bracket such as 1.003 or 1.095 or 1.096 is engaged with a bracket support pin 7.004, 1.004 then the bracket 1.003 or 1.095 or 1.096 will be held in a cantilever fashion with respect to the support flange 1.001, by the bracket being held by pin 7.004, 1.004 and the lower rear corner of the bracket 1.003 or 1.095 or 1.096 engaging the support plate 1.010.

The slots 1.005 can be formed by any known means such as cutting, punching and moulding. When loaded, a bracket support pin 7.004, 1.004 will bear the force from the bracket 1.003 or 1.095 or 1.096 in a direction towards the mounting wall or support plate 1.010, as well as bearing the downwardly directed mass of any object placed on the end of a bracket. Thus in the racking system, both the bracket support in the slot and the wall and or the support plate on which the racking system is mounted will bear the loads.

The bracket 1.003, 1.095 or 1.096 will pivot or rotate when loaded, until such time as the lower rear corner of the bracket 1.003, 1.095 or 1.096 engages the wall and or the support plate 1.010. This pivot results in the edge of the bracket lying in close proximity to the wall, in cooperation with the bracket support pin 1.004 bearing the bending moment produced by the load. This support mechanism will be described in more detail below with respect to FIGS. 22 and 23.

In FIG. 1 the support flange 1.001 is shown as having two support flanges and a support plate. The support flanges 1.001 and the support plate 1.010 can be made of wood, metal, plastic, other polymeric or composite materials. The support flanges 1.001 and the support plate 1.010 can be formed as one piece using injection moulding, extrusion, routing, milling or other methods. If joined separately the support flanges 1.001 can be fixed to the support plate 1.010 using welding (plastic or metal), routing and joinery, screwing, bolting, riveting, gluing or a variety of other appropriate methods. Once joined the support plate 1.010 can used to fix or affix the rack system to a wall in a variety of ways including welding, screwing, bolting, riveting, joinery and others.

The wall to which the rack system is attached can be a stationary wall such as found in a building. However if desired, the wall can be part of a frame or stand upon which the racking system is to be mounted, with such a frame or stand being free standing or wheel mounted for easy movement and re-positioning.

In an alternative embodiment, a suitably wide support flange or flanges 1.001 can be secured directly to a wall or frame or stand support without the use of a support plate 1.010. In this arrangement any appropriate fixing methods between a support plate 1.010 and supporting wall or frame can be used as described above.

The brackets 1.003 or 1.095 or 1.096 can be made of any appropriate material, and would most likely be made from the same material as the support plate 1.010 or the support flanges 1.001, and can be formed using any appropriate method or technique. As illustrative dimensions for the system of FIG. 1, the base width A is approximately 160 mm. while the height B is approx 2400 mm, with the depth C of the support flanges 1.001 being of the order of 100 mm. The length D of the bracket 1.096 is of the order of 750 mm, while the height E of the bracket end 1.096 is the order of 80 mm while its thickness is of the order of 25 mm.

Figure 2:
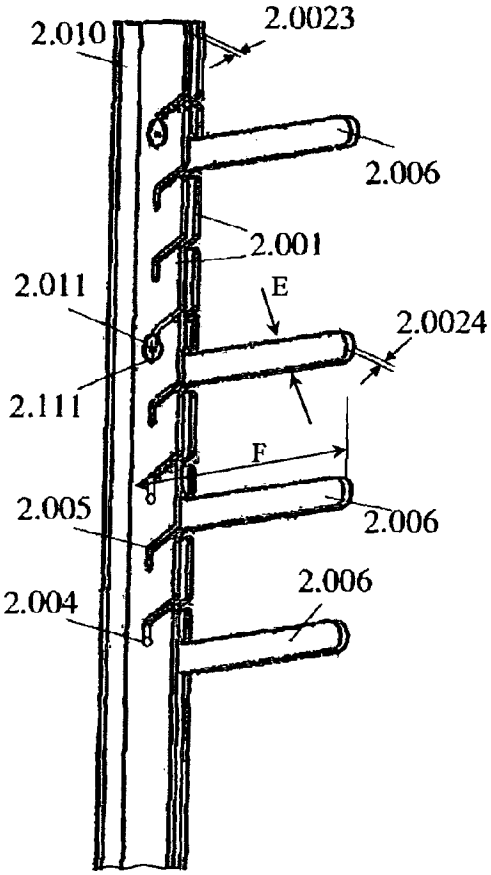
FIG. 2 is a perspective view of a racking system including two support flanges, a bracket support slot and a bracket.

FIGS. 2 and 8 illustrates a modified racking system which is similar to that described above. The racking system's two support flanges 2.001 are spaced apart so as to receive a single or non-bifurcated bracket 2.006 between the flanges. The inwards faces of the flanges 2.001 are spaced apart at a distance 2.0023 approximately equivalent to the width or thickness 2.0024 of the bracket 2.006 that sits between the flanges 2.001, ensuring a close fit reinforcing the bracket with respect to lateral forces applied to the bracket when being loaded or unloaded.

In the embodiment of FIGS. 2 and 8, the support flanges 2.001 are mounted to a support plate 2.010, however, they can be formed and or joined in the same manner as described above.

In FIG. 2, two types of bracket supports are shown, namely bracket support 2.111, having disc flanges 2.011 on both sides and 2.004 without disc flanges. The disc flanges 2.011 are located adjacent the outward face of each of the support flanges 2.001. The bracket support 2.111 differs from the bracket support 1.111 in that the distance 21.022 between the disc flanges 22.011 is less. By the disc flanges 2.011 being adjacent the outwards face of each support flange 2.001 the bracket 2.006 is reinforced against lateral forces applied to the bracket 2.006.

As above the disc flanges 2.011 are fixed to the ends of a pin 2.004 and can be removable or permanently fixed. The bracket 2.006 engages with the pin 2.004 between the disc flanges 2.011 and can be removable from the pin or fixed in place.

The two lower brackets 2.0061 illustrated in FIG. 2 can be of the same construction as the brackets 2.006, however the brackets 2.0061 each have a single pin 2.004 to be the bracket support, that is the pin 2.004 does not include disc flanges 2.011, but still sits in the flange slots 2.005 and is fixed to the respective bracket 2.0061.

The bracket assembly of FIG. 2 functions in a similar manner as described above with respect to FIG. 1 to bear bending moments and loads placed on the brackets 2.006, 2.0061. Illustrative of the construction the length F of the bracket 2.006 is of the order of 750 mm, while the height E of the bracket end 2.006 is the order of 80 mm while its thickness is of the order of 25 mm.

Illustrated in FIGS. 3, 3A, 4, 4A, 8*a* and 8*b* is a racking system including a support flange with two support flanges 3.001 and 3.002 wherein support flanges 3.001 is identical to the support flanges 1.001. However, the second support flange 3.002 has either a blind slot or no slot at all. The two support flanges 3.001 and 3.002 are spaced apart in the same manner as described for FIG. 2. In the version which has a blind slot, such as slot 3A.098, the blind slot opens through one surface of the support flange 3A.002 being the inwards face. The profile of the slot 3A.098 need only be straight and vertical, with the terminus 3A.051 being at the bottom of the slot 3A.098, and at the same location or aligned with the terminus of the slot 3.005, which is of the same profile as those in FIGS. 1 and 2.

Where a blind slot 3A.098 is used with a single disc flanged bracket support 8A.111, there are two possible methods of assembly. A first method requires the bracket support pin 8A.004 which has a single disc flange 8A.011 on at least one end of the bracket support pin 8A.004 being pushed through the support flange 8A.001 and through the bracket 8A.006 so as to enter the blind slot 8A.098 so that the pin 8A.004 will rest in the termini of the slots on the respective support flanges 8.002 and 8.001.

A second method requires that the bracket support 8A.111 be pushed through the slot 3.005, then into the blind slot 3A.005 and once there and in the termini of the slots on respective support flanges 3.001 and 3.002, the bracket 3.006 can be positioned on the bracket support pin 8A.004 between the inward surfaces of the support flanges 3.001 and 3.002.

If desired, a bracket support without disc flanges can be used in much the same manner as the bracket support 8A.111, so that it will extend into the blind slot 8A.098 and thus into the support flange 8A.002 through the support flange 8A.001. The assembly method used can be either of the first and second methods described above.

In the arrangement where the support flange 3.002 does not contain a slot, the bracket support 3.111 can be fixed to the bracket 3.006 and the bracket support pin 3.004 extends from only one side of the bracket and through the slotted side of the support flange 3.001. The face of the bracket 3.001 abuts the inward face of the support flange 3.002 acting to reinforce against lateral forces. The bracket 3.006 lies within the flanges as described above.

The support flanges 3.001 and 3.002 and bracket 3.006 can be manufactured as mentioned above with respect to the previously described embodiments.

Figure 4A:
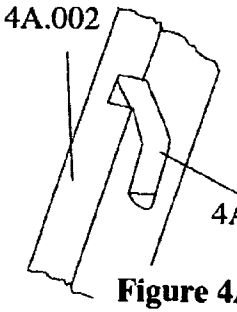
FIG. 4A is an enlarged view of a section of the support flange of FIG. 4.

Illustrated in FIG. 4A is support flange 4A.002 which has its slot 4A.005 part way through the support flange 4A.002, and the slot 4A.005 only opens through two surfaces of the support flange 4A.002, namely the inward surface of the support flange 4A.002 and the front face or surface. While one such support flange 4A.002 can be used with a support flange 4.001, if desired two support flanges 4A.002, one the mirror image of the other, can be used with the slots 4A.004 on the inward surfaces when assembled to a wall or to a support plate 4.010. This will provide a racking system with a neater appearance, as the slots will not be visible from the outward directions, but the extra rigidity that is provided by the slots 4A.005 passing through only two surfaces, may not provide a sufficiently elastic suspension system of its own accord, but may do so with a suitably constructed bracket as will be described below. A similar comment can be made in respect of the blind slot 3A.005.

Figure 5:
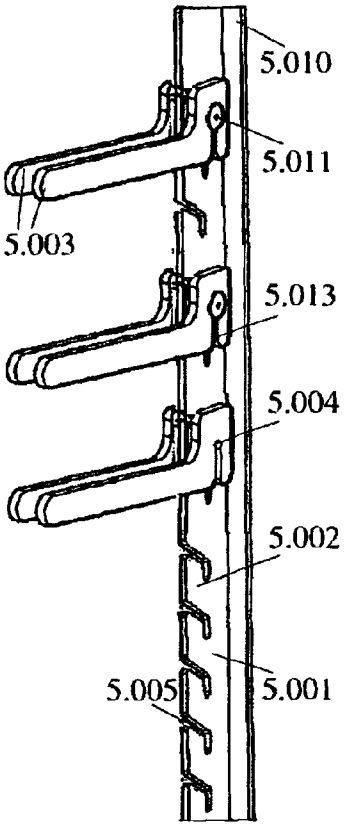
FIG. 5 illustrates a perspective view of a racking system including a single support flange, a bracket support slot and a bifurcated bracket.

FIGS. 5 and 6 show a racking system, wherein a single support flange 5.001 which receives in its slots 5.005 a flanged bracket support 5.111 or a pin type bracket support 5.004, which engages or is engaged by a bifurcated bracket 5.003. The single support flange 5.001 is fixed to the support plate 5.010 in a T shaped configuration.

The bracket 5.003 has an engagement slot 5.013 to receive the pin portion 5.004 of the bracket support 5.111. The slot 5.013 has a second function which will be described in more detail below. A dual disc flanged 5.011 bracket support 5.111 is used with the gap between flanges 5.011 being approximately equal to the combined thicknesses of the support flange 5.001, and the two arms of the bracket 5.003. Further, the space between the two arms of the bracket 5.003 is approximately the same as the thickness of the single support flange 5.001.

The bracket supports 5.111 or 5.004 operate with the bracket 5.003 in a manner similar to that as described for other embodiments and are numbered in the same way.

With the embodiments described above the bracket supports 1.111, and 1.004 for example are described as being separate to or affixed to the respective brackets. However, if desired the respective bracket supports can be integrally formed, say be injection or other moulding, with the brackets, or for that matter, integrally formed with the support flanges or each support flange.

FIG. 8A shows a support flange 8A.001 and 8A.002, one being a slotted flange and the other having an aligned blind slot in the flange, with the blind slot 8.098 shown in partial cross section for ease of illustration. The bracket support pin 8.004 has one disc flange 8.011 at one end whilst the other end of the pin 8.004 sits within the blind slot 8.098. In this arrangement the bracket support 8.111 is preferably fixed to the bracket, or the support flanges to avoid the bracket support 8.111 from inadvertently moving out of the slots upon the application of loads in use.

FIG. 8B shows two support flange 8B.001, and 8B.012 the former being slotted flange and the latter being without slots. The bracket support pin 8.004 is as described above for other embodiments and is numbered accordingly. In this arrangement the bracket support is preferably integrally formed with the bracket to avoid the bracket support moving out of the slot by loading forces. The bracket side without a pin 8.003 sits against the inward face of the support flange 8B.002 which is without slots and is held in place by the inward support flange walls and the pin 8B.004 of the bracket support 8B.111.

Figure 9:
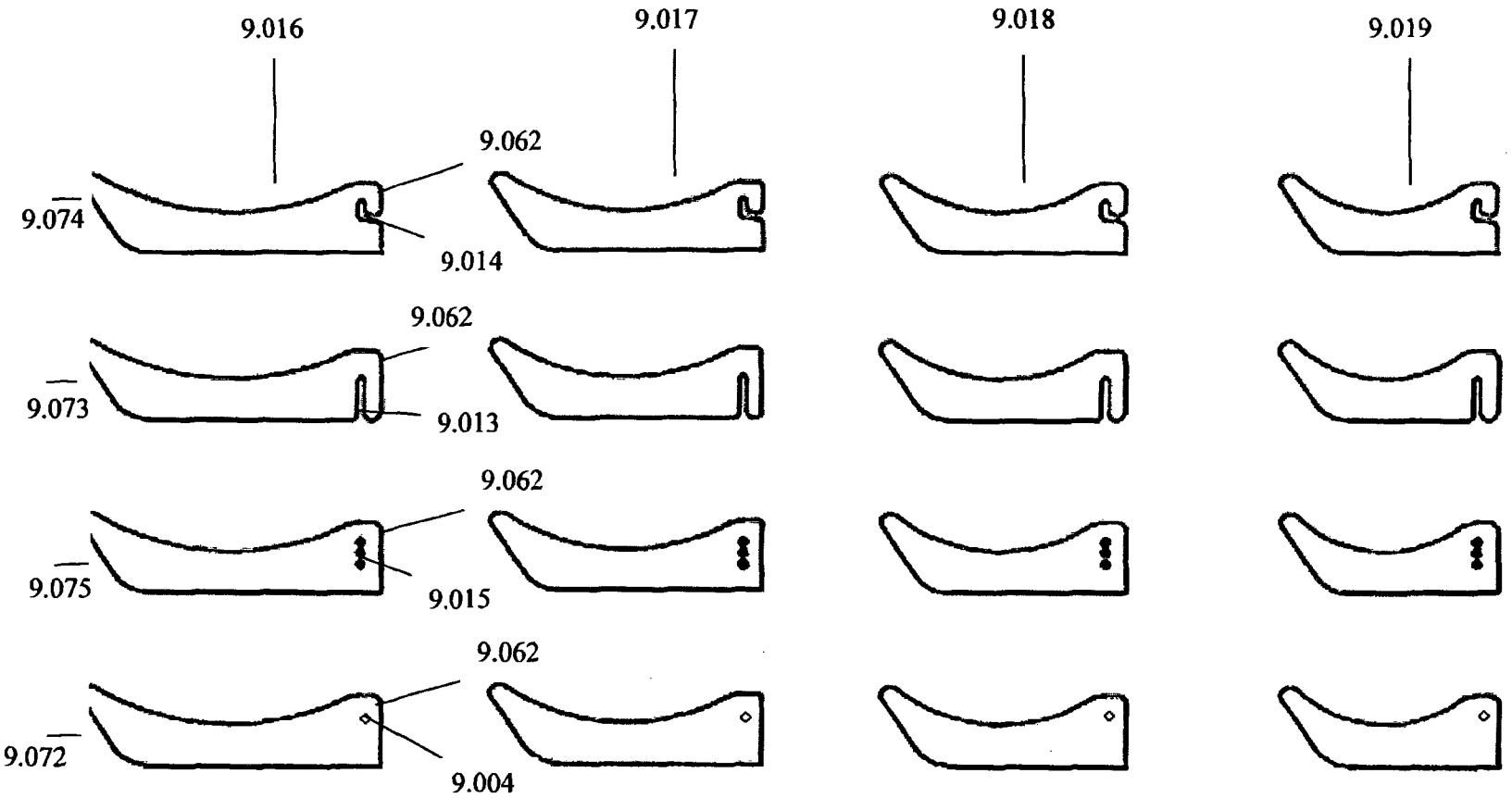
FIG. 9 is a side on view of a variety of canter lever brackets illustrating a variety of dimensions and engaging means.

FIG. 9 illustrates a series of cantilever brackets that may be engaged with a bracket support. Row 9.074 illustrates a bracket having an L-shaped aperture which extends first horizontally inwards from the wall mounted face of the bracket and then vertically upwards to a terminus. This engaging means holds the pin portion of the bracket support in the terminus of the vertical portion of the aperture. When the cantilever is loaded the pin in the bracket support and the load bearing lowermost, rearmost edge 9.062 prevents any further rotation of the bracket around the pin of the bracket support. As discussed above the application of load in the form of bending moments on the cantilever brackets causes the bracket to pivot putting a load bearing force on the rear edge 9.062 and on the pin in the bracket support.

The L shaped apertures in row 9.074 can also work together with the shape of the slots in the support flange to damp movement, and provide a source of elasticity. The length and thickness of the bracket and the support flanges can assist in this role when a load is placed on the cantilever. When a load is placed on the bracket mounted on a support flange via the bracket support, the aperture can close around the pin of the bracket support thereby absorbing the force of loading and protecting the load from damage which will be further discussed below at FIGS. 11 and 12.

Row 9.073 illustrates an engaging means for the cantilever bracket with a bracket support which has a slot that extends downwardly to the base of the bracket for an engaging with and receiving the bracket support and to provide a spring and or motion damping. The pin in the bracket support will sit in the terminus at the top of the vertical slot in the rear of the bracket. In this arrangement when engaged with a bracket support and loaded the vertical slot can flex, closing around the pin, thereby allowing the bracket to have elastic and damping properties, which will be further discussed below at FIGS. 11 and 12.

Row 9.075 illustrates a cantilever bracket wherein three apertures at different vertical locations on the bracket are provided to receive the pin portions of the bracket support. Pins in a bracket support will extend through at least one of the apertures in the bracket. The brackets of row 9.075 can be used in one of two methods. Firstly they can be used with a single pin of a bracket support, in one of the three apertures. For more damping the upper aperture can be used, while for less damping the lower aperture could be used.

In a second method, two non disc flanged pins could be used in adjacent aperture, or separated by being in the top and bottom aperture, and then positioned in the slot on the support flange. In this instance the two pins can work together to provide a degree of elasticity. When more than one aperture in the bracket is used the cantilever is fixed in place and the pivoting of the bracket mentioned above does not occur. In this arrangement the force upon loading is absorbed at the aperture points. If the load bearing edge 9.062 of the cantilever is placed against the support plate or support wall the rear wall absorbs some of the force but the majority of the force is still absorbed by the bracket support pins through the apertures.

Row 9.072 illustrates a bracket support extended through a bracket. In this embodiment a single aperture is found in a bracket in close proximity to the load bearing edge 9.062 of the bracket. The cantilever will pivot around the aperture loaded engaged with a bracket support pin and force will be absorbed by the pin and the lower edge of the load bearing edge 9.062.

Columns 9.016 through to 9.019 illustrate a variety of lengths of cantilever bracket that can be used with 9.016 illustrating a longer canter lever through to 9.019 illustrating a shorter canter lever. These differing lengths provide a gradation of elasticity whereby the longer brackets have more elasticity or capability for elastic deformation under load, than the shorter brackets.

Figure 10:
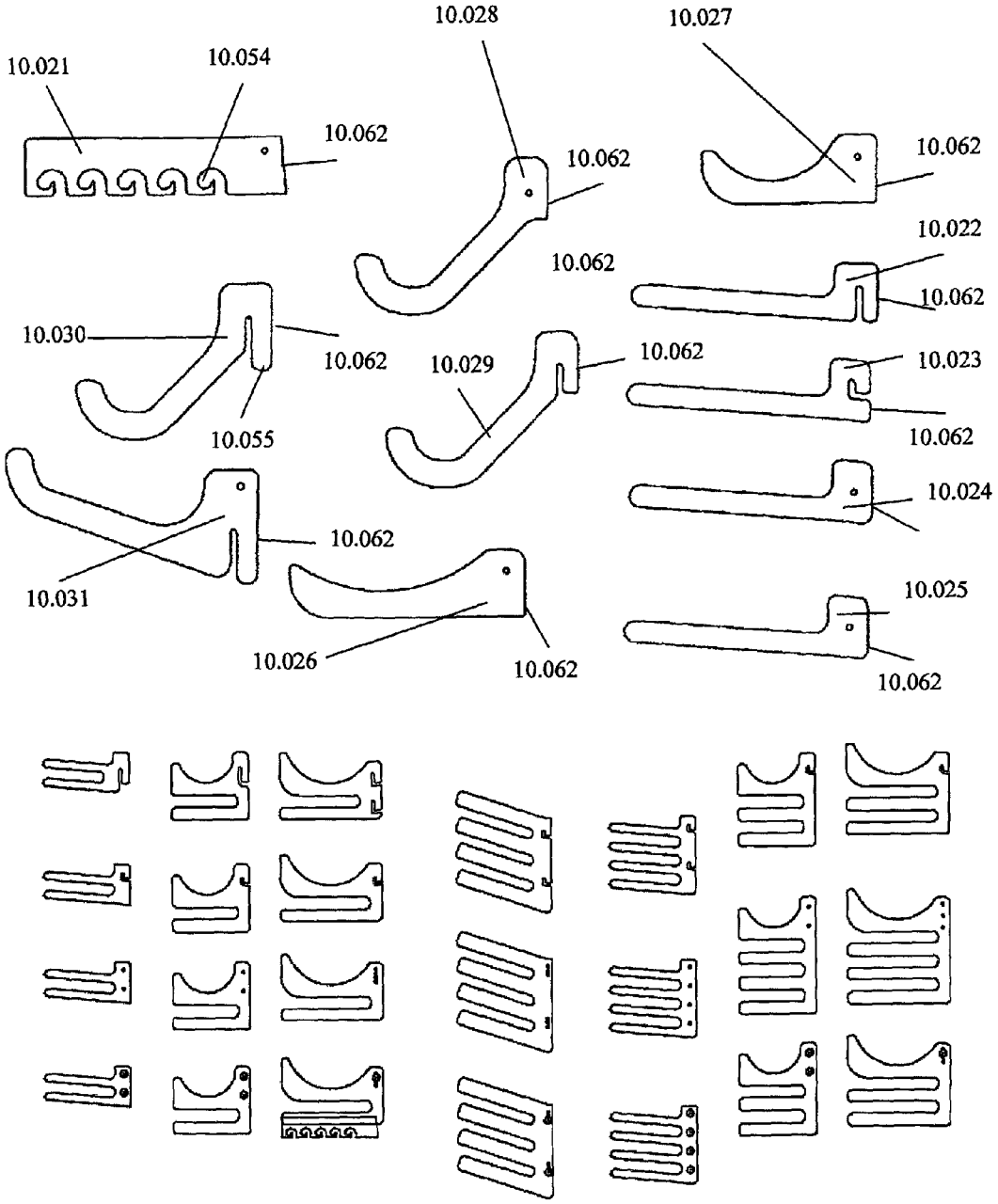
FIG. 10 illustrates in the top part of the figure a variety of single bracket profiles for supporting a variety of different loads, while it illustrates in the lower part a variety of multiple bracket profiles for supporting loads.

FIG. 10 illustrates some of the variations possible in the profile of the brackets to be engaged with bracket supports and support flanges. Common to all cantilever brackets to be used in this racking system is the load bearing edge 10.062. The load bearing edge lies along either the support plate or wall from which the support flanges project. The engaging slot or means of the brackets shown in this FIG. 10 as a variety of slots or apertures either circular, L-shaped, or vertical is to be in close proximity to this load bearing edge to enable firm support between the support plate or wall and bracket. The distance between the centre of the terminus of the aperture and the distance between the terminus of the slots in the flanges and the support plate or wall are generally of similar magnitude to restrict the bracket from pivoting upon loading. All of these examples can be fitted with all of the racking system variations as discussed above and below. The various shapes accommodate different equipment to be stored on the racking system, such as surf boards, surf skis, catamaran hulls, etc, with the upper brackets being single supports while the lower brackets having two three or four supports with combinations of hull supports at the top while below may be fishing rod or hanging hooks, or straight support arms, angled or not.

10.021 illustrates a straight cantilever bracket wherein hooked profiles have been cut along the length of the bracket allowing objects to be placed inside the hooks either individually or between brackets, such as fishing rods, ski poles etc, when more than one support flange is part of a racking system.

Bracket 10.030 illustrates a bracket that is angled down and finishes in a hook with engaging means designed to allow flex upon loading as will be described further below. By having a long vertical load bearing wall creating a longer vertical aperture the bending moment that is borne upon loading is increased meaning that greater flex will result upon loading of a lesser weight.

Bracket 10.028 illustrates a similarly profiled angle down hooked bracket as in 10.030 without the flexible engaging means for damping upon loading with a circular aperture able to receive a pin bracket support.

Bracket 10.029 is angled down and hooked as in that preceding two Figures and is equipped with dampening means but to a lesser extent than 10.030 with more force being required to engage the flexing motion as the length of the vertical aperture is shorter creating less torque than on 10.30 upon the same loading.

Bracket 10.031 illustrates an angled up bracket with a turned up end also with a vertical aperture damping means at the engaging aperture with a long aperture creating large torque and flexing from a lesser weight than for 10.29.

Bracket 10.026 illustrates at straight cantilever with a curved face to engage loaded goods with a circular aperture for receiving a pin bracket support near the load bearing edge. Bracket 10.027 is of a similar arrangement with a shorter length and greater radius of curvature in proportion to diameter to support loads in place.

Bracket 10.022 is a bracket angled slightly up with a vertical aperture dampening means at the engaging aperture as for 10.29. While bracket 10.023 illustrates a slightly angled up straight cantilever with a L-shaped aperture engaging means providing elasticity and or allowing damping of force from a load. In this example as the aperture extends to the load bearing edge, as the force first exerts upon the bottom edge this dampening the dampening effect of this arrangement will require more force and weight to be used than in the other examples. Bracket 10.024 is a angled up straight bracket with a circular aperture engaging means leaving any damping properties to the properties inherent in the material of the bracket itself. Whereas bracket 10.025 is a straight bracket angled up more so than in 10.24 with a round aperture giving limited dampening properties.

The examples of brackets in FIG. 10, particularly those with the slots, can also have a circular aperture above the slot (as in bracket 10.031) to receive the pin of a bracket support, so that a user is able to use either means. This will allow the maximum length of slot so as to provide elasticity and or damping of the motion of an object placed or dropped onto the bracket when mounted in a racking system as described previously.

Figure 11:
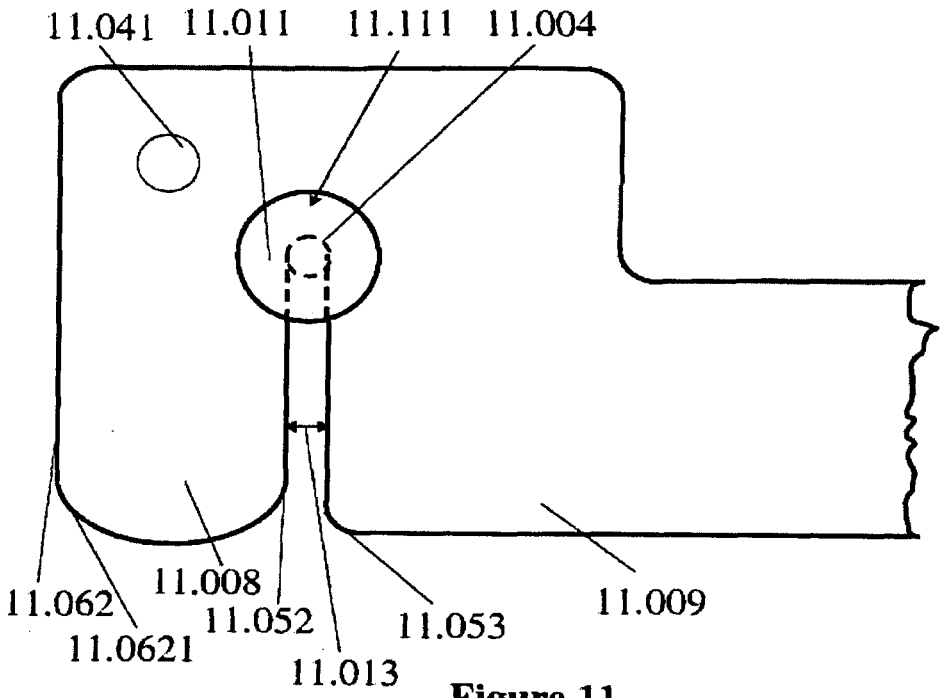
FIG. 11 illustrates a side on view of a bracket illustrating a bracket support disc flange and illustrating an extended aperture in said bracket allowing for flex in said bracket upon loading.

FIG. 11 illustrates a side-on view of the engaging slot or engaging means 11.013 of a bracket with damping or elastic properties in the bracket. The generally vertically aligned slot 11.013 has a width that remains open when the bracket is unloaded. Upon loading the bracket, with the pin 11.004 at the top of the slot 11.013 and in the slot 1.005 in the support flange 1.001, as has been described above, the supporting plate 1.010 or the supporting wall to which the supporting flange 1.001 is mounted, will be engaged or abutted by the lowermost rearward most portion of the rear edge 11.0621 (in the vicinity of where lead line for 11.062 is pointing), in this case on the rear tongue 11.008. At which point the bracket cannot rotate further and the corner or edge 11.053 will approach the edge 11.052 on the opposite side of the slot 11.013 thereby flexing around the pin 11.004 closing the gap 11.013 due to the bending moment applied by and to the bracket. For the elasticity and or damping to be generated the back face 11.062 of the bracket needs to be in close proximity to the support plate 1.010 or mounting wall from which the support flanges 1.001 extend, so that the bottom edge 11.0621 of the load bearing rear edge 11.062 can engage with the support plate or wall thereby causing the closing of the gap. In this embodiment a separate removable bracket support 11.111 with a pin 11.004 is shown. Where a disc flanged end on the bracket support is used a support flange having slots which open through three faces of the support flange is preferred.

In the arrangement of FIG. 11, a pin receiving aperture 11.041 is provided above the upper termini of the slot 11.013 so that a user has the option of changing the rest angle of the bracket with respect to the support flange and simultaneously increasing the elasticity or damping by not requiring the pin 11.004 to be located in the slot 11.013. If the rest angle of the bracket with respect to the support flange needs to be different the aperture 11.041 can be located at a different location on the end of the bracket.

Figure 12:
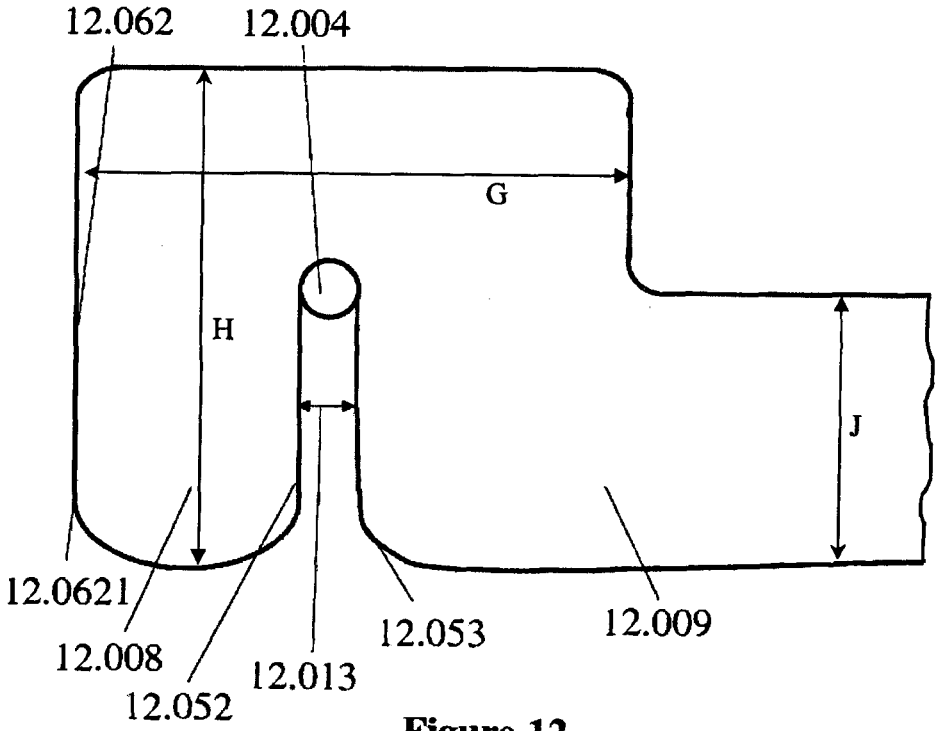
FIG. 12 illustrates engaging means in a bracket wherein the engaging means incorporates a damping means.

FIG. 12 illustrates a bracket end similar to that of FIG. 11 where pin 12.004 is used without a disc flange wherein the pin extends into a slot either blind or through. Illustrative of the dimensions used for the brackets of FIGS. 11 and 12, the length G is of the order of 160 mm while the height H is of the order of 215 mm with the bracket height J being of the order of 100 mm. The width of the slot 12.013 is of the order of 23 mm while the pin 12.004 is of a radius of the order of 11 mm.

Figures 13, 14, 15, 16, 17, 18:
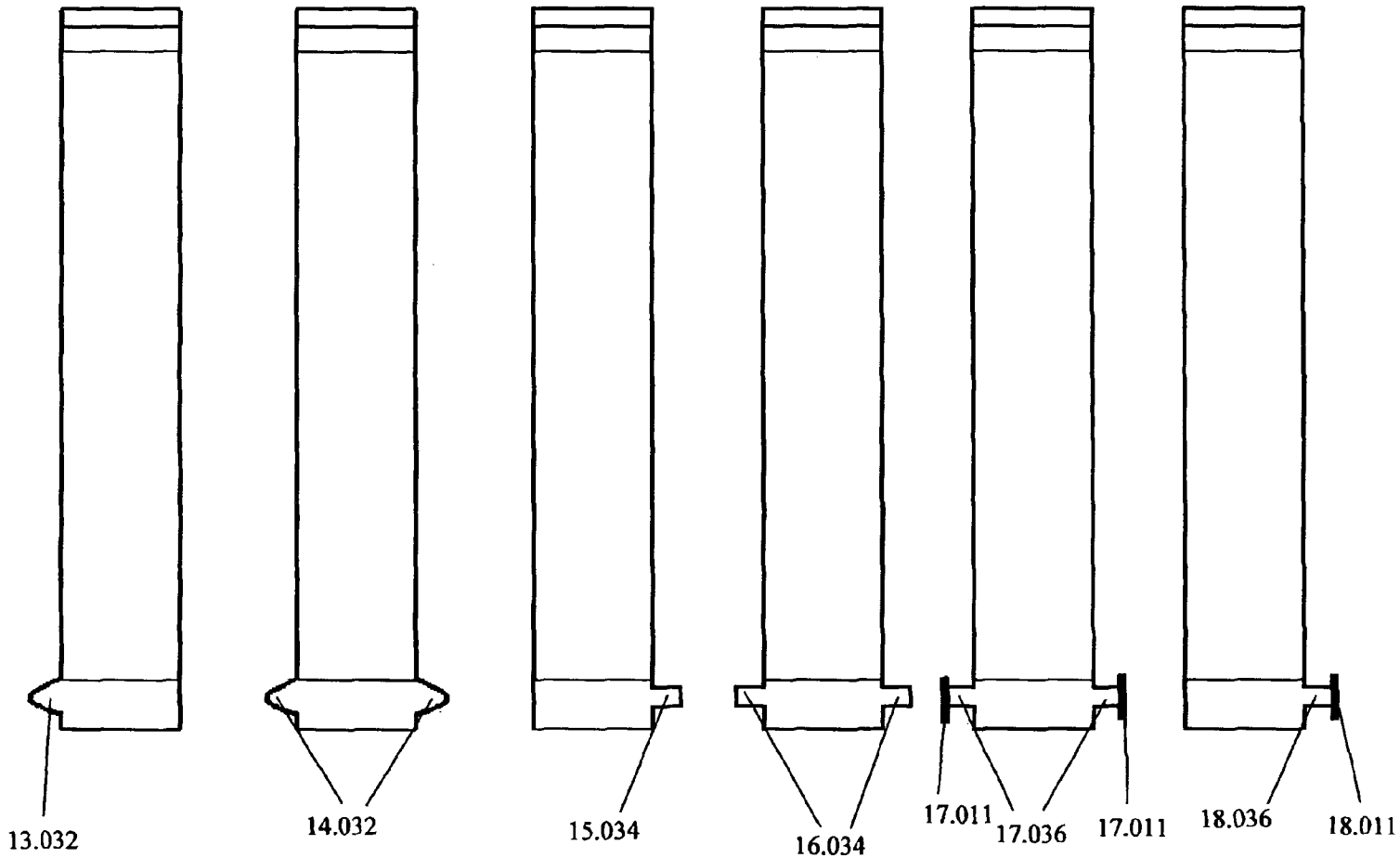
FIGS. 13 to 20 are plans views of brackets respectively showing: a bracket support extending from one side of said bracket; bracket supports extending from both sides of the bracket; bracket support extending from one side of said bracket; bracket supports extending from both sides of said bracket; bracket supports extending from both sides of said bracket, wherein said bracket supports have a disc flanged end; a bracket support extending from one side of said bracket, wherein said bracket support is a disc flanged end; bracket support being a spring-driven extendable pin; bracket supports having an extendable pin with a spring lock mechanism.

FIG. 13 is a top down view of a bracket wherein a bracket support 13.032 is integrally formed within the bracket extending from one side of the bracket. A two flanged support flange will be required with the bracket of FIG. 13, so as to fit between the inward surfaces of the support flanges as described above for FIGS. 3, 4, 8A and 8B. The slot in which the bracket support engages need not be square to the surface of the flange, the slot can be rounded or irregularly shaped and still hold this bracket support. The distance between the flanges will need to be approximately the same as the width of the bracket.

FIG. 14 illustrates a top down view of a bracket wherein bracket supports are integrally formed within the bracket and extend from two opposite sides of the bracket. In this embodiment a support flange with two slotted flanges is required with the bracket sitting between the flanges. In this embodiment the slots in the flanges need not be square as in FIG. 13.

The embodiments of FIGS. 13 and 14 allow the use of blind slots in the support flanges, wherein the flexibility between the adjacent support flanges can allow them to be prised away form each other to allow the tapered, hemispherical or conical bracket supports 13.032 and 14.032 to make their passage into the blind slots. These embodiments also allow the blind "slots" to be discrete blind recesses which are not elongated, such as circular recesses, to be used.

FIG. 15 is a plan view of a bracket wherein a square or cylindrical bracket support 15.034 is integrally formed with the bracket extending from one side. In this embodiment a support flange with two flanges is required as for FIG. 13. The distance between the support flanges will preferably be approximately the same as the width of the bracket.

FIG. 16 is a plan view of a bracket wherein a pair of opposed bracket supports 16.034 are integrally formed with the bracket extending from two opposite faces of the bracket. The bracket lies between the flanges and the bracket supports engage with adjacent slots as for FIG. 14.

FIGS. 17 and 18 are plan views of brackets having integrally formed bracket supports 17.036 and 18.036 which are integrally formed as in FIGS. 15 and 16, except that disc flanges 17.011 and 18.011 are also integrally formed with the bracket.

Figure 19:
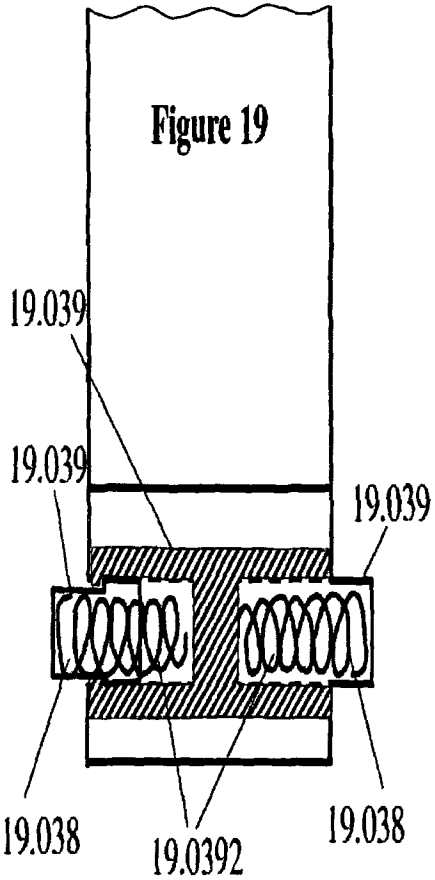

FIG. 19 is a plan view of a bracket wherein bracket supports are integrally formed with or separately formed and attached to the bracket, with the bracket supports located on opposite sides of the bracket. The bracket supports 19.038 are telescoping biased pins 19.039 where the external perimeter of the extendible portion of the pin 19.039 sits inside the internal perimeter of the fixed portion 19.0391 of the pin 19.038 where a compression spring 19.032 is situated to provide a bias forcing the moveable portion 19.039 in an outward direction. When in the rest position the pins are extended due to springs 19.0392 expanding and pushing out the pins. The bracket of FIG. 19 is usable with blind slots and with open slots, as well as racks which have one of two or both support flanges having slots. The extendable pins can be compressed in order for the bracket supports to fit within the blind slots. When in the compressed position the distance between the two extendible pins will fit within the distance between the internal walls of the two blind slots that are parallel with the side walls of the brackets. When the distance between extendible pins extended is greater than the distance between the surfaces through which the blind slots open. The bracket otherwise sits within the support flange as described above. This arrangement can also be used in a support flange consisting of two flanges wherein the flanges comprise slots open on three faces.

Figure 20:
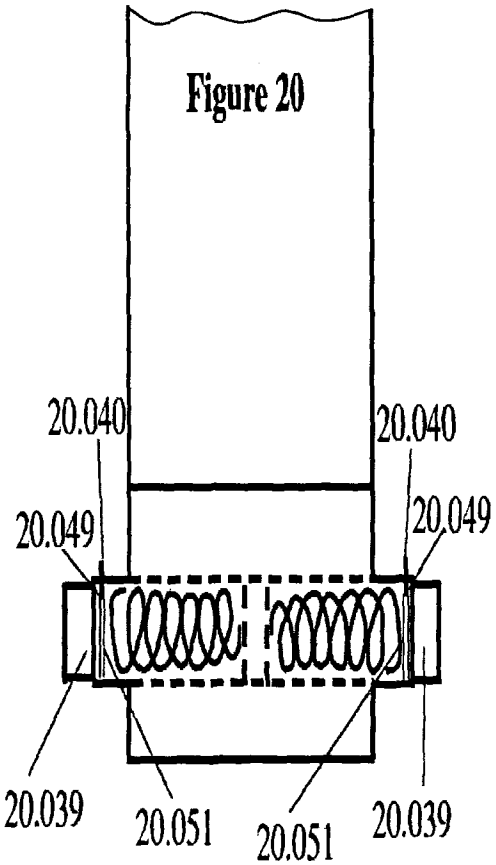

FIG. 20 is a plan view of a bracket including bracket supports as in FIG. 19 with extension of the extendible pins 2.039 being controlled by an internal spring lock 20.051 which is in turn controlled through the use of an external button 20.040 and internal pin 20.049. When the button mechanism is pressed the internal pin is extended into the extendible pin moving a leaf spring which allows a major spring to extend the extendible pin. The leaf spring and internal pin allow the extendible pin to be locked in the extended and retracted position. For the bracket supports to engage with a support flange the extendable pins must be contracted to fit within blind slots as in FIG. 19.

FIG. 21 illustrates a bracket support system including a pin 21.004 and a disc flange 21.011. The pin is disc flanged with two disc flanges leaving the space 21.022 between the two disc flanges apt to receive a bracket and a support flange. The Figures described above have illustrated instances where disc flanged bracket supports are to be used. The disc flanges are fixed to the pin in this arrangement but can be removable. Illustrative of the dimensions of the pin 21.004, this has a radius of the order of 11 mm while the flanges 21.011 have a radius of the order of 35 mm.

Figure 22:
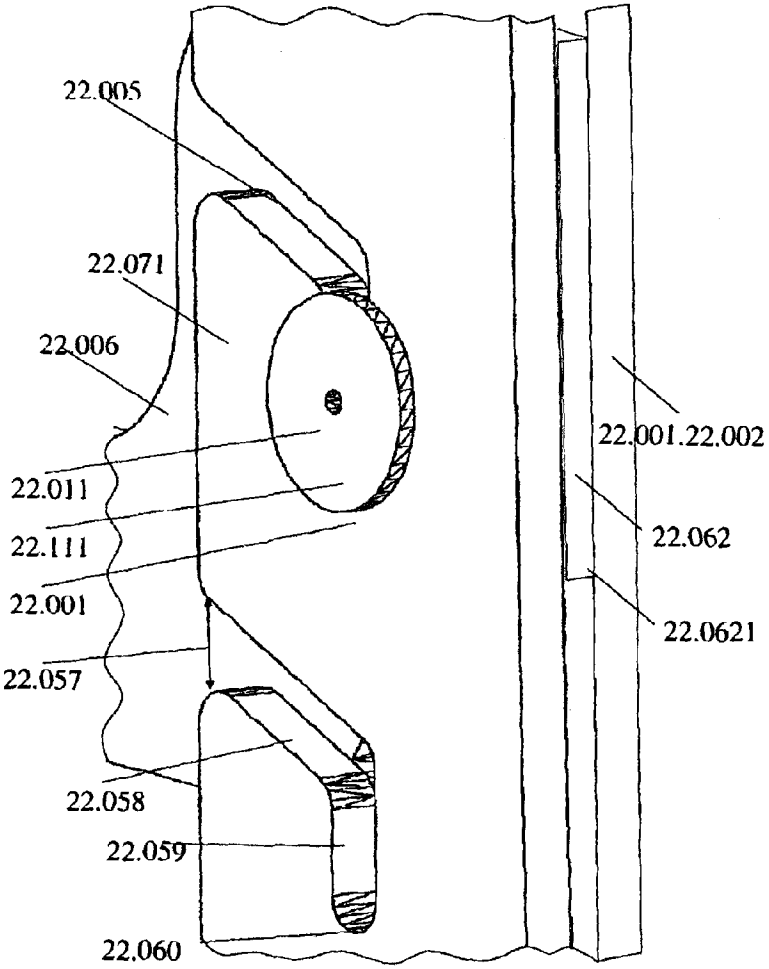
FIG. 22 is a perspective view of a bracket engaged with a support flange through the use of a pin in a slot.

FIG. 22 shows a detailed perspective view of portion of a support flange with a bracket 22.006 engaged with a bracket support 22.111 including a pin between disc flanges 22.011 sitting in the terminus of a slot 22.005 in the support flange 22.001. As illustrated it is possible for the bracket 22.06 to be held by a two support flanges 22.001 or a single support flange 22.001 with the two disc flanges acting to restrict lateral movement. The pin is inserted into the opening 22.057 of the slot 22.005 and is then progresses along the angled slot section 22.058 (angled downwardly from the horizontal) and then progresses down the vertical section 22.059 of the slot to sit in the radiused or semi-circular terminus 22.060 of the slot. The bracket is mounted and held in place as described above for similar embodiments and is numbered accordingly.

Figure 23:
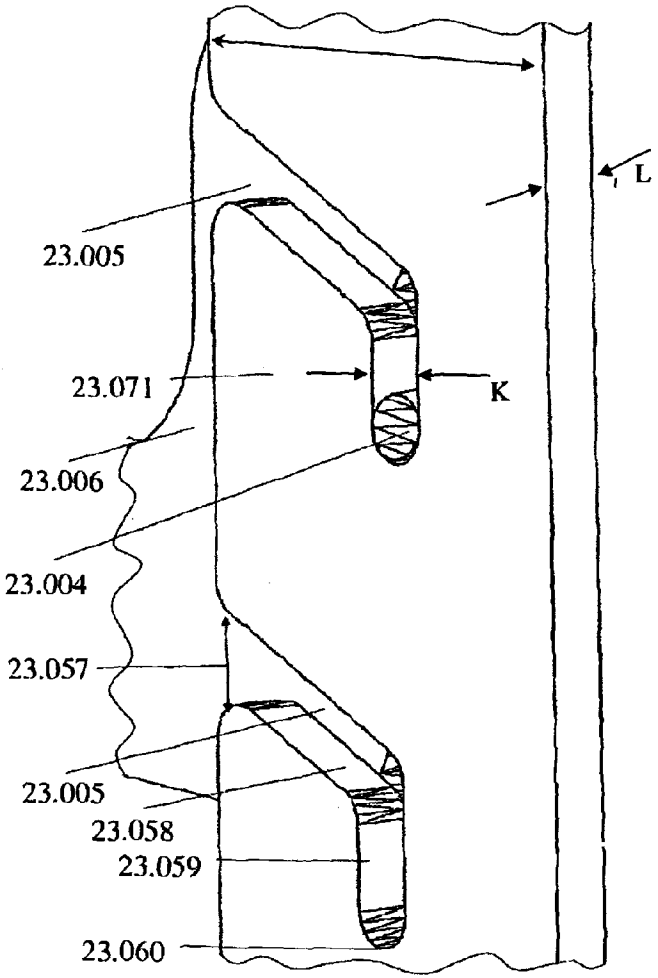
FIG. 23 is a perspective view of a bracket engaged with a support flange through the use of a pin, wherein said pin is disc flanged.

FIG. 23 illustrates a bracket 22.006 engaged with a non disc flanged bracket support 23.004 which is in turn engaged with a slot 23.005 within a support flange. The non disc flanged bracket support 23.004 operates in the same way as described in previous similar embodiments and is numbered accordingly. Illustrative of the dimensions of the system of FIG. 23 is that the slot 23.005 is of the order of 23 mm wide while the pin 23.004 has a radius of approximately 11 mm, while the thickness L of the support flange is of the order of 18 mm.

Figure 24:
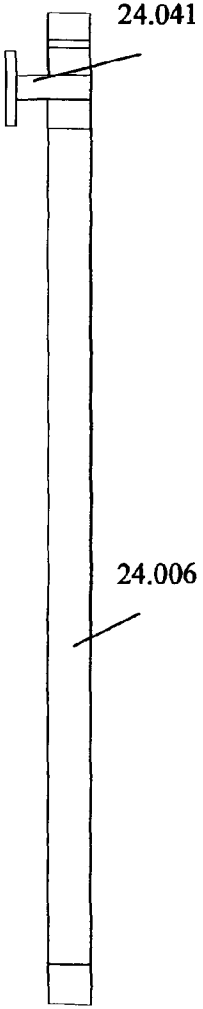

FIG. 24 illustrates a bracket 24.006 including a disc flanged pin bracket support 24.041 that is integrally formed within the bracket 24.06. The bracket support extends only from one face of the bracket. The bracket can be supported by a slot which opens on three faces of a single flange support wherein the face of the bracket on the side of the disc flanged end will be in close proximity with the flange to restrict lateral movement. Alternatively this bracket and bracket support can be used in a two flange support flange in a manner as described above in similar embodiments. When the bracket support is inserted in a single flange support the bracket support can engage with the disc flange sitting to one side of the flange whilst the bracket sits on the other side of the flange.

Figure 25:
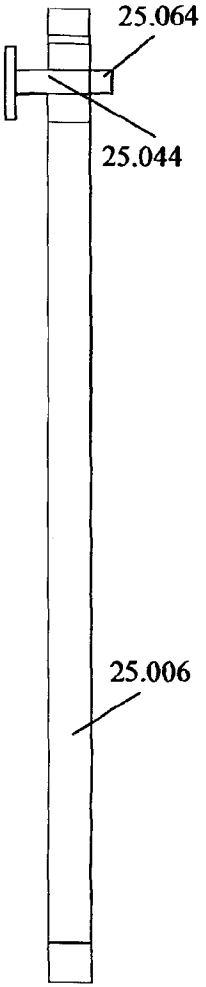

FIG. 25 illustrates a bracket 25.006 and bracket support means wherein one end of the bracket support 24.044 is disc flanged and the other end of the bracket support is a pin as described above in FIGS. 3, 4 and 8A. The bracket support 24.044 is integrally formed within the bracket to restrict lateral movement of the bracket support when engaged in a support flange. The bracket support is able to engage with a support flange including a single flange as in FIG. 5, two flanges wherein both flanges comprise of slots as in FIGS. 1 and 2 or in a support flange including a blind slot and an open slot as in FIGS. 3 and 4.

Figure 26:
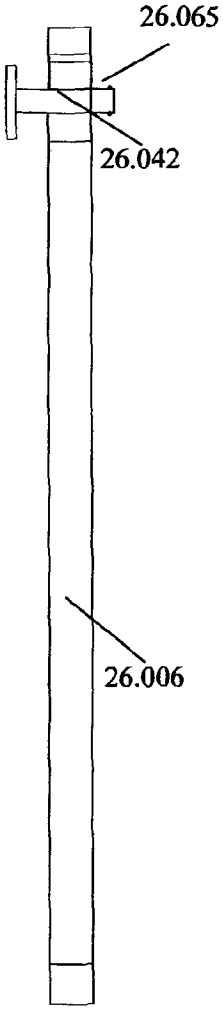

FIG. 26 illustrates a bracket 26.006 and bracket support 26.042 as in FIG. 25 with a locking pin means 26.065 that is spring driven. The bracket support is removable from the bracket through the use of the sprung pins. The sprung pins are pins sitting on extended springs in the rest position. The bracket support is able to engage with a support flange including two flanges wherein one flange has open slots and the other flange has blind slots with openings in the walls perpendicular to the flange sides in contact with the bracket apt to receive the sprung pins. The sprung pins can be retracted through the application of force and then inserted into the slots within the apertures which then extend when aligned with the openings in the slots. In one instance the pins are rounded in one direction and the application of force in that direction causes the springs to compress allowing the bracket support to be removed. In another arrangement the pins are released through the use of a button that is connected to a leaf spring within the bracket support pin.

Figure 27:
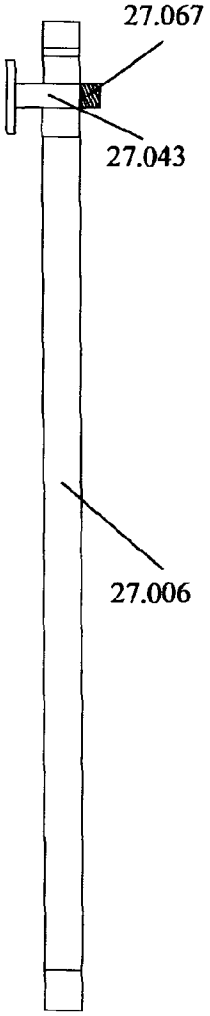

FIG. 27 comprises a bracket 27.006 and bracket support 27.043 as in FIG. 26 where the bracket support contains a threaded end 27.067 to fix the bracket support to a flange in a support flange rather than sprung pins. The bracket support is removable from the bracket and has a disc flanged end that extends past one side of the bracket and a threaded screw end extending past the other side of the bracket. In this embodiment the bracket support can be engaged with a support flange including two flanges wherein one flange has slots as described above to receive the disc flanged end of disc flanged end side of the bracket support and the other flange having threaded holes apt to receive the threaded screw end of the bracket support.

Figure 28:
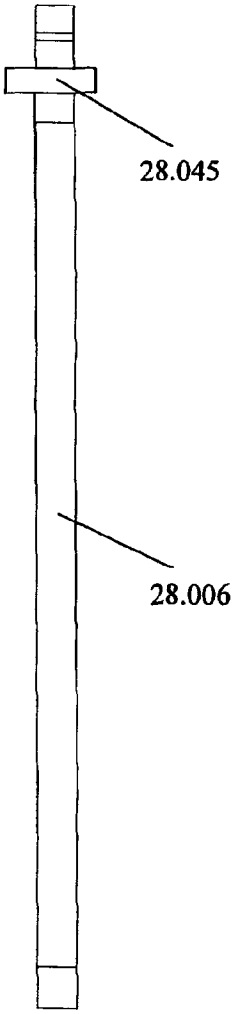
FIGS. 24 to 28 are section view of a bracket respectively showing: bracket support on one side and integrally formed; bracket support on both sides and integrally formed; a bracket support extending from two sides from said bracket, includes locking pin means; a removable bracket support extends from two sides of said bracket and includes thread; a bracket support extends from two sides of said bracket and is integrally formed there within.

FIG. 28 is a bracket 28.006 and bracket support 28.045 wherein the bracket support is a pin that extends from two opposite sides of the bracket. The bracket support operates in a similar manner to that described in other similar embodiments and is numbered accordingly.

Figure 29:
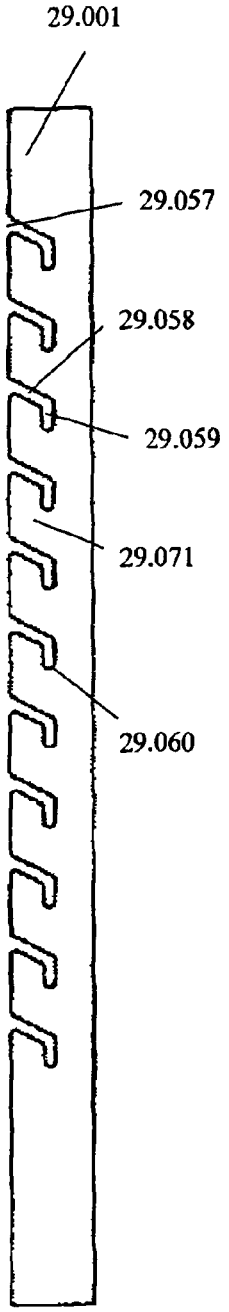
FIGS. 29, 29A and 30 illustrates respectively: a support flange, with a plurality of slots are located for engaging means; a support flange, wherein a plurality of slots are located for engaging means; a support flange with a plurality of slots for engaging means.
Figure 29A:
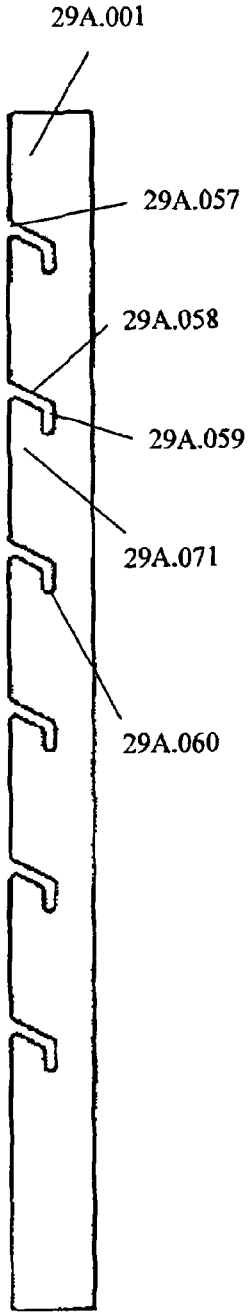
Figure 30:
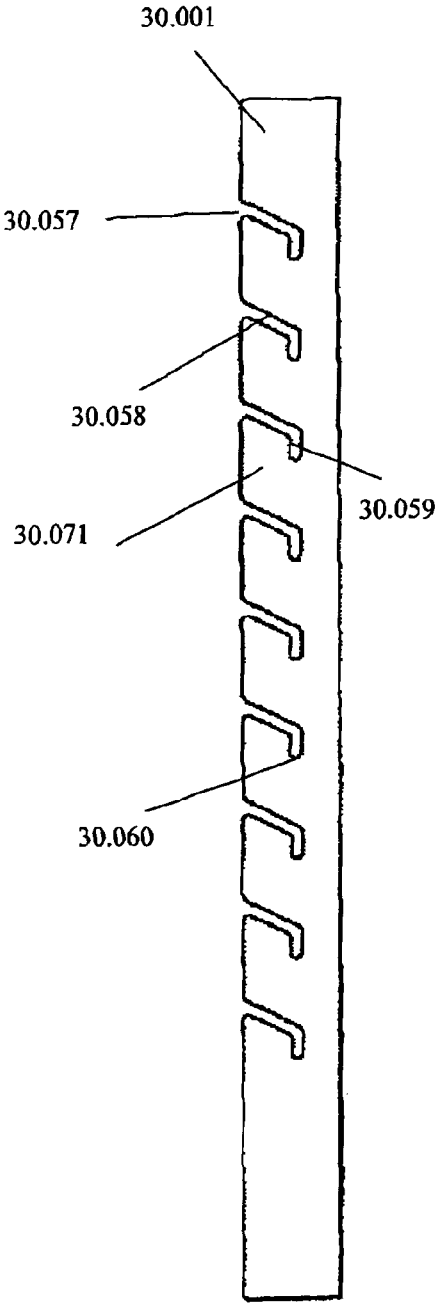

The support flanges of FIGS. 29, 29A and 30 includes a multiple number of slots as described above in similar embodiments and is numbered accordingly. By varying the number of slots, the distance between the slots, the depth of the support flange and the length of the slots, the elasticity of these cantilevering wall sections 29/29A/30.071 can be established as required or desired.

Figure 31:
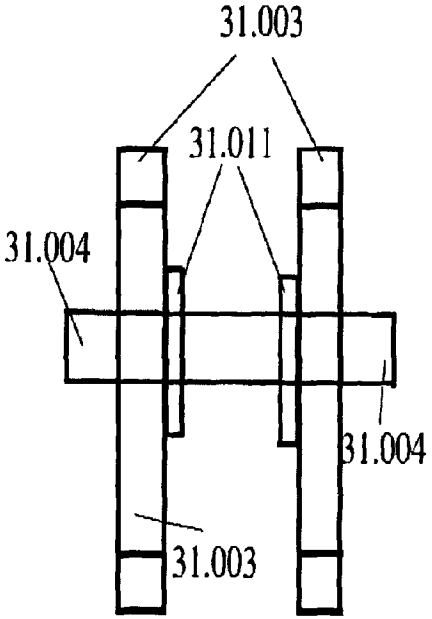
FIG. 31 is a front on view of a bracket support engaged with a bracket.

Illustrated in FIG. 31 is a bracket support pin 31.004 and disc flanges 31.011, whereby the disc flanges are not located at the ends of the pin 31.004. In FIG. 31 the bracket support is engaged with a bifurcated bracket 31.003 as in the prior embodiments. Adjacent the inward faces of the bifurcated brackets are disc flanges 31.011 sitting around the diameter of the pin. The pin 31.004 sits within slots either blind or open on three faces in two flanges as described above and the internal disc flanges restrict lateral movement by the brackets. The disc flanges are fixed to the pin and the bifurcated arms are removable from the bracket support. Alternatively the bracket support sits within a single flanged support flange as described above with the disc flanges acting as spacers between the flange sides and the bracket sides.

Figure 32:
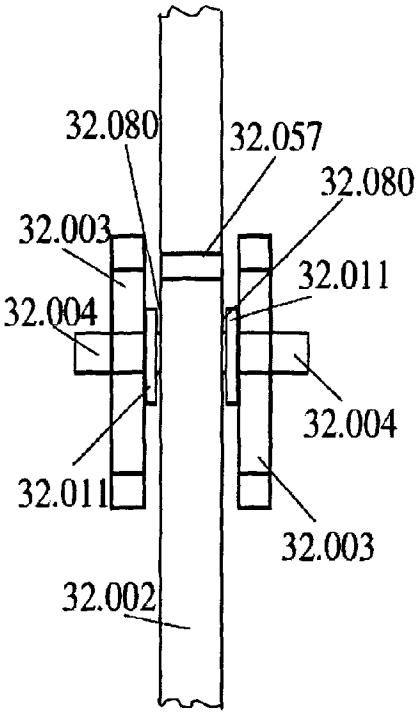
FIG. 32 is a front on view illustrating a bracket support engaged with the bracket whilst engaged with a support flange.

FIG. 32 shows the bracket 32.003 and bracket support pin 32.004 and disc flanges 32.011 system from FIG. 31 engaged with a support flange 32.002. The disc flanges 32.011 around the diameter of the bracket support pins 32.004 create a space between the support flange 32.002 and the bifurcated bracket arms 32.003 allowing clearance. Additionally a space 32.080 between the disc flanges 32.011 and the flange 32.002 is present allowing for expansion and contraction of the materials in the bracket, bracket support and flange under environmental conditions. The bracket support is inserted into a slot opening 32.057 and sits in the terminus of the slot as described above.

Figure 33:
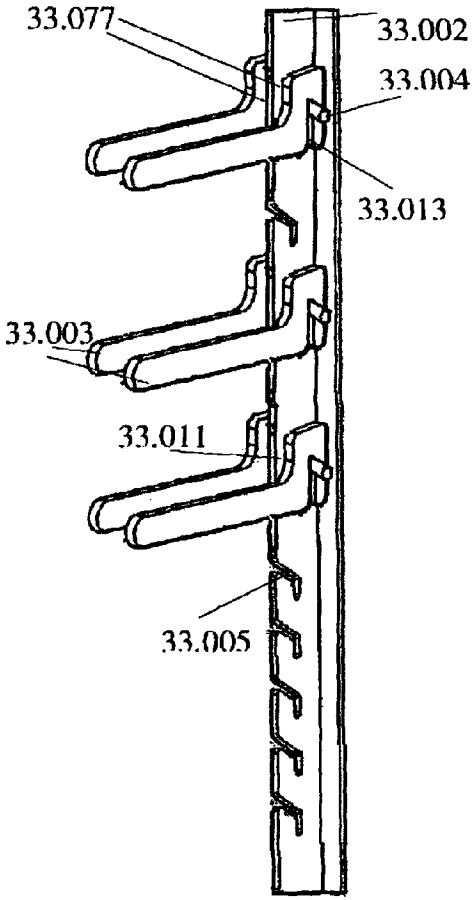
FIG. 33 is a perspective view of a single support flange engaged with a bracket support and bracket.
Figures 34, 35, 36, 37, 38:
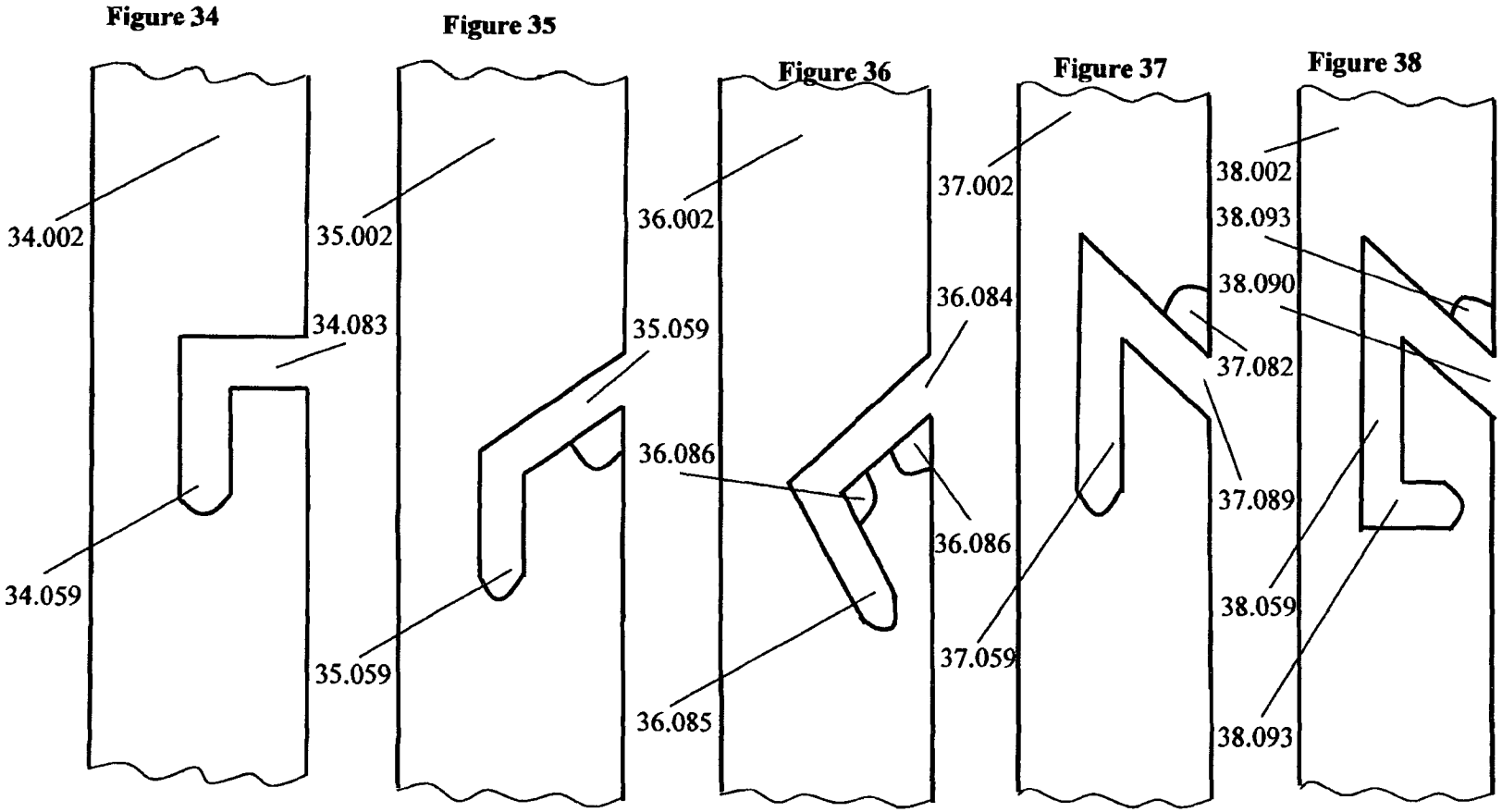
FIGS. 34 to 38 are side views of a bracket support respectively showing: a horizontal then vertical slot; an angled and vertical slot; a slot that is angled in two directions; a slot that is angled up and vertical; a slot that is angled up, vertical and horizontal.

FIG. 33 shows a bracket 33.003 and bracket support pin 33.004 system engaged with the flange in a support flange 33.002 from FIG. 32. The extension of the bracket support pins 33.004 is beyond the outside face of the brackets. The brackets support 33.004 is engaged with a slot 33.005 in the support flange 33.002 as described above in previous embodiments. The bracket support is fixed to the bracket and a space 33.077 is created between the bracket and flange Illustrated in FIGS. 34 to 38 are a range of other slot profiles that can be used with the embodiments described above. The support flange 34.002 in FIG. 34 shows a slot in a support flange where the slot extends in the horizontal 34.083 and then extends down in the vertical 34.059 finishing in a terminus in which a bracket support pin can sit. The support flange 35.002 in FIG. 35 has a slot extending down from the horizontal 35.059 which then extend down in the vertical 35.059 to end in a terminus where a bracket support pin will sit with a bracket and load.

The support flange 36.002 in FIG. 36 shows a slot 36.084 extending downwards at an angle 36.086 approximately 45 degrees from the vertical. The slot then extends down with a vertical and horizontal component towards the face in which the slot opened originally at 36.085 at an angle of approximately 90 degrees 36.086.

The support flange in FIG. 37 shows a slot that extends from the opening up from the horizontal 37.089 at an angle of approximately 45 degrees to the vertical 37.8082 and then goes down in the vertical 37.059 to stop at a terminus wherein a bracket support can rest. The support flange in FIG. 38 shows a slot extending up from the horizontal 38.090 at an angle of approximately 45 degrees 38.093 then the slot goes down in the vertical 38.059 to then move back in the horizontal 38.094 towards the face in which the slot entered the support flange.

With the embodiments of FIGS. 37 and 38, sharp corners are illustrated but in practice these would be radiused or rounded, so as to minimise stress fracturing. Each of the embodiments of FIGS. 34 to 38 has a differently shaped cantilevering wall section, and thus a differing amount of elasticity and or damping effect will result. The profiles of FIGS. 34 to 38 are cut into the support flange through cutting, punching, pre forming, extrusion or other means.

Figure 39:
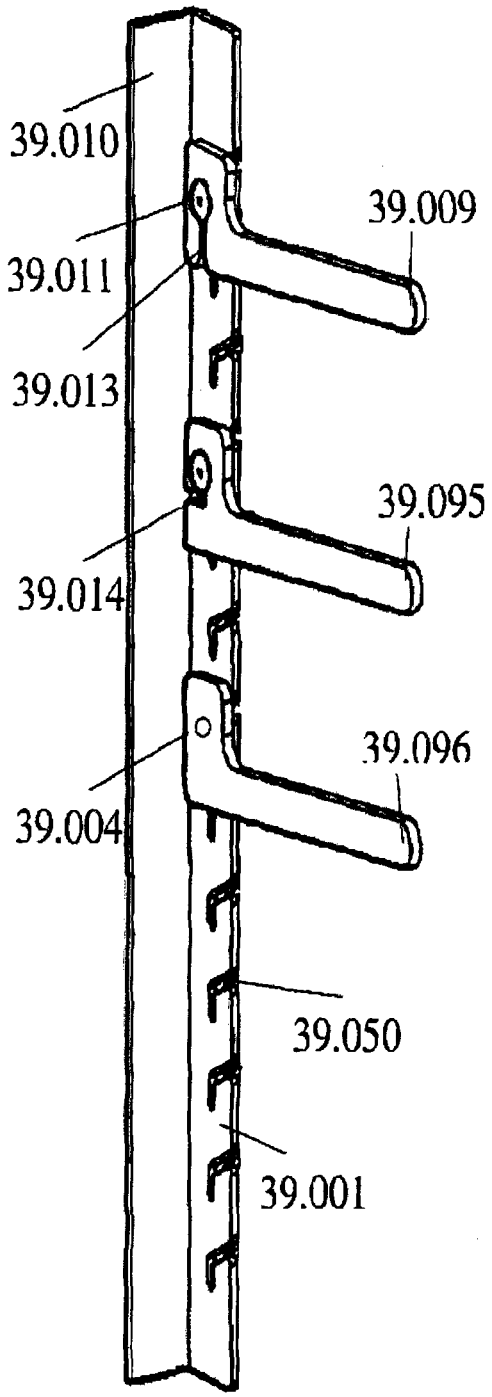
FIG. 39 is a perspective view of a racking system with a support plate and support flange forming an L shape.

FIG. 39 illustrates a rack system element where the support flange 39.001 and the support plate 39.010 are connected in a L shaped orientation. The support flange 39.001 and support plate 39.010 can be formed together or fixed later in the same way as mentioned above for other support flanges or support plates and can be made of the same materials. The slots are formed in the same way as mentioned above and can interact with bracket supports and brackets as mentioned above where the support flange contains one flange.

Figure 40:
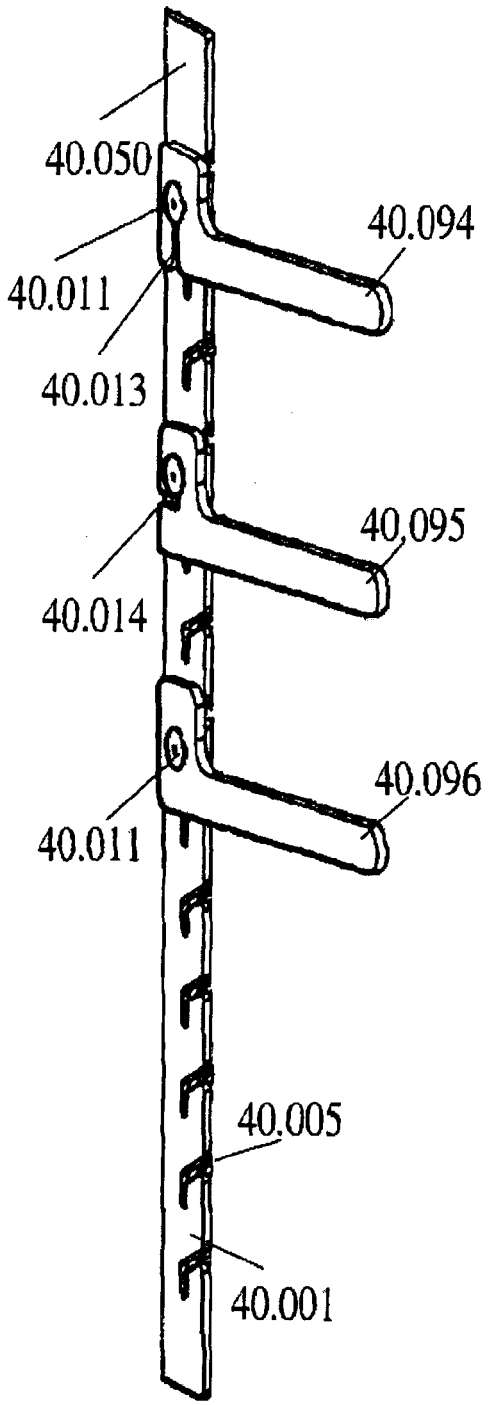
FIG. 40 is a perspective view of a bracket engaged with a single support flange.

FIG. 40 illustrates a rack system element where a support flange 40.001 is provided with sufficient thickness that will enable direct connection of the support flange 40.001 to a wall or frame or stand, but otherwise interacts with bracket supports and brackets in the same ways as described above. The support flange 40.001 can be joined to a wall in any appropriate manner, such as welding, gluing, riveting, or screwed directly or via hanging brackets etc. The amount of securing necessary will be to prevent relative movement of the support flange 40.001 away from the supporting wall when the brackets are "rotated" under a load.

Figure 41:
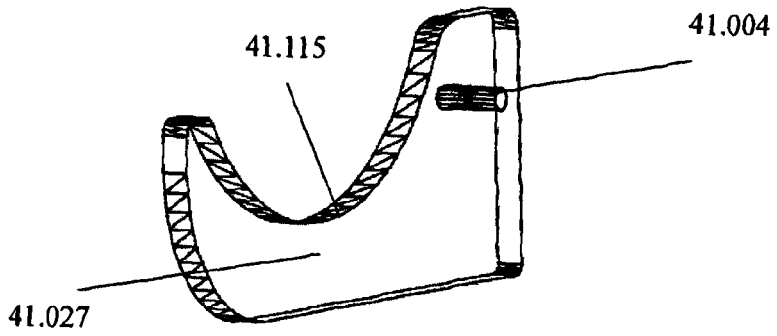
FIGS. 41, 42, 43 and 44 illustrate brackets in perspective view.

FIG. 41 illustrates a cantilever straight bracket 41.027 where a radius of curvature is found in the loading section of the bracket. The radius of curvature is large in relation to the length of the bracket. The bracket has a pin 41.004 located near the load bearing edge of the bracket that may be removably connected to the bracket by a thread system, or integrally formed therewith or permanently fixed to the pin by thread and glue, or simply glued or attached by any other appropriate means. FIG. 41 shows the pin extending from only one side of the bracket but where there is an aperture open to two opposite sides of the bracket a pin can be extended through both sides of the bracket as described previously. A pin can also be mounted to both sides of the bracket.

Figure 42:
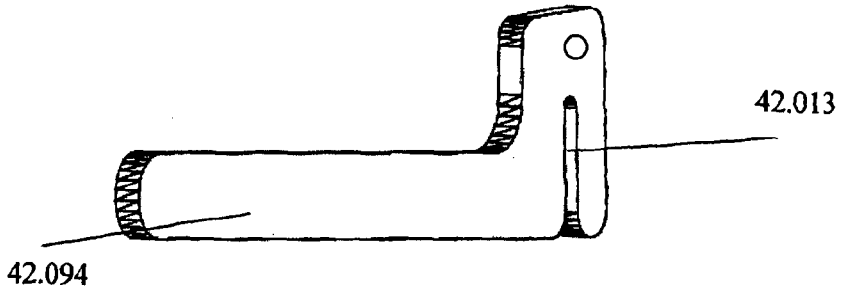

FIG. 42 illustrates a straight cantilever bracket 42.094, similar to the bracket 10.022, and functions in the same way In this arrangement when engaged with a bracket support and load is placed on the bracket the vertical slot can flex, as was described above at FIGS. 11 and 12.

Figure 43:
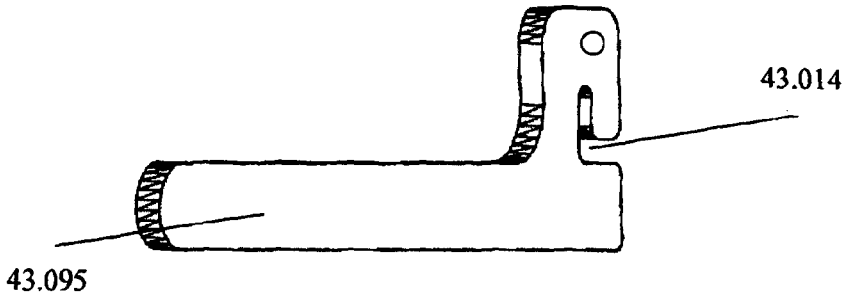

FIG. 43 illustrates a straight cantilever bracket 43.095, which is similar to the bracket 10.023, with an L shaped aperture 43.014 which can work together with the shape of the slots in the support flange to damp movement, and provide a source of elasticity as described at FIGS. 11 and 12.

Figure 44:
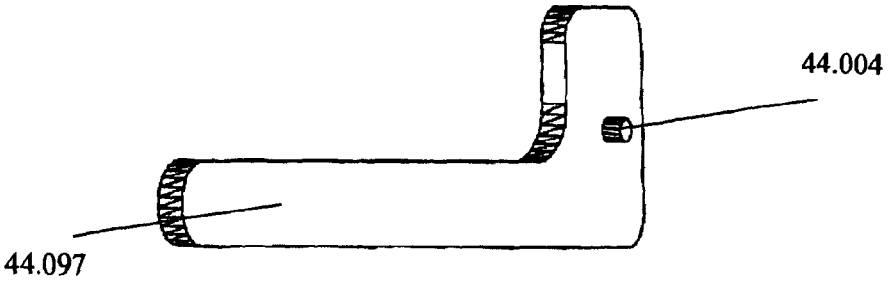

FIG. 44 illustrates a straight cantilever bracket where a pin extends from the side of the bracket in the same way as for FIG. 41. The pin is located further down the load bearing edge of the bracket than in FIG. 41. This gives the bracket less support from the load bearing edge as less bending moment can be borne by the bracket and load bearing edge.

Figure 45:
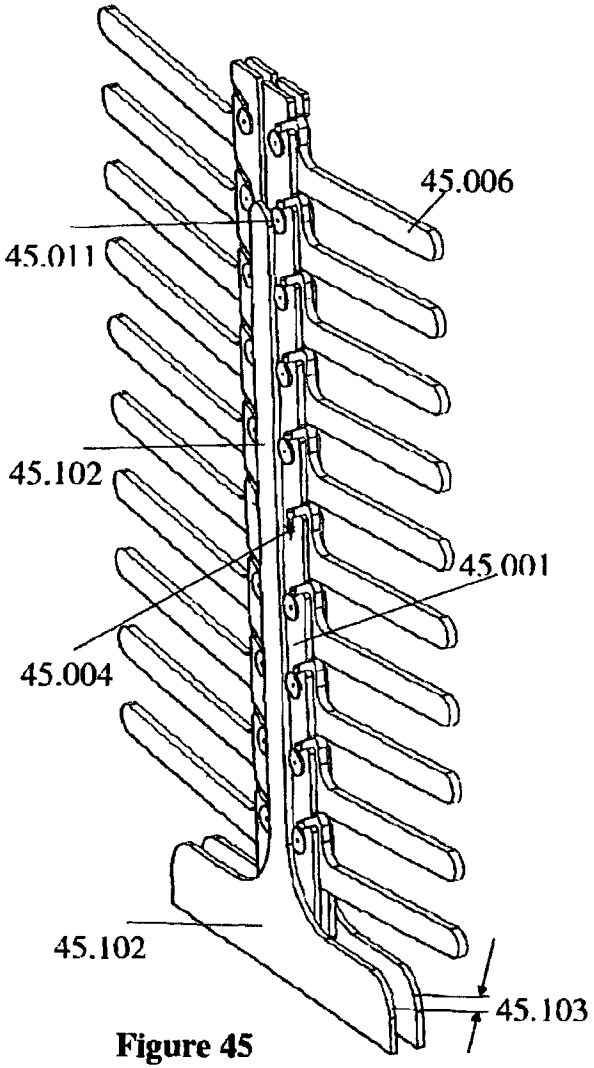

FIG. 45 illustrates a free standing racking system with the same racking mechanisms as described previously. Two sets of two flanges 45.001 are located back to back and are mounted to a support frame 45.102. The support frame 45.102 is shaped in a T profile with the top of the T supporting the racking system on the ground. The side support frame lays on the outside of the support flange and is fixed to the flange using welding (plastic or metal), routing and joinery, screwing, bolting, riveting, gluing or a variety of other appropriate methods. A side support frame is able to join to two support flanges facing in opposite directions in order to allow loading in multiple directions from the same side support frame. When a support flange comprising of two flanges is used as depicted in FIG. 45 two side support frames are to be placed on opposite sides of the support flange which will give the racking system support and balance on the ground. If a support flange comprising of one flange as previously discussed a side support frame can be used that additionally includes a wall that extends along the ground underneath the support flange in order to supply balance and lateral support.

Figure 46:
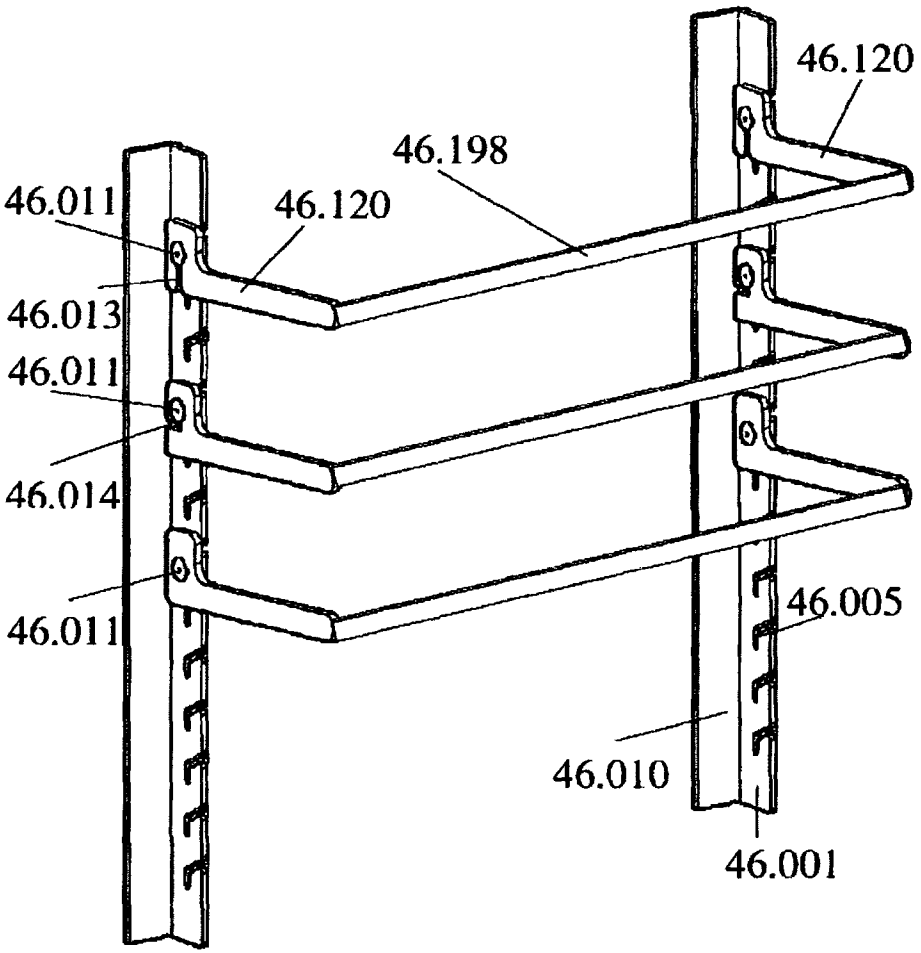
FIGS. 45, 46 47 and 48 are respectively perspective views of: a series of brackets in a stand mounted racking system; a racking system where aligned brackets are connected by means of struts; another racking system where aligned brackets are connected by means of struts; a stand mounted racking system.

FIG. 46 illustrates a racking system having two L shaped support flanges as described above at FIG. 39 that uses a strut 46.198 that connects between brackets on the support flanges providing a hanging means. The support flanges are shown as L shaped but can any of the support flanges previously mentioned and include bracket supports 46.011, engaging means 46.013, 46.014 and slots 46.005. The flanges will attach to a wall or flange through the same ways as discussed above. The support flanges are spaced apart the same distance as the length of the strut 46.198. The support brackets 46.120 are joined together through the use of a strut 46.198 which is illustrated as a flat strut but can be of a variety of profiles including cylindrical. In one arrangement the brackets are formed with the strut initially setting a fixed distance at which the support flanges are to be spaced. In another arrangement the brackets are independent to the strut and the two can be joined post installation. In this arrangement the length of the strut can be suited to the desired distance between support flanges, the strut will either be segmented allowing it to be shortened or lengthened or it can be cut to suit. The strut and the brackets can be joined using the previously mentioned methods.

Figure 47:
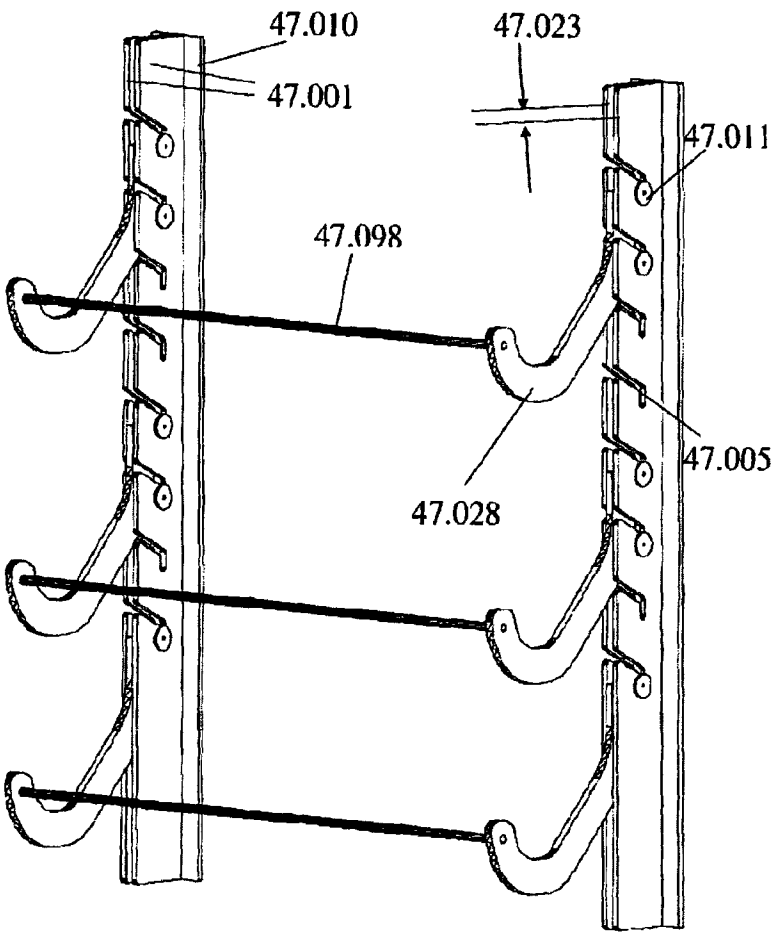

FIG. 47 illustrates a racking system with at least two π shaped support flanges 47.001 as described above at FIG. 1 that uses a bracket system that connects between support flanges providing a hanging means. The support flanges are shown as IF shaped but can any of the support flanges previously mentioned and include bracket supports 47.011, engaging means and slots 47.005. The flanges will attach to a wall or flange through any of the previously mentioned methods. The support flanges are spaced apart the same distance as the length of the strut 47.107. The support brackets 47.028 are profiled as angled down pointed up hooks but can be of any of the profiles mentioned above. They are joined together through the use of a strut 46.098 which can be cylindrical as shown but can be a strut of any cross sectional profile. In one arrangement the brackets are formed with the strut initially setting a fixed distance at which the support flanges are to be spaced. In another arrangement the brackets are independent to the strut and the two can be joined post installation. In this arrangement the length of the strut can be adjusted in the manner mentioned at FIG. 46.

Figure 48:
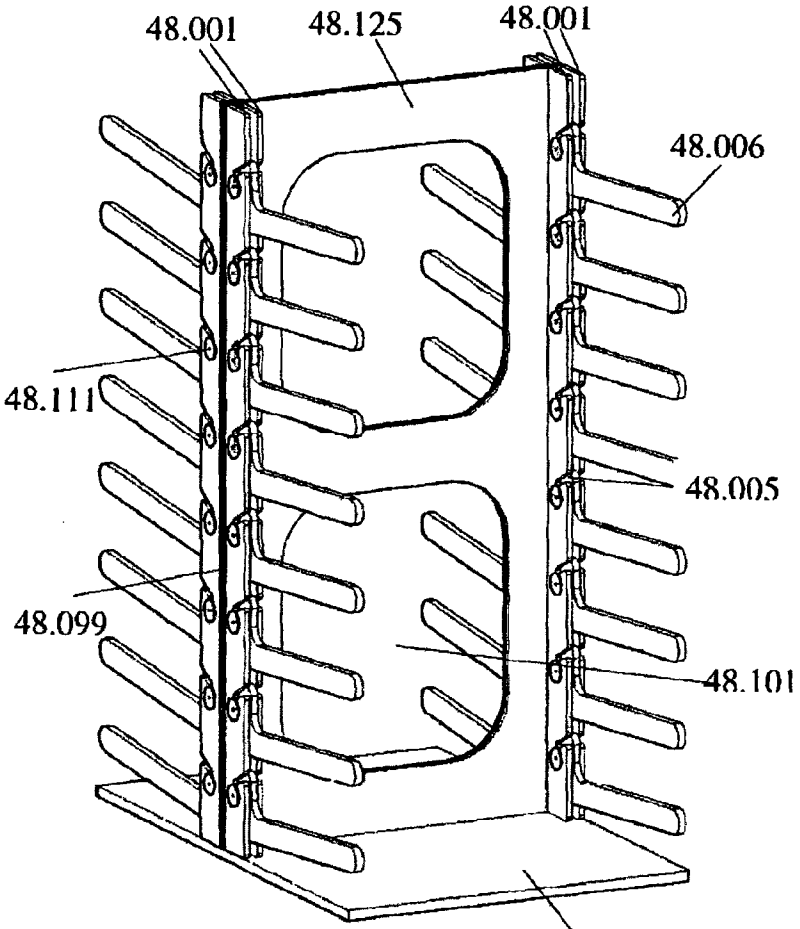

FIG. 48 illustrates a free standing racking system that includes at least two support flanges 48.001 which are connected by a fixing wall 48.125 and base plate section. The fixing wall is connected to the flanges 48.001 in the same way that the support plate is as mentioned above. The base plate is connected to both the fixing wall and the support flanges. The three components can be formed using any of the previously mentioned methods. The brackets 48.006 connect to a bracket support 48.111 in the same way as previously described which in turn sits in a slot 48.005 in the same manner as the previously mentioned racking arrangements. The fixing wall and base plate act to reinforce the support flanges from forces approaching in the lateral direction. Where there are holes 48.101 in the fixing wall access is increased and transportation of the fixing wall or racking system is simplified. The holes can be cut, punched or moulded into the fixing wall. Alternatively the fixing wall can be a solid piece fitted between the support flanges or can be or a variety of profiles.

Figure 49:
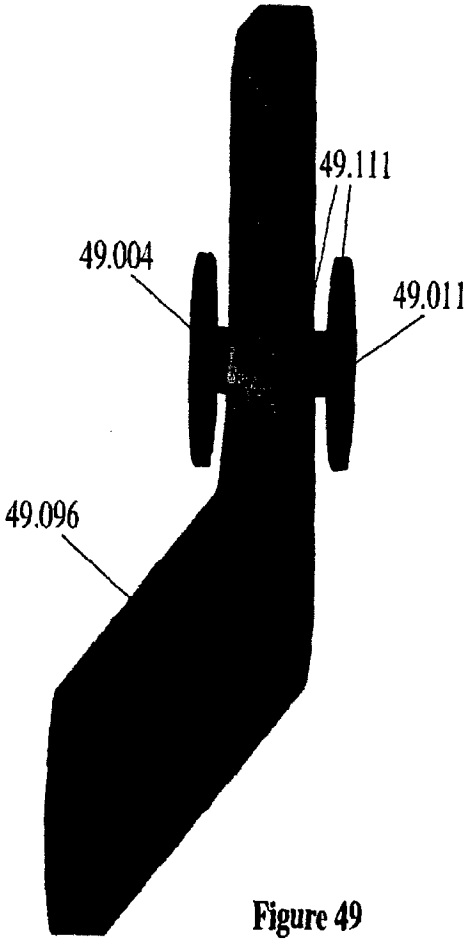
FIG. 49 is a perspective view of a bracket with bracket support attached.

FIG. 49 illustrates a bracket 49.096 with two pins extending from either side of the bracket with disc flanges for a bracket support as mentioned above throughout the embodiments.

Figure 50:
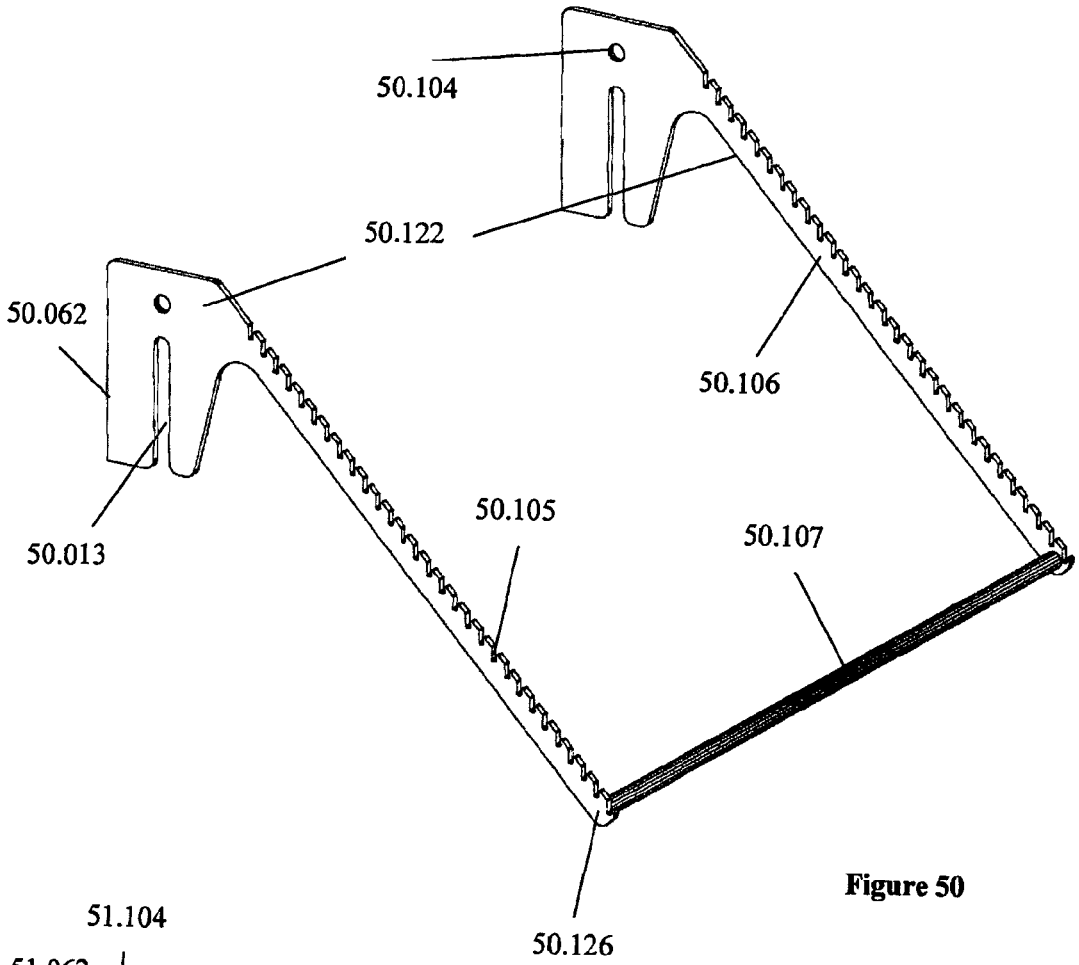
FIG. 50 is a perspective view of bracket arrangements particularly useful for carrying hangers.
Figure 51:
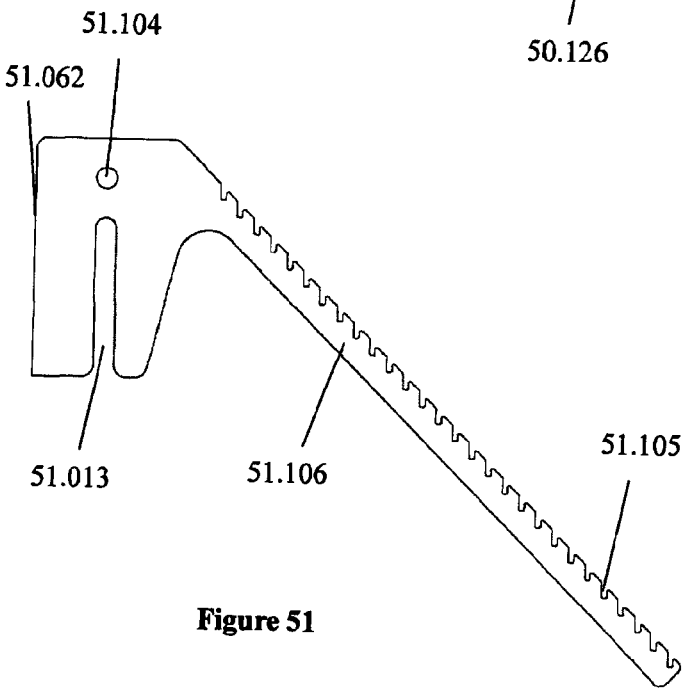
FIG. 51 is side view of the cantilever bracket of FIG. 50.

FIGS. 50 and 51 illustrates a bracket assembly having twin brackets 50.122 that has extensions 50.106 extending downwardly and away from the rear of the brackets. The extensions 50.106 are joined by means of a strut 50.107. The extensions 50.106 each contain a plurality of notches to receive the hooks of clothes hangers. The rear of the brackets 50.122 contain two bracket support receiving means which are meant as alternatives, one being a slot extending downwards to as described above under FIGS. 11 and 12 and the other being circular aperture 50.062 enabling the use of a pin as described above in other racking system arrangements. Two brackets by being joined together at the ends of the downwards extension means that as shoppers are taking clothes off storage from extensions 50.106 they can place garments or wetsuits that they like onto the strut 50.107. The brackets 50.122 are each to be supported by respective support flanges, as is described above.

Figures 52, 53, 54:
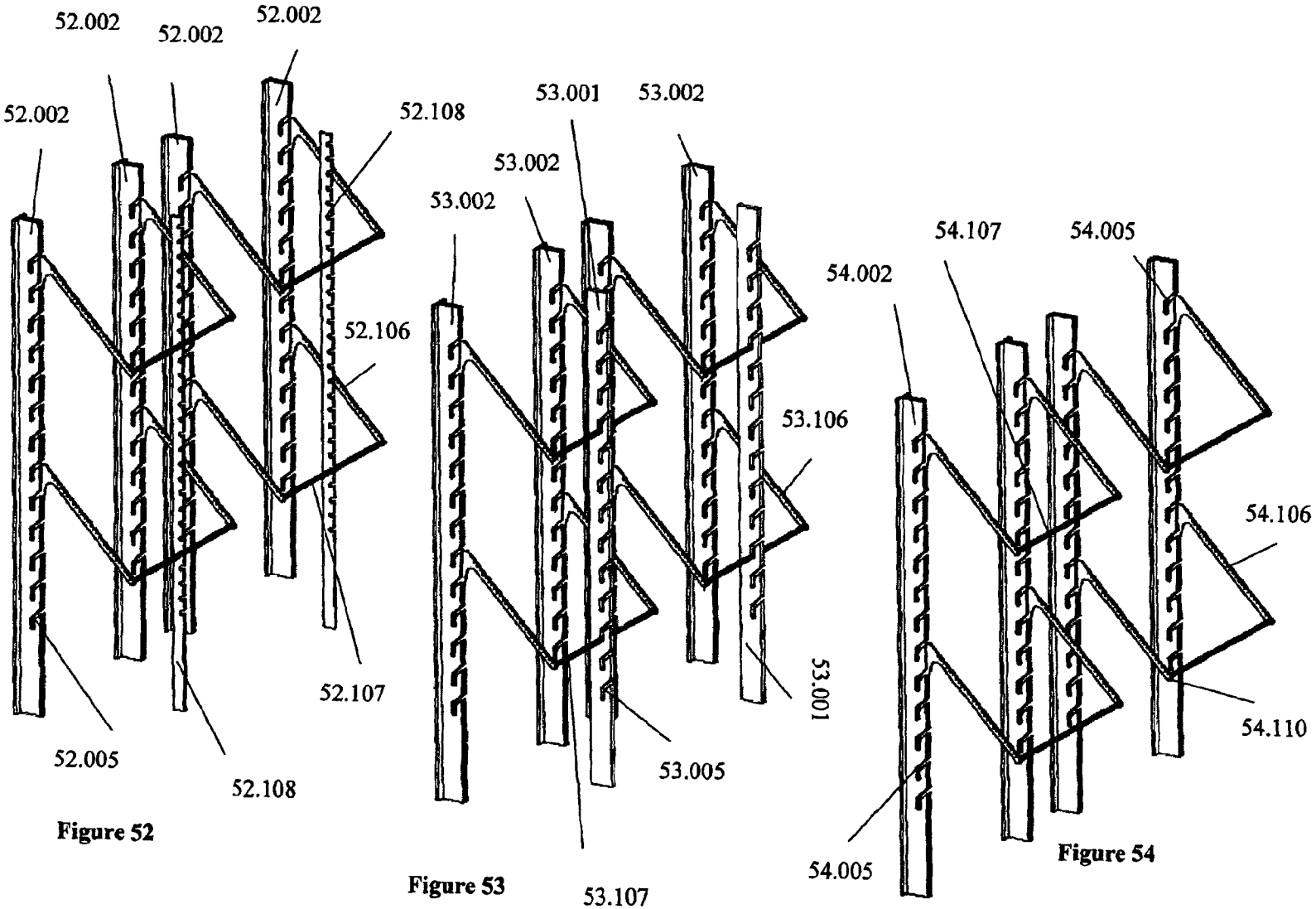
FIG. 52 is a perspective view of the brackets of FIG. 50 on the rack system, with a forward support.
FIG. 53 is a perspective view of the brackets of FIG. 50 with a different forward support.
FIG. 54 is a perspective view of the bracket in cantilever mount to the rear support flanges.
Figure 55:
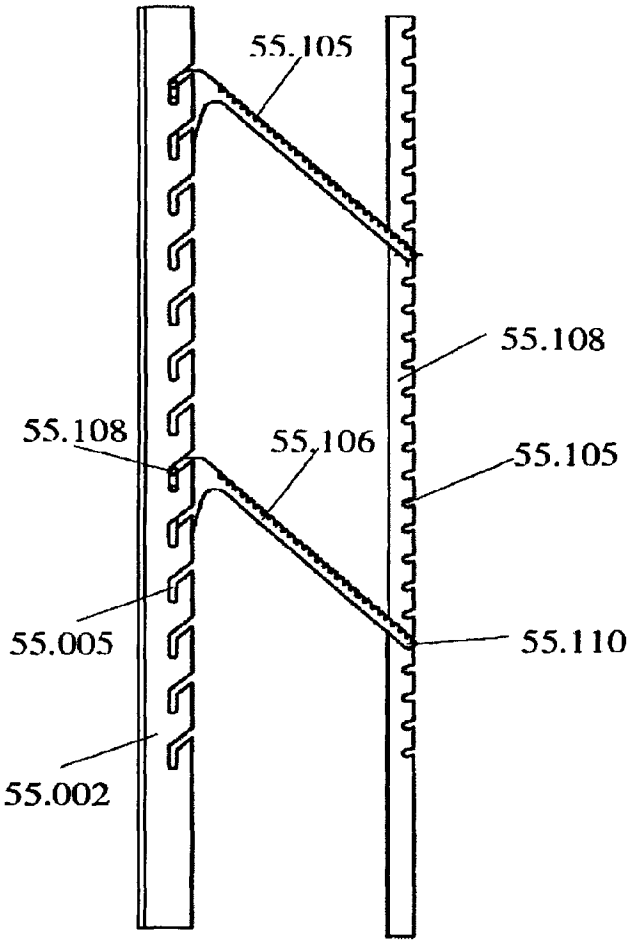
FIG. 55 is a side view of the racking system of FIG. 52.

FIGS. 52 and 55 illustrate a racking system where the bracket 52.106 as described at FIGS. 50 and 51 engages with respective rear support flanges 52.002 and the strut 52.107 is held by a notched vertical member 52.108. The strut 52.107 connected between the two brackets at the end of the angled down bracket arms 52.110 is further supported at the front by a notched vertical member 52.108. The strut sits in a notch along the length of the vertical member between the ends of the bracket supports. To allow this racking system to be free standing a connection plate is required to connect the tops of the support flanges and the top of the notched vertical member 52.108. While the lower ends may be inserted in ground drilled apertures, the preference is that the bottoms of the support flanges and notched vertical member are also interconnected by a lower connection plate. This connection plate can be in the form of a plate that lays across the top and separately across the bottom of the support members and notched vertical support. The bracket support is engaged with a slot 52.005 through one of the two engaging means described in FIGS. 50 and 51.

Figure 56:
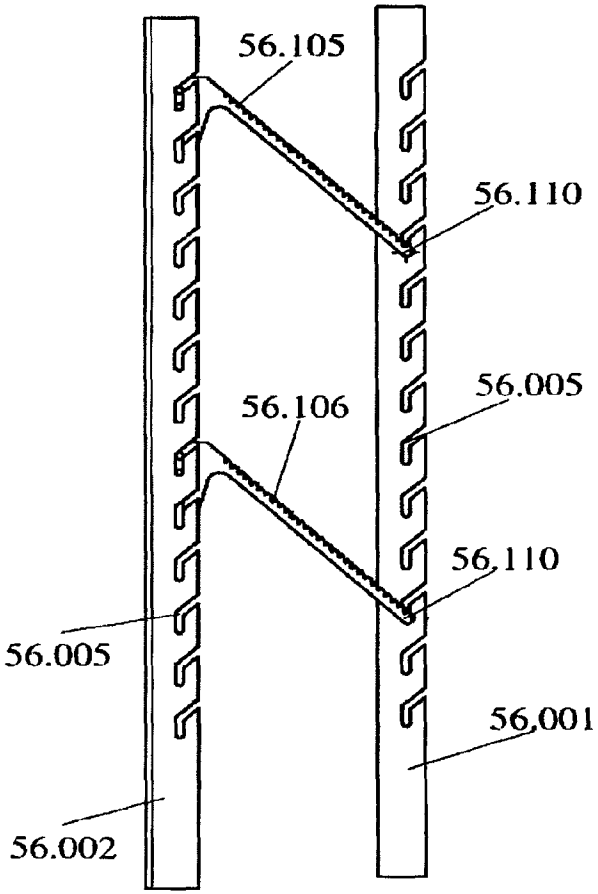
FIG. 56 is a side view of the racking system of FIG. 53.

FIGS. 53 and 56 illustrate a racking system similar to that as described with respect to FIGS. 52 and 55, where the notched vertical member 52.108 is replaced with a single slotted support flange 53.002 as described above in respect of FIG. 40. In this arrangement the strut 53.107 sits within the slots in the flange rather than in notches, thereby providing potentially more positive support.

FIG. 54 illustrates a wall or frame mounted racking system similar to that of FIGS. 52 and 53, except that the strut ends of the brackets remain cantilevered, and are not supported intermediately.

Figure 58:
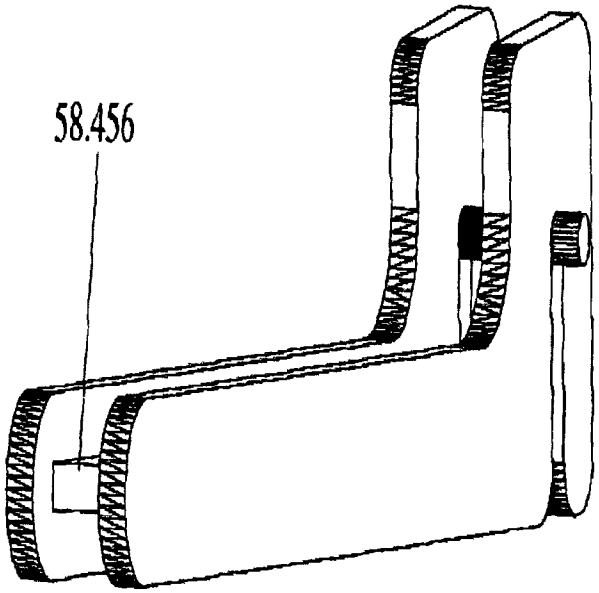
FIGS. 57 and 58 are perspective view of two arm brackets.

FIGS. 57 and 58 illustrate a bifurcated bracket as described above where additional cross supports 57.456 and 58.456 are placed between the bracket arms at the distal end for additional support.

Figure 59:
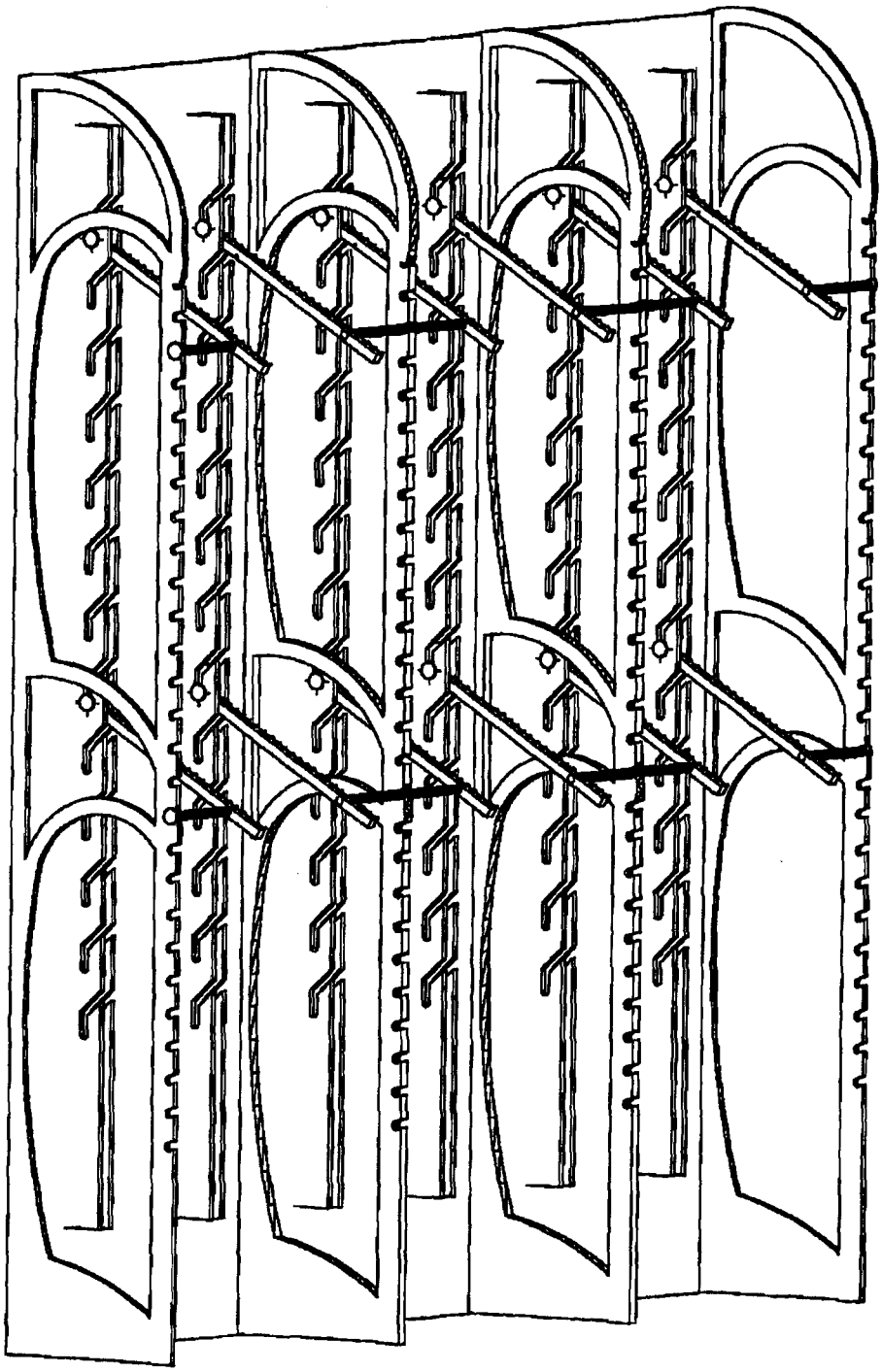
FIG. 59 Illustrates a rack embodying the improvements of FIGS. 50 to 56.

Illustrated in FIG. 59 is a rack system which includes the features of FIGS. 52 and 55, showing another arrangement for forming the racking system assembly of these Figures. The embodiment of FIG. 59 functions in the same manner as that of FIGS. 52 and 55, except that the vertical members are integral with a 'flying buttress" frame which extends way from the wall to which the racking system is mounted.

Figure 60:
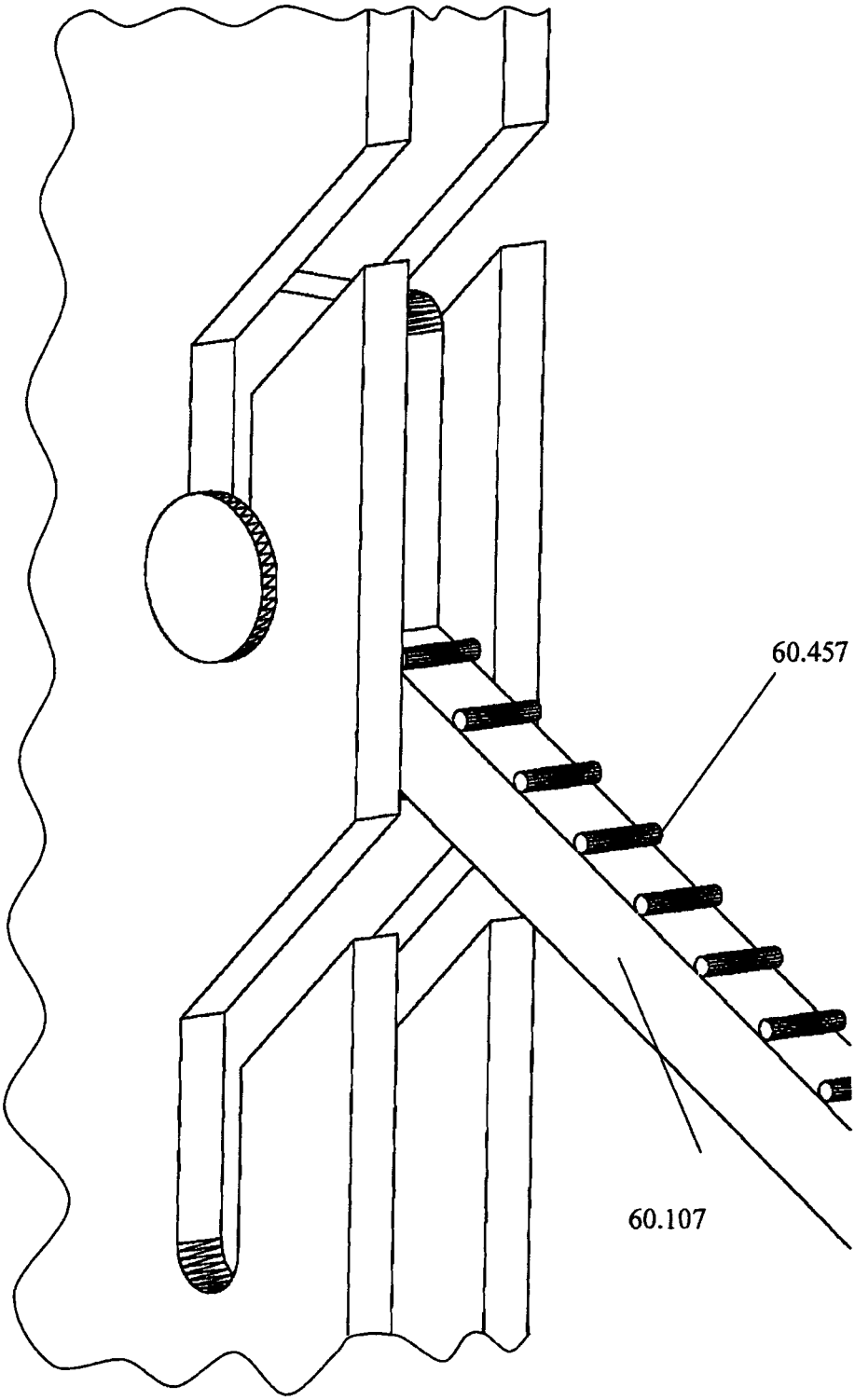
FIG. 60 Illustrates a perspective view of part of an alternative bracket to the bracket of FIG. 50.
Figure 61:
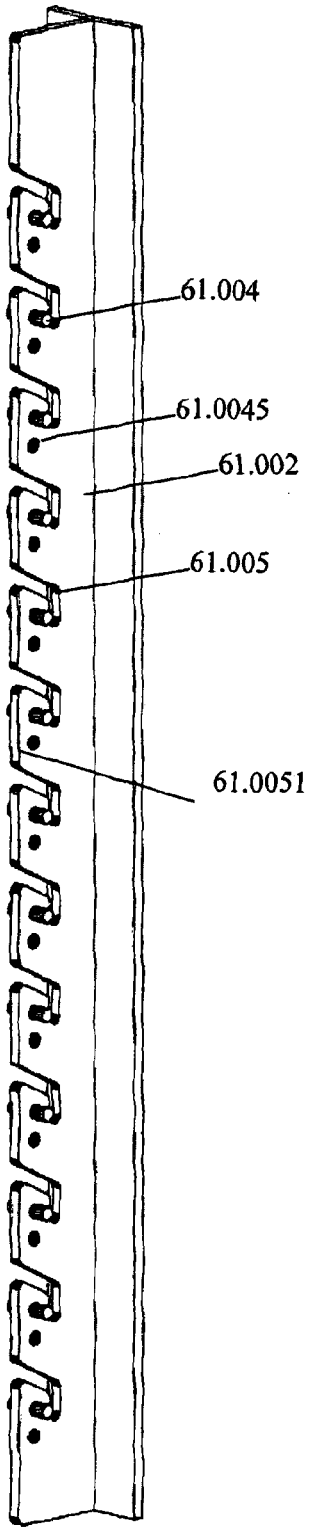
FIG. 61 illustrates a perspective view of a single support flange having slots and apertures to mount bracket supports onto the support flange.
Figure 62:
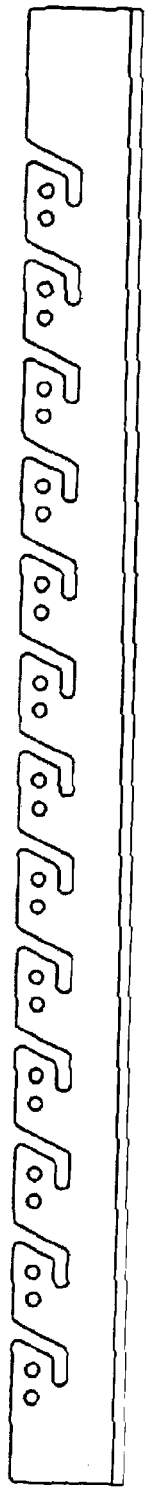
FIG. 62 illustrates a side view of the support flange of FIG. 61.

Illustrated in FIG. 60 is another bracket, similar in construction to the brackets of FIGS. 50 to 56 and 59, except that instead of notches on the bracket extension 60.107 are a series of raised projections 60.457 of generally cylindrical shape, providing means to prevent hooks of garment hangers form sliding down the extensions, and spacing them at regular intervals.

Figure 64:
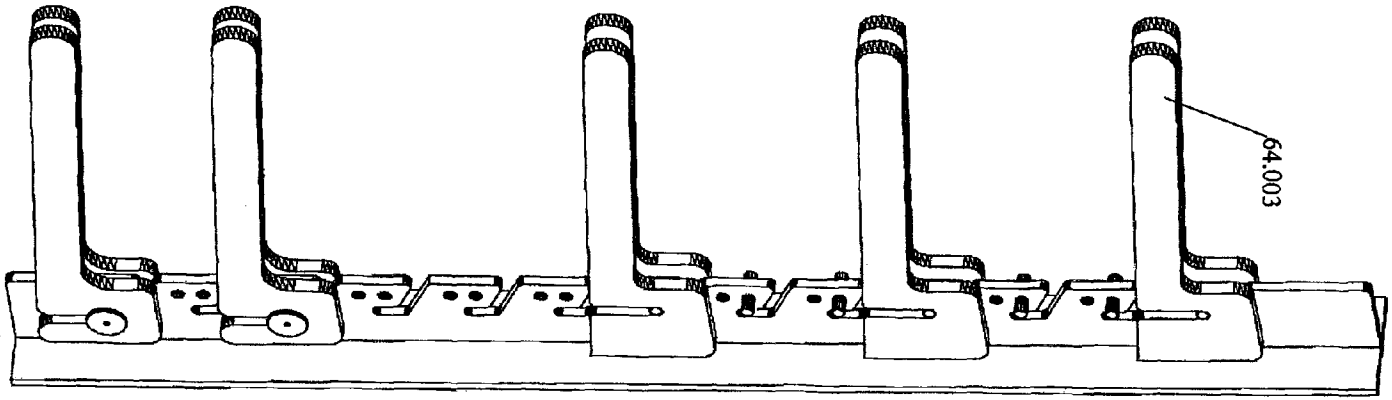
FIG. 64 is a perspective view of the support flange and the brackets of FIGS. 61 and 62.

Illustrated in FIGS. 61 to 64 is a single support flange 61.002 similar to the single support flanges 5.002 described above. The difference being that a bracket support 61.004, in the form of a dowel or pin is mounted in apertures 61.0045 on the support flange 61.002 which are located between the slot 61.005 and a free end 61.0051 of the support flange 61.002. The bracket 64.003, as illustrated in FIG. 64 which engages the aperture mounted bracket supports 61.004 will have a wider rear portion than the previously described brackets, because the location of the pin is closer to the free end of the support flange. This difference in dimension of the rear portion of the bracket is visible in FIG. 64, where the upper brackets have this wider feature, while the lower brackets, as described in earlier Figures, engages bracket supports 64.111, as described above, which are received in the slots 61.005.

A feature of the racking system of FIGS. 61 to 64 is that if desired, by the positioning of two pins or dowels 61.004 in the two apertures 61.0045 provided, will mean an increase in the rigidity of the bracket 64.003, because the slot on the bracket will not be able to function to contribute to the elasticity and or damping means, however, this will not impact the elasticity, or suspension or damping contribution provided by the land of the support flange containing the bracket support.

Figures 63, 136:
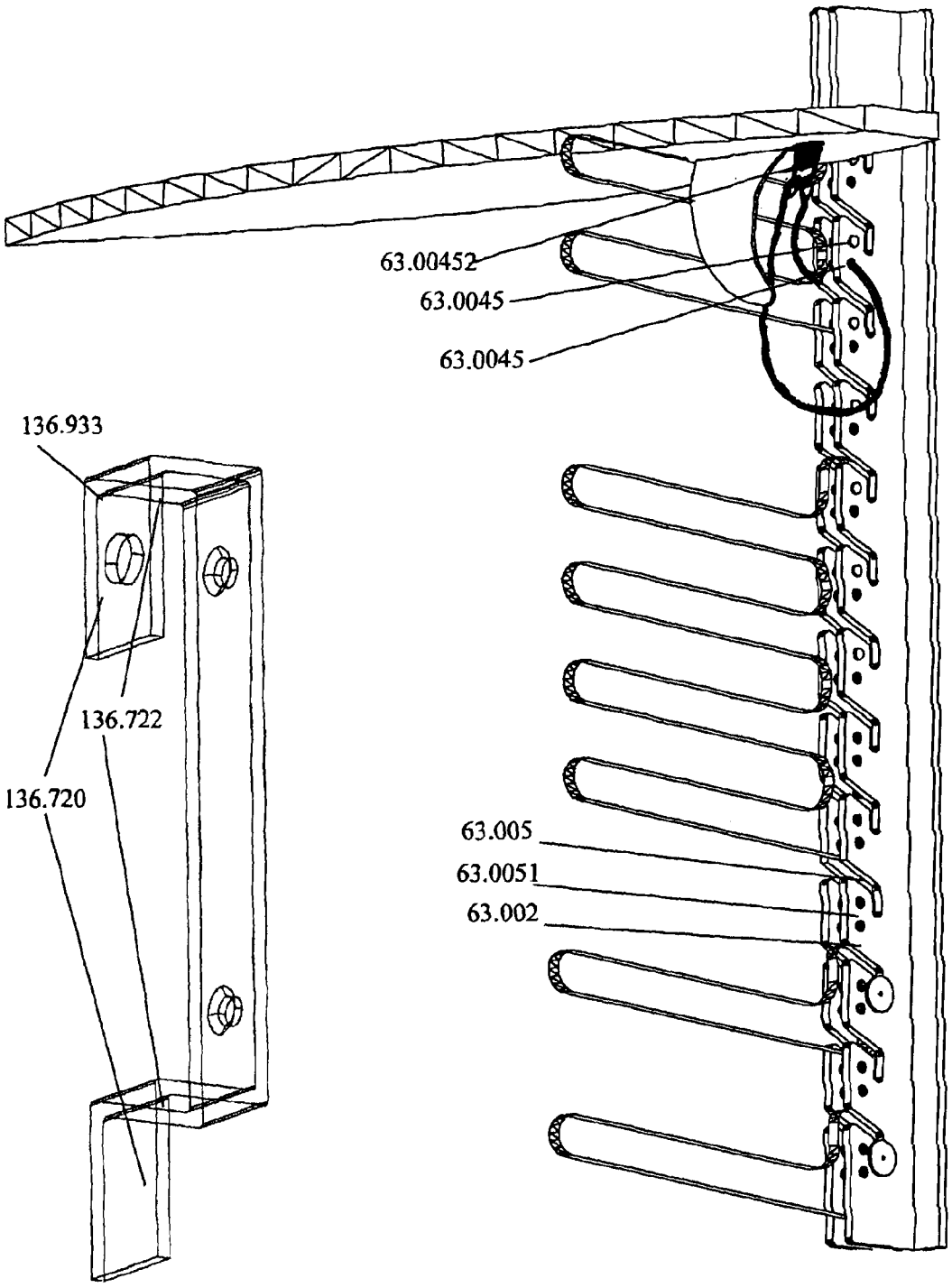
FIG. 63 illustrates a perspective view of a dual support flange similar to single support flange of FIGS. 61 and 62, supporting an locking a surfboard to the bracket.
FIG. 136 illustrates a wire frame perspective view of a two hooked support for attachment to a bracket, such as illustrated in the previous figures.

Illustrated in FIG. 63 is a dual support flange 63.002 with a multiple support bracket, such as illustrated in FIG. 10, assembled thereto. One the bracket member is shown a surf board being supported thereby, and illustrates how one or more dowels or pin are mounted in the appropriate apertures 63.0045 on the support flange 63.002 which are located between the slots 63.005 and free ends 63.0051 of the support flanges 63.002. Further a second aperture 63.0045 is utilised as part of a locking system whereby a wire rope with looped ends is passed through the second aperture 63.0045 and locked to the surfboard by means of a fin box cleat and a pad lock 63.00452.

Figure 65:
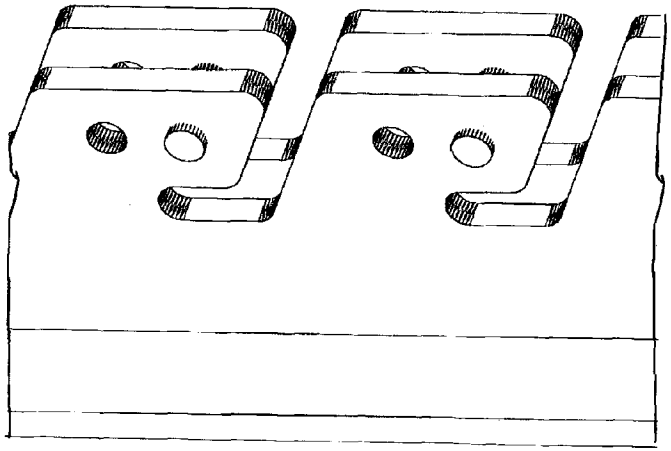
FIG. 65 illustrates a perspective view of a twin support flange with bracket supports attached through apertures in the support flanges.
Figure 66:
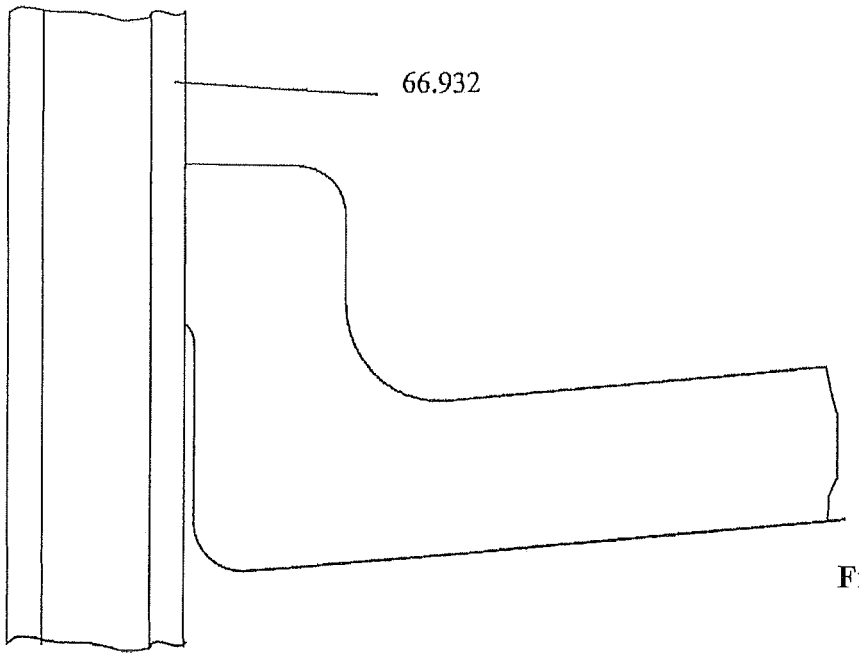
FIG. 66 illustrates a left side elevation of a rack system consisting of wall or wall plate and bracket having an elasticity, suspension or damping features.

Illustrated in FIG. 65 is a twin bracket version of the support flange of FIGS. 61 to 64 with the bracket support pin or dowel extending between the twin support flanges.

If desired more than two bracket support apertures can be provided to the support flange As in previous embodiments, the rear of the bracket makes contact with a rear support plate or wall means to which the support flange or flanges are attached.

In the systems of FIGS. 61 to 65 the bracket support dowel or pin is removable and re-usable, however if desired the dowels, one or more can be integrally formed with the support flanges or permanently attached thereto.

In the rack systems of FIGS. 61 to 65 the slot or slots in the support flanges, whether or not they receive a bracket support pin or dowel, will still contribute to the elasticity, or suspension or damping system of the racking system.

Figure 67:
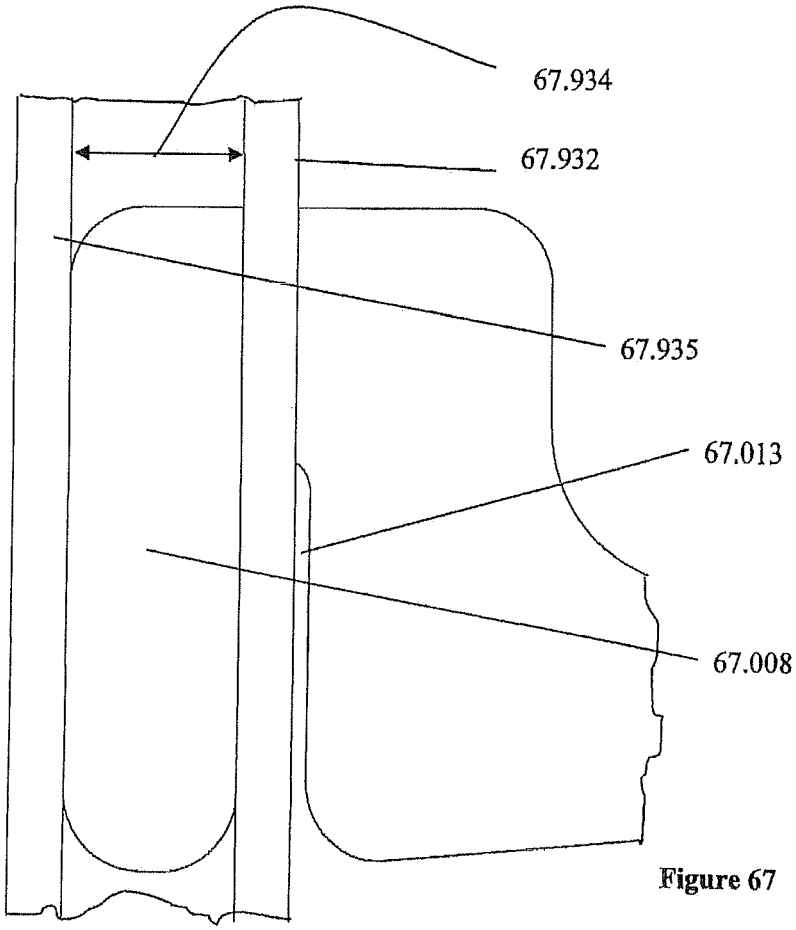
FIG. 67 is a cross section through a portion of FIG. 66.
Figure 68:
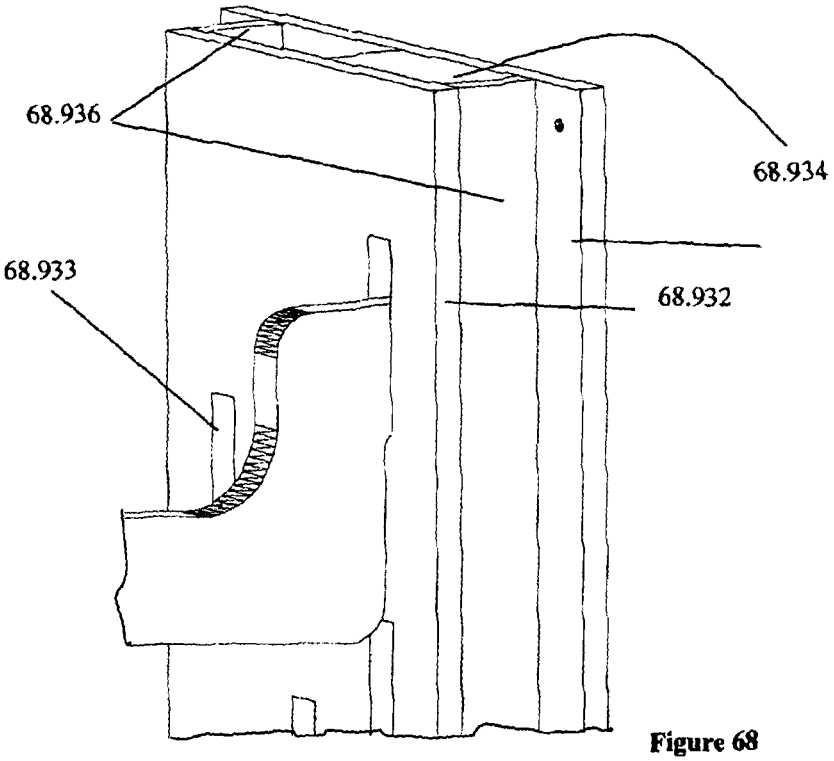
FIG. 68 illustrates a right side perspective view of the wall or wall plate and bracket system of FIG. 66.
Figure 69:
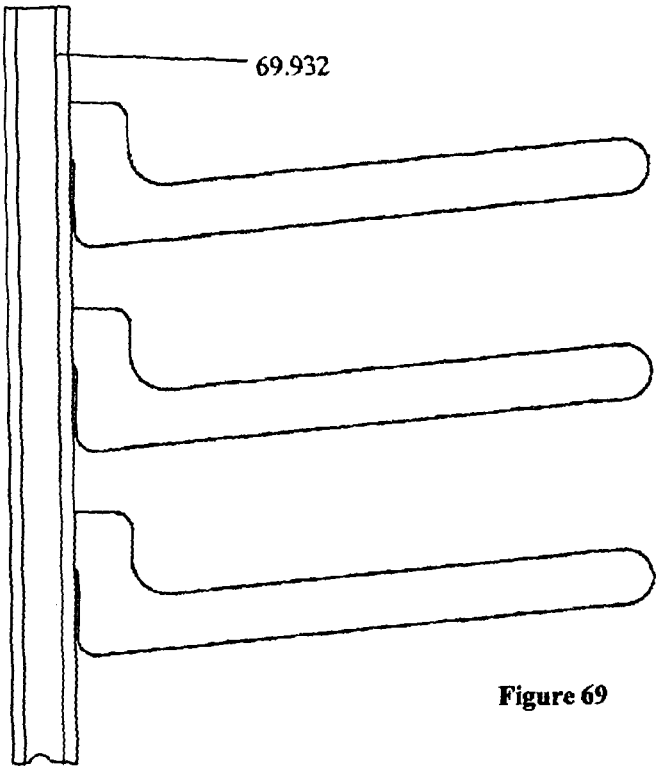
FIG. 69 illustrates a left side elevation of the system of FIG. 66 showing multiple brackets in position.
Figure 70:
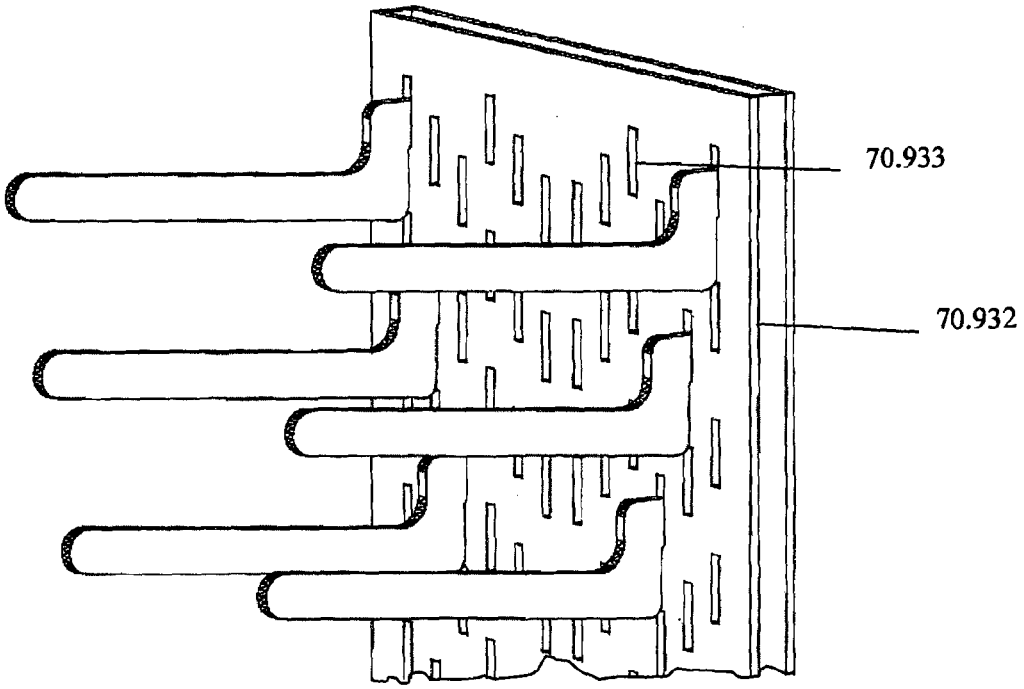
FIG. 70 illustrates a right side perspective view of a wall or wall plate receiving several brackets across the width.
Figure 71:
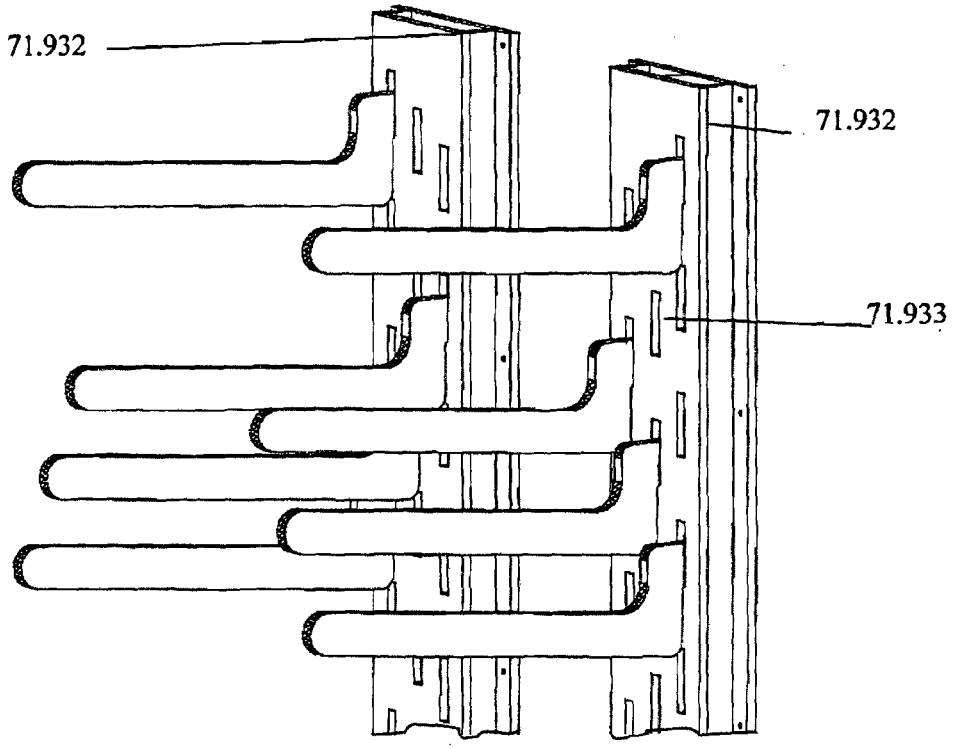
FIG. 71 illustrates the system of FIGS. 66 to 69 where two wall mounted plates are used to space brackets laterally with respect to each other.

Illustrated in FIGS. 66 to 71 is another racking system which utilises brackets similar to those described above with the vertical apertures discussed at FIGS. 11 and 12, with several differences. The main difference is that the bracket supports and pins or dowels are not utilised. Instead, as is illustrated in FIGS. 68, 70 and 71, a front panel 66.932 which has an array of rectangular shaped slots 68.933, which provides communicable passage to a space 68.934 which is locate at the rear of the panel 66.932. The space 68.934 is formed between the rear of panel 69.932 and the wall plate 68.935 by means of the side members 68.936. In this instance the wall plate 68.935, which in this instance is the means to secure the support formation (comprising the front panel 68.932, side members 68.936 and wall plate 68.935) to a wall or wall means such as a stand frame etc. The wall plate 68.935 can, if desired, be absent in which case the front panel 68.932 and side members 68.936 can be secured direct to a wall or wall means such as a wall or frame of a stand.

As is illustrated best in FIG. 67 the bracket has its own downwardly directed slot 67.013 which spaces the rear tongue 67.008 away from the rest of the bracket. The rear tongue 67.008 has a width which is approximately equal to the width of the space 67.934, and this geometry together with the slot 67.013 having its forward edge distanced from the external face of the panel 67.932 will ensure that the forward end of the bracket will provide some elasticity, suspension or damping qualities, in order to decrease the impulse (force divided by time) by increasing the time that it takes to bring an object stored on the bracket to rest. This effect like previous brackets depends upon the ability of the material of the bracket on the outer side of the slot 6.013 being able to move relative to the tongue 67.008.

As can be seen in FIGS. 68, 70 and 71 the support formations are provided with an array of slots 68.933, 70.933 and 71.933, so that a multiplicity of brackets and flexibility of their use can be provided. In FIG. 70, a single support formation carries the panel 70.932 and is wide enough to have two brackets engaged in respective slots, thereby allowing support of articles. Whereas in FIGS. 68 and 71, there are provided only three columns in the array, and if long objects need to be supported then tow support formations, as depicted in FIG. 71 will need to be utilised.

Figure 72:
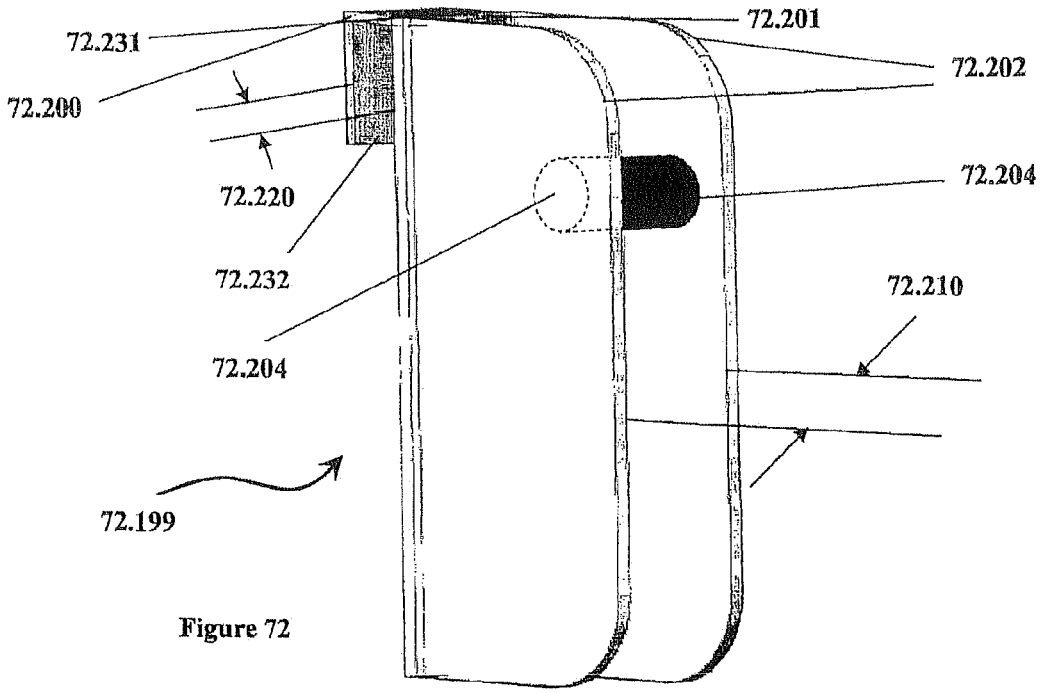
FIG. 72 illustrates a front perspective view of a removable support means with bracket supports able to be removably engaged with the support slots in FIGS. 68, 70 and 71.
Figure 73:
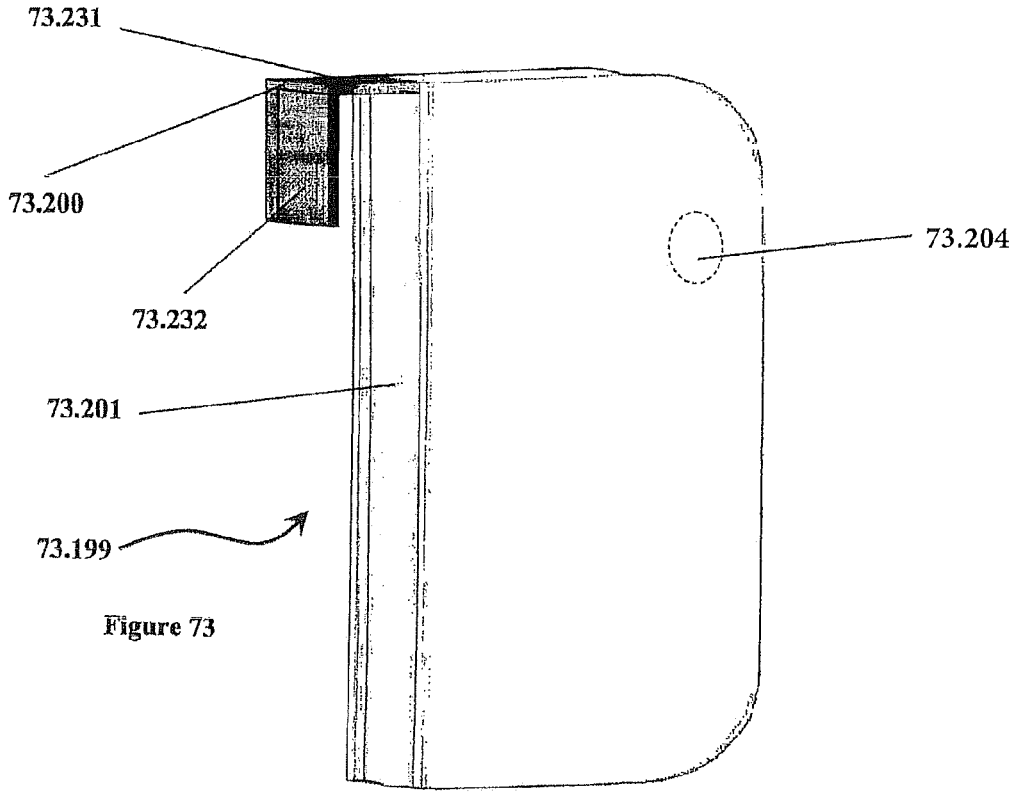
FIG. 73 illustrates a rear perspective view of the removable support means of FIG. 72.

Illustrated in FIGS. 72 and 73 is a removable support means that is able to engage with slots 68.933, 70.933 and 71.933 in a wall or attached to a wall. The removable support means is made up of two support flanges 72.202, a support plate 72.201, a support hook 72.200 and a bracket support 72.204. The support flanges 72.202 and the support plate 72.201 form a U shape with a channel bounded by the support flanges 72.202 and the support plate 72.201. The support hook 72.200 includes a horizontal member 72.231 and a vertical member 72.232. The support hook 72.200 can be inserted into the slots 68.933, 70.933 and 71.933 with the vertical member 72.232 entering the space 68.934 and the horizontal member 72.231 extending through a rear panel such as 69.932. The distance 72.220 is approximately equivalent to the thickness of the rear panel through which it extends such as 69.932.

When the support hook 72.200 is engaged in a slot the support plate 72.201 rests against the external face of the panel 67.932. The bracket support 72.204 is engaged between the two support flanges 72.202 and is able to receive a bracket that contains a slot such as shown in FIGS. 9 and 10. The bracket support can be fixed or removable. Where a bifurcated bracket is used two removable support means 72.199 will be required. The distance 72.210 between the inside faces of the support flanges is approximately equivalent to the thickness of a bracket support 2.024. The bracket engages with the removable support means 72.199 in the same way as been described above for other embodiments of the racking system.

Figure 74:
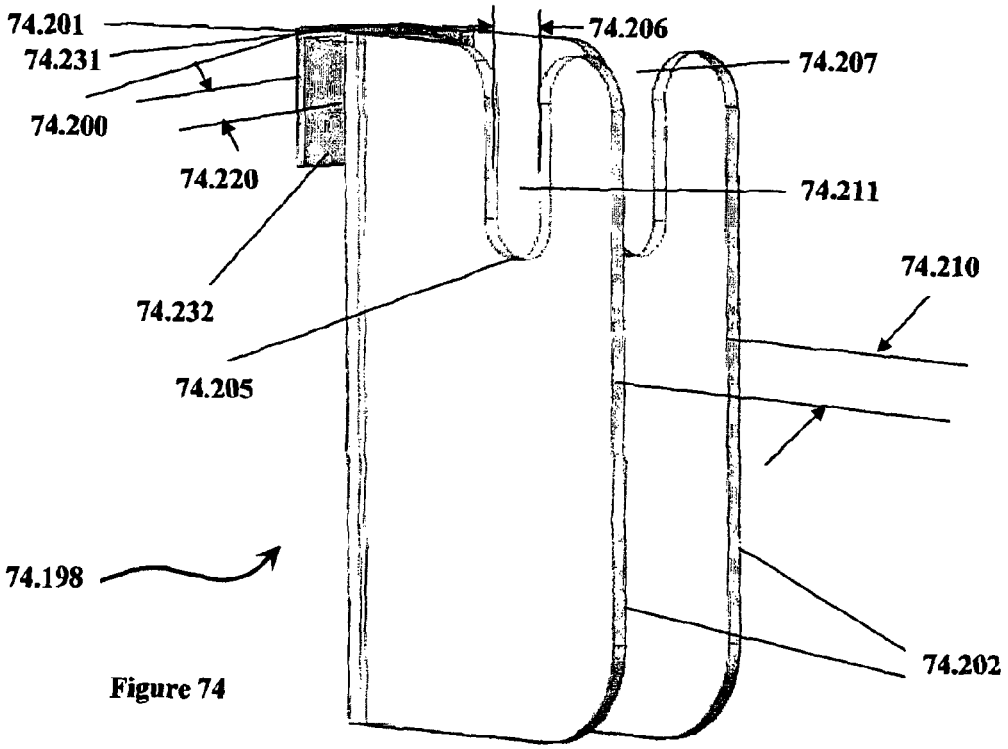
FIG. 74 illustrates a front perspective view of an alternative removable support means as in FIG. 72 with a vertical slot able to engage with a removable bracket support.
Figure 75:
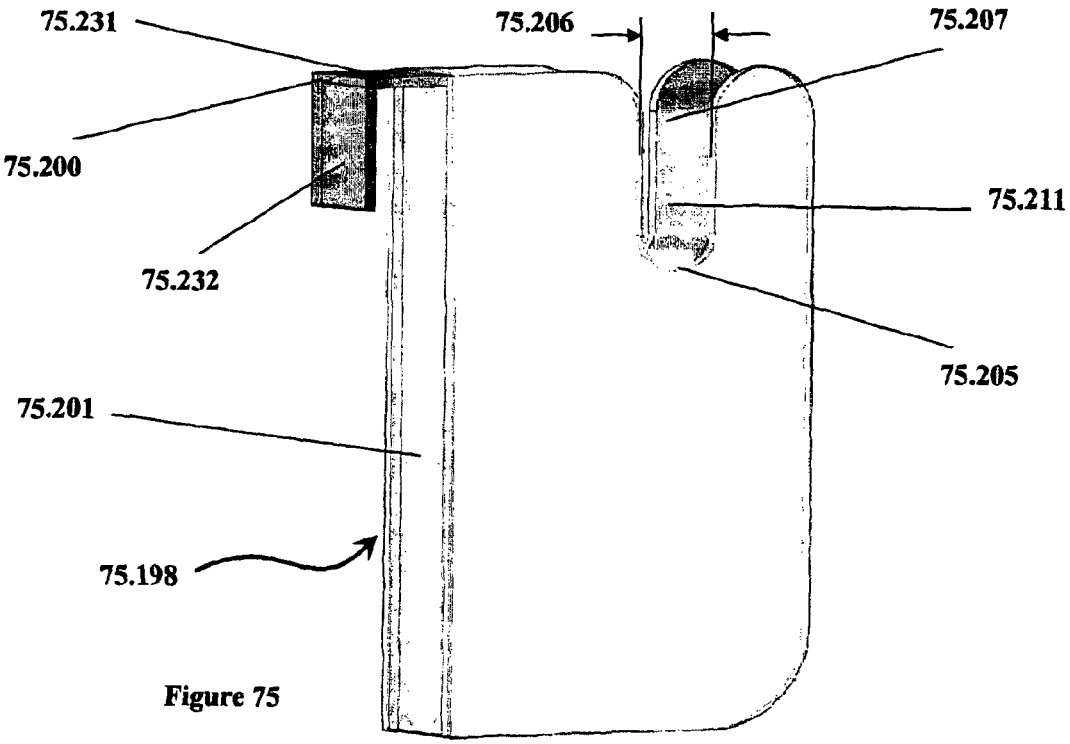
FIG. 75 illustrates a rear perspective view of the removable support means of FIG. 74.

Illustrated in FIGS. 74 and 75 is a removable support means 74.198 similar to 72.199. The difference being that the bracket support in the form of a pin is not used, instead an upwardly directed slot 74.211 in the support flanges 74.202 is used. The upwardly directed slot 74.211 is able to receive a bracket support such as the one illustrated in FIG. 21. The bracket support is inserted through the opening 74.207 and rests in the terminus 74.205. When resting in the terminus the bracket support can engage a bracket in the same manner as has been described above. The distance 74.206 is approximately equivalent to the width or diameter of the bracket support. The upwardly directed slot as shown can be replaced with a slot of different dimensions such as those of slot 1.005.

The removable support means 72.199, 73.199, 74.198 and 75.198 illustrated between FIGS. 72 to 75 are illustrated with only 2 support flanges, however if desired they may include 1 support flange or more than 2 support flanges.

FIGS. 76 to 94 illustrate a bracket 76.006 for supporting a watercraft such as a kayak, surf ski, surfboard, canoe, sail board, wind surfing board, small run about or other watercraft in a cantilever manner with the use of straps. The brackets differ from each other in the form of straps that they use, which will be further described throughout the description. FIG. 95 illustrates a possible support means. FIGS. 99 to 102 illustrate a bracket for supporting a watercraft that is angularly adjustable.

In one embodiment the bracket as illustrated in FIGS. 76 to 101 can be used in the racking system as described above.

Figure 76:
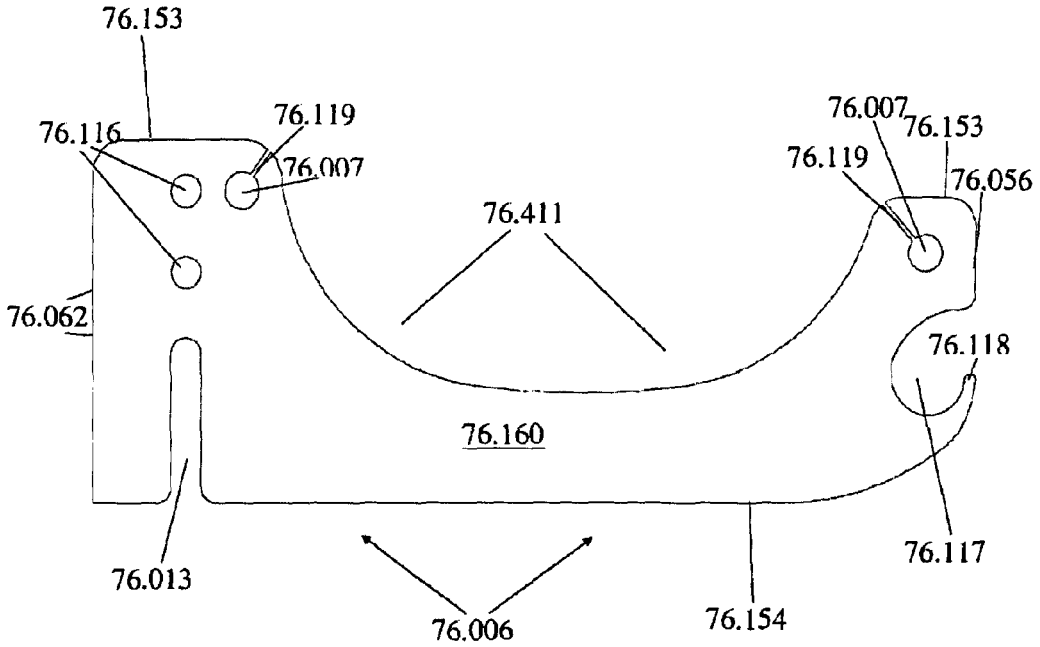
FIG. 76 is a side view of a bracket for supporting watercraft illustrating apertures for receiving support means, a top edge with a U shaped medial section and additional supporting aperture in the front edge.

FIG. 76 illustrates a bracket 76.006 prior to being fitted with a strap. The bracket includes a load bearing edge 76.062, a top edge 76.153, a bottom edge 76.154 and a front edge 76.056. The bracket extends from the load bearing edge 76.062 to the distal front edge 76.056 to receive a watercraft on the top edge 76.153. The top edge 76.153 includes at a medial region a depression or recess 76.411 that has a somewhat U shaped profile to receive the hull of a watercraft. In use generally at least two brackets are used supporting a watercraft at, at least two points.

Figure 78:
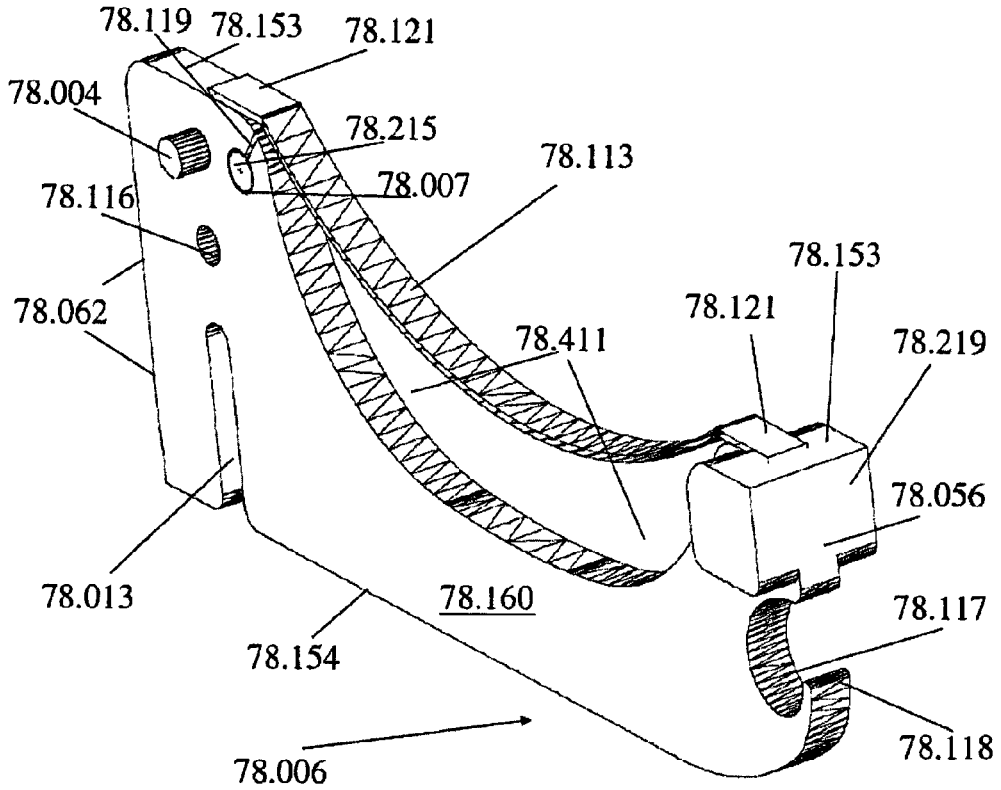
FIG. 78 is a perspective view of the bracket of FIG. 77 with the addition of a support pin.
Figure 81:
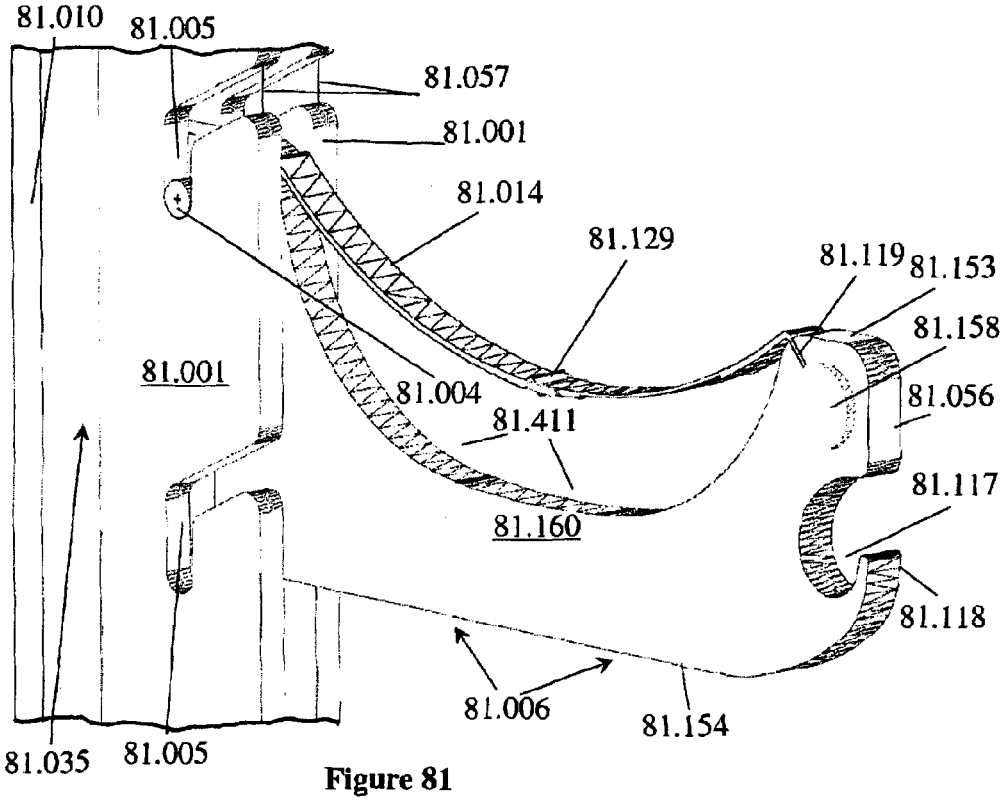
FIG. 81 is a perspective view of the bracket of FIG. 80 engaged with a support member.

FIG. 81 illustrates the manner in which the bracket 81.006 is supported by engaging with a support member 81.035 through the use of support means 81.004 held in a slot 81.005 in a support flange 81.001 attached to a support plate 81.010. It is readily envisaged that the support plate 81.010 can be either a plate or the structure against which the support member 81.035 is attached. FIG. 78 illustrates the support means 78.004 as being in the form of a pin or rod. The apertures 76.116 receive and engage the support means 78.004 and acts as the fixing point for the bracket 76.006 to the support member. FIG. 81 illustrates the bracket 81.006 being engaged with the racking system described above in previous embodiments.

The bracket 76.006 include apertures 76.116 open on two opposite faces of the bracket that are located proximate to the load bearing edge 76.062 and the top edge 76.153. The apertures 76.116 are able to receive a support means in the form of a pin or rod that extends in both directions laterally beyond the face 76.160 of the bracket.

A slot 76.013 extends from the bottom edge 76.154 proximate to the load bearing edge 76.062 generally parallel to the load bearing edge. As an alternative to one of the apertures 76.116 the slot 76.013 is able to receive a support means as illustrated in FIG. 21 in the form of a flanged pin to engage with a support member as described above. When the bracket is loaded with a water craft the slot 76.013 can flex to dampen the force from loading the watercraft as described above for FIGS. 11 and 12.

The bracket 76.006 along its front edge 76.056 includes an open faced aperture 76.117 able to receive additional materials such as an oar, paddle or fishing rod. The aperture 76.117 includes a restraining edge 76.118 that acts to hold the additional material in place.

The top edge 76.153 at the entrances of the U shaped medial region 76.011 includes at least one slot 76.119 ending in an aperture 76.007. Illustrated in FIG. 76 there are two slots 76.119 and two apertures 76.007, one of each at the distal and proximal ends of the U shaped medial regions entrance. The slot 76.119 receives a strap that extends over the medial region 76.011 with a U shaped profile and the aperture 76.007 receives a strap engaging pin that is fixed to the strap and is further described below.

Figure 77:
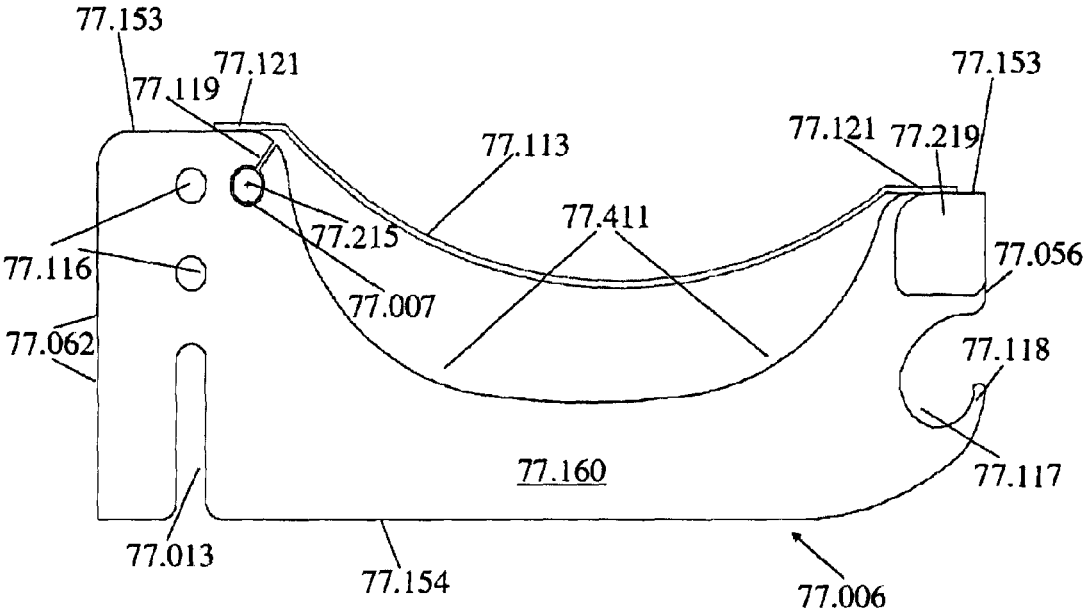
FIG. 77 is a side view of a bracket for supporting watercraft illustrating a strap member engaged with the top edge of the bracket, a top edge with a U shaped medial section and additional supporting aperture in the front edge.

FIGS. 77 and 78 illustrate a bracket for supporting a watercraft 77.006 and 78.006 that includes a strap 78.113 across the U shaped medial region 78.011. The strap 78.113 can be made of rubber, cloth, webbing, synthetic fibres or a variety of other materials readily understood by the skilled addressee. The strap 78.113 is fixed in two places to the top edge 78.153 of the bracket 78.001 proximate to the entrance to the U shaped medial region 78.011. The strap 78.113 is fixed at points 78.121. Points 78.121 can be screwed, pinned, glued, bonded or integrally formed with the top edge 78.153. In this embodiment the strap 78.113 is of a fixed length. When fixed in place and a water craft is loaded onto the bracket 78.006 the strap 78.113 acts to dampen the force of the hull of the watercraft contacting the bracket 78.001. Additionally when loaded the straps help to absorb any external forces applied to the watercraft or bracket. For example a force applied when the bracket or watercraft is bumped, or when the watercraft is adjusted or if the watercraft is being transported while being loaded on the bracket 78.001. The front edge 78.056 includes a T section 78.219 on the top edge 78.153 that extends laterally beyond both faces 78.160 of the bracket 78.006.

In this embodiment the aperture 77.007 and 78.007 includes a strap engaging pin 77.215 and 78.215 which is not engaged with the strap 77.113 and 78.113.

Figure 79:
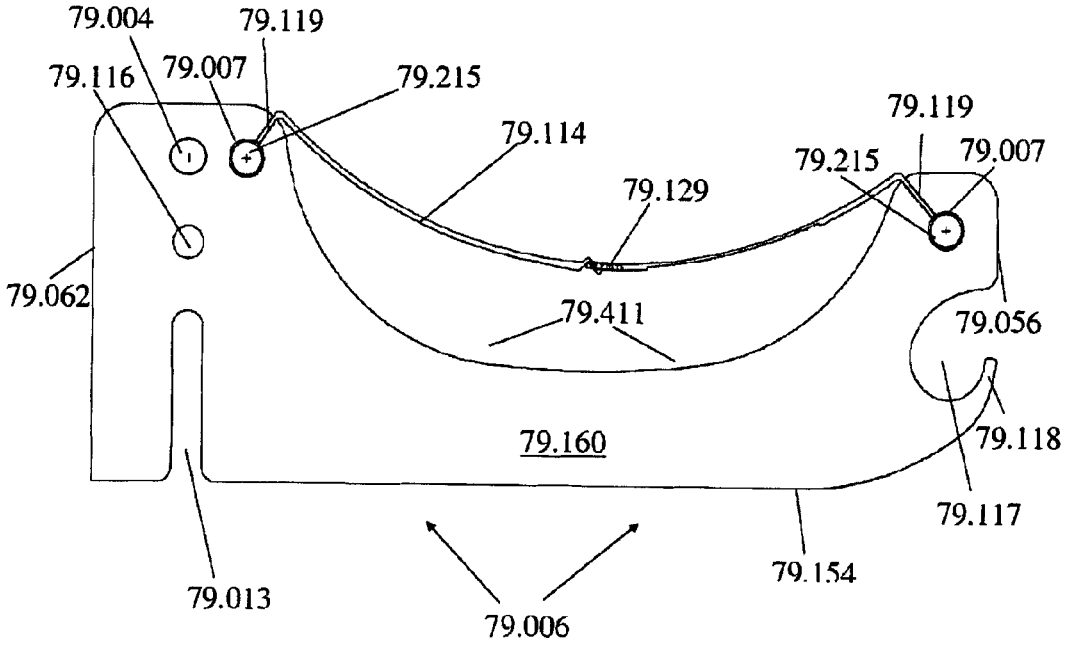
FIG. 79 is a perspective view of a bracket for supporting watercraft illustrating a strap member engaged with pins in strap supporting apertures, a top edge with a U shaped medial section and additional supporting aperture in the front edge.
Figure 80:
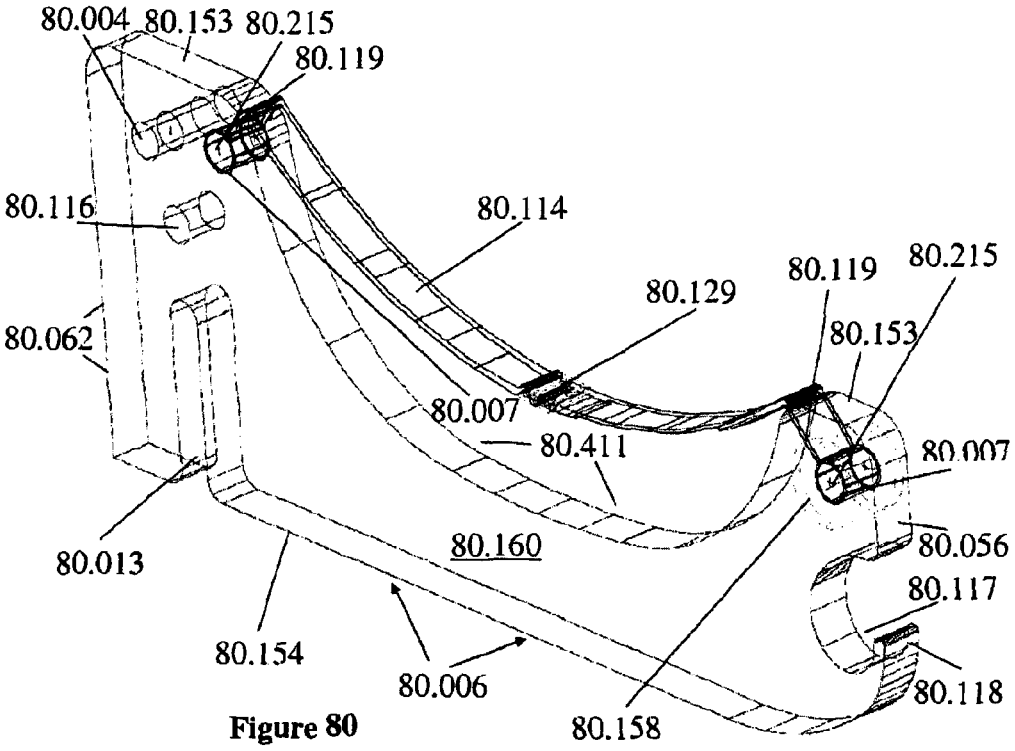
FIG. 80 is a perspective view of a bracket for supporting watercraft as in FIG. 4 with a ladder lock on the strap and caps on the pins in the strap supporting aperture.

FIGS. 79 and 80 illustrate a bracket 79.006 and 80.006 for supporting a watercraft that includes an adjustable strap 79.114 and 80.114. The strap 79.114 and 80.114 includes an adjustment means including a ladder lock or slide adjuster 79.129 and 80.129 to adjust the length of the strap 79.114 and 80.114. The strap 79.114 and 80.114 engages with bracket 79.006 and 80.006 through the use of strap engaging pins 79.215 and 80.215. The ends of the strap 79.114 and 80.114 can be fixed to a strap engaging pin 79.215 and 80.215 or can be removably engageable with the strap engaging pin. The strap engaging pin 79.215 and 80.215 is inserted into an aperture 79.007 and 80.007 proximate to the entrance to the U shaped medial region 79.411 and 80.411 of the top edge 79.153 and 80.153. A slot 79.119 and 80.119 extends from the top edge near the entrance to the U shaped medial region 79.411 and 80.411 which is wide enough to hold the strap 79.114 and 80.114 but is not wide enough to allow the strap engaging pin 79.215 and 80.215 to pass through. When a hull is loaded onto the strap 79.114 and 80.114 the resultant force pulls the strap engaging pin 79.215 and 80.215 towards the centre of the U shaped medial region 79.411 and 80.411 which are restrained by the width of the slot 79.119 and 80.119. The length of the strap 79.114 and 80.114 can be adjusted using an adjustment mechanism such as ladder lock or slide adjuster 79.129 and 80.129 allowing a loaded watercraft to sit lower in the U shaped medial region 79.011 and 80.011 with a longer strap 79.114 and 80.114 length.

The strap engaging pins 79.215 and 80.215 can be locked within the aperture 79.007 and 80.007 or can be removable. When removable the strap engaging pins can optionally include locking means such as a cap flange 79.158. The cap flange 80.158 can be may be removably connected by a thread system, or clip system or integrally formed therewith or permanently fixed to the pin by thread and glue, or simply glued or attached by any other appropriate means.

FIG. 81 illustrates a bracket 81.006 for supporting a watercraft engaged in a support member 81.035 as described above between FIGS. 1 and 60. The bracket engages the flange in the same way as the bracket described between FIGS. 1 and 60 and is numbered accordingly. The strap 81.114 includes a ladder lock or slide adjuster 81.129 to allow the strap 81.114 to be lengthened and shortened. The strap engaging pin located proximal to the load bearing edge of the bracket does not need a cap flange 81.158 and does not need to be fixed in the aperture for receiving it as the receiving flanges 81.001 act to fix the strap receiving pin in place.

The wall to which the rack system is attached can be a stationary wall such as found in a building. However if desired, the wall can be part of a frame or stand upon which the racking system is to be mounted, with such a frame or stand being free standing or wheel mounted for easy movement and re-positioning.

Figure 82:
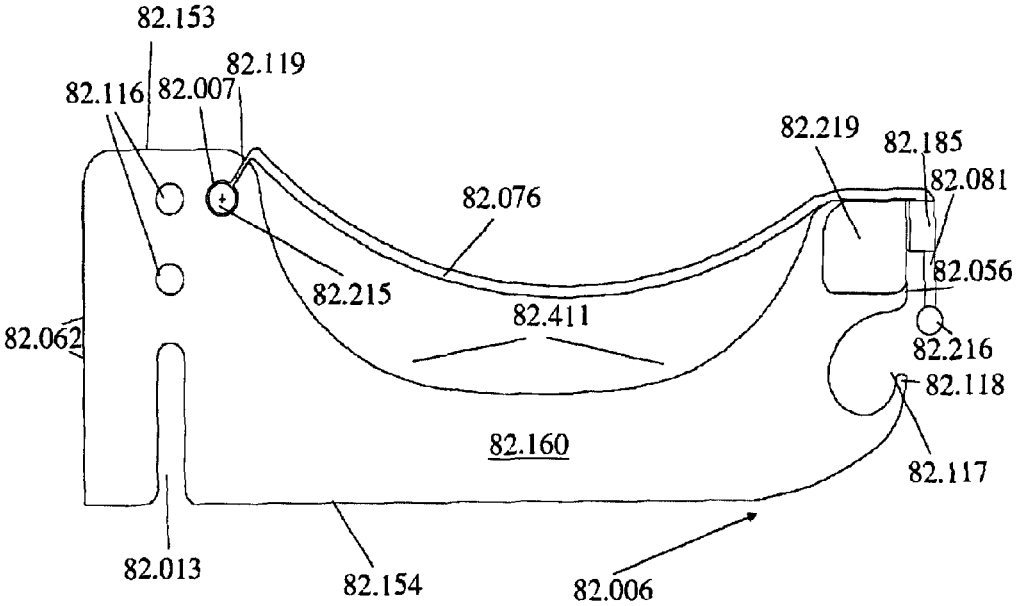
FIG. 82 is a side view of a bracket for supporting watercraft illustrating a strap, a toothed cam lock on the brackets front edge, a T lock on the end of the strap, a top edge with a U shaped medial section and additional supporting aperture in the front edge.
Figure 83:
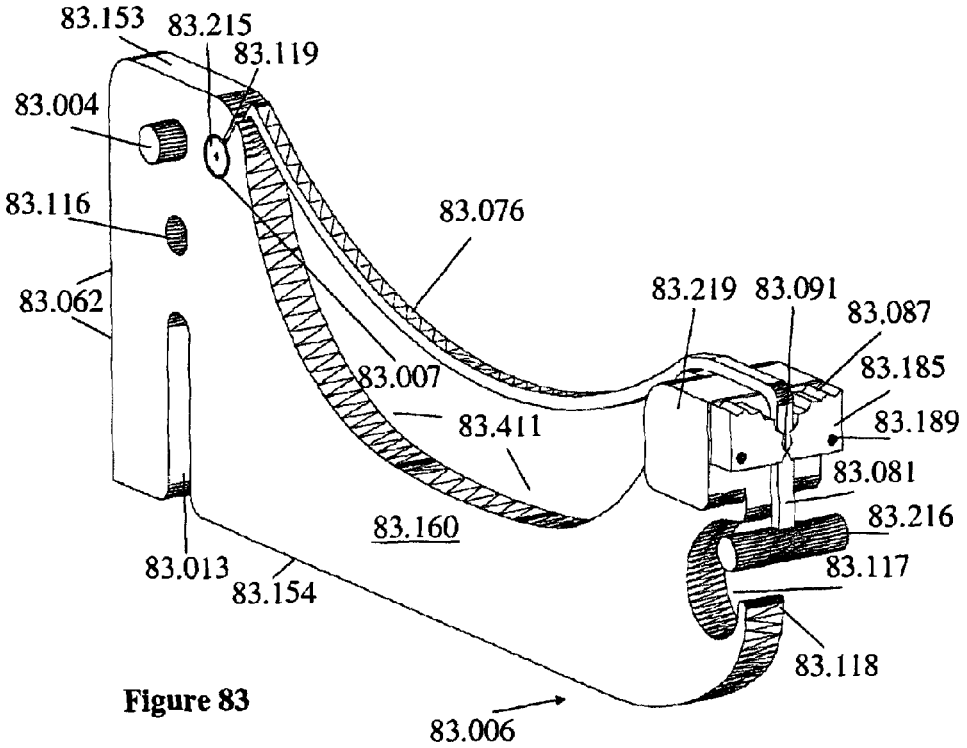
FIG. 83 is a perspective view of the bracket of FIG. 82 with the addition of a support pin.

FIGS. 82 and 83 illustrate a bracket with an extended strap 82.076, 83.076 and a cam cleat 82.185, 83.185 locking mechanism on the front edge 82.056 for locking the extended strap 82.076. The cam cleat rotates around a point 83.189 to lock and unlock the strap 82.076, 83.076. The top edge 82.153, 83.153 includes a T section 82.219 at the front edge 82.056 that that extends laterally from the face 82.160, 83.160 in both directions and is used to fix the toothed cam cleat on the front face 82.056. The extended strap 82.076 on the front tope edge 82.153 lies over the T section 82.219 and passes through the cam cleat 82.185 which stops the strap 82.076 lengthening over the U shaped medial region 82.011 when locked. A hanging section 82.081 of the strap 82.076 hangs past the cam cleat 82.185 and terminates in a T bar 82.216. The T bar 82.216 acts as a grip and to set the maximum length to which the strap 82.076 can lengthen over the U shaped medial region 82.011.

Where the term capped flange has been used to describe the flanges on the end of a bracket support it does not restrict the shape of the flange to being circular as depicted in the drawings. The disc flange can be of any profile that is larger than the aperture in the bracket support and the width of the flange slots.

Figure 84:
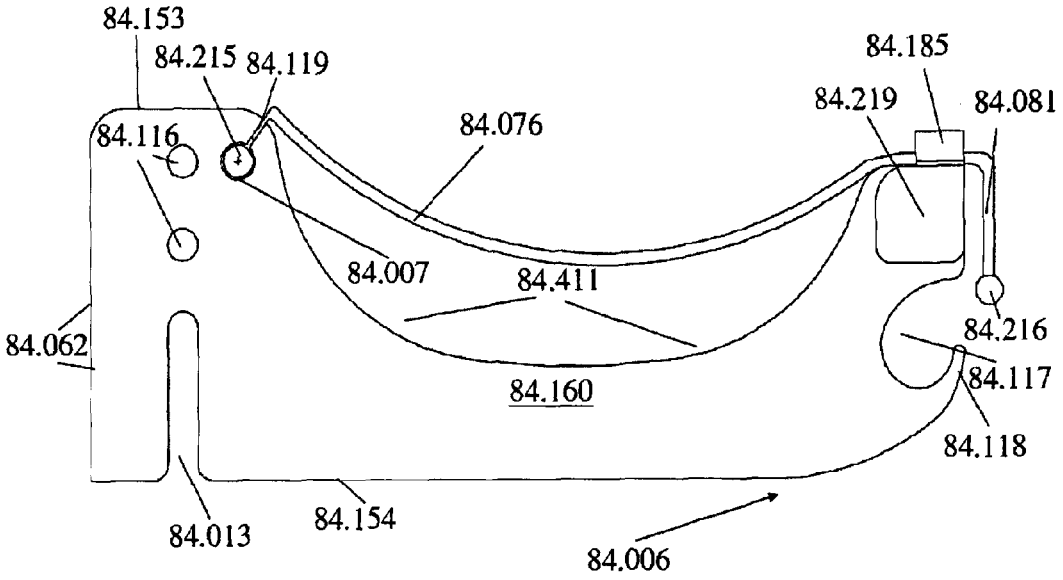
FIG. 84 is a side view of a bracket for supporting watercraft illustrating a strap, a toothed cam lock on the brackets top edge, a T lock on the end of the strap, a top edge with a U shaped medial section and additional supporting aperture in the front edge.
Figure 85:
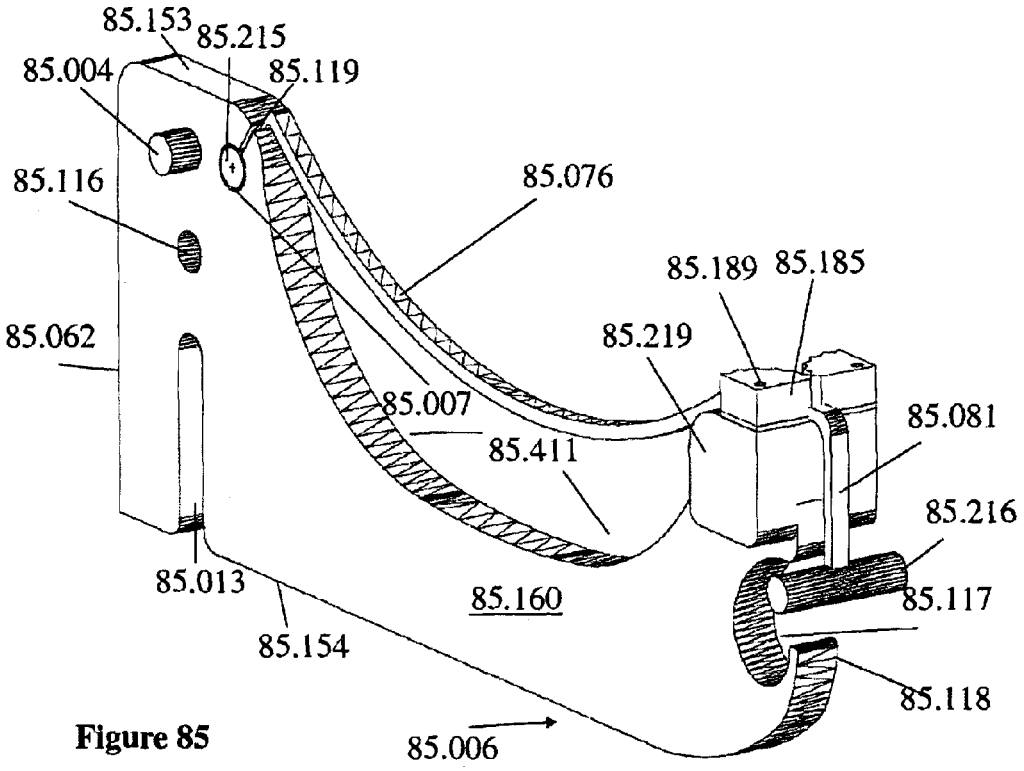
FIG. 85 is a perspective view of the bracket of FIG. 84 with the addition of a support pin.

FIGS. 84 and 85 illustrate a bracket similar to that in FIGS. 82 and 83 with like parts being like numbered. In FIGS. 84 and 85, the cam cleat is fixed on top of the T section 84.219, 85.219.

Figure 86:
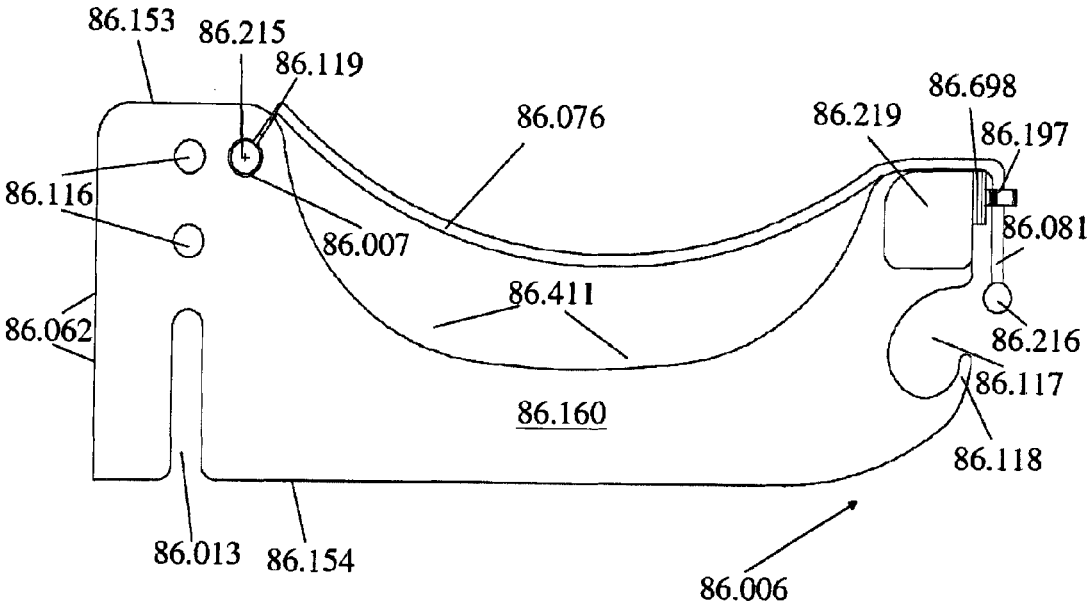
FIG. 86 is a side on view of a bracket for supporting a watercraft illustrating a strap, a guide stop on the front edge of the bracket, a T lock on the end of the strap, a top edge with a U shaped medial section and additional supporting aperture in the front edge.
Figure 87:
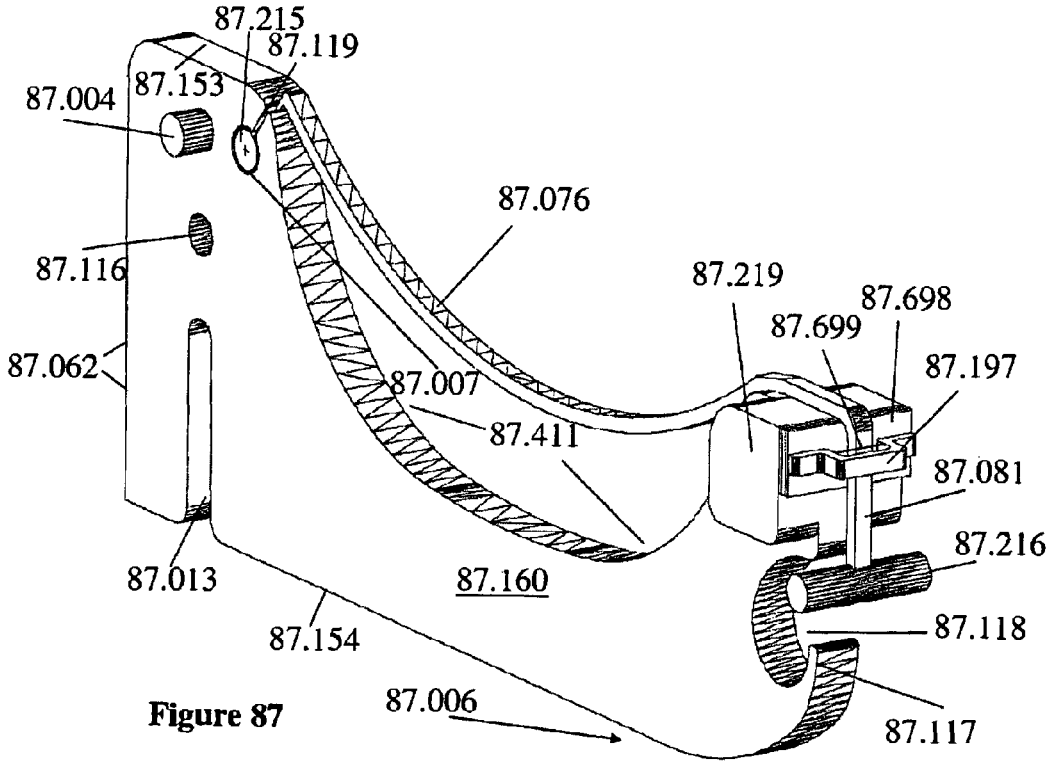
FIG. 87 is a perspective view of the bracket of FIG. 86 with the addition of a support pin.

FIGS. 86 and 87 illustrate a bracket as in FIGS. 82 to 85 with an apertured bracket 86.197, 87.197 instead of a cam cleat. The strap 86.076, 87.076 cannot be locked in a variety of positions in this embodiment. The strap 86.076, 87.076 passes through an aperture 87.699 in the bracket 86.197. When a water craft is loaded on the bracket the strap 86.076, 87.076 will lengthen in the U shaped medial region 86.011, 87.011 and shorten in the hanging section 86.081, 87.081. The T bar 86.216 is longer than the aperture 87.699 in the apertured bracket 86.197, 87.197 so that when the bracket 86.001, 87.001 is loaded with a watercraft the apertured bracket 86.197, 87.197 will act to stop the T bar 186.216, 87.216 raising further, limiting the length of the strap 86.076 in the U shaped medial region 86.011.

Figure 88:
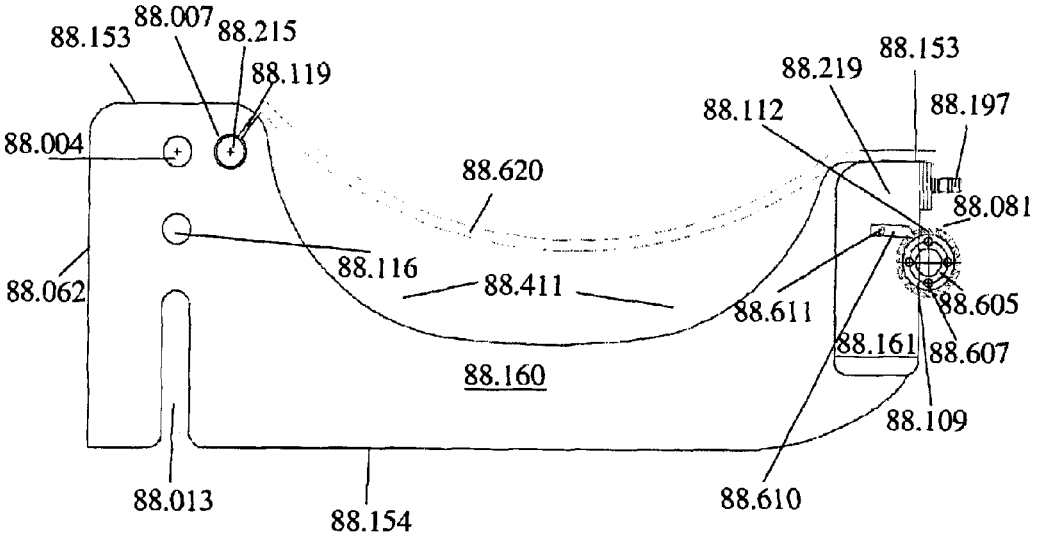
FIG. 88 is a side on view of a bracket for supporting a watercraft illustrating a strap, a guide on the front edge of the bracket, a rotating cylinder attached to the strap for shortening, toothed ends and a locking member for engaging the cogged ends and additional supporting aperture in the front edge.
Figure 89:
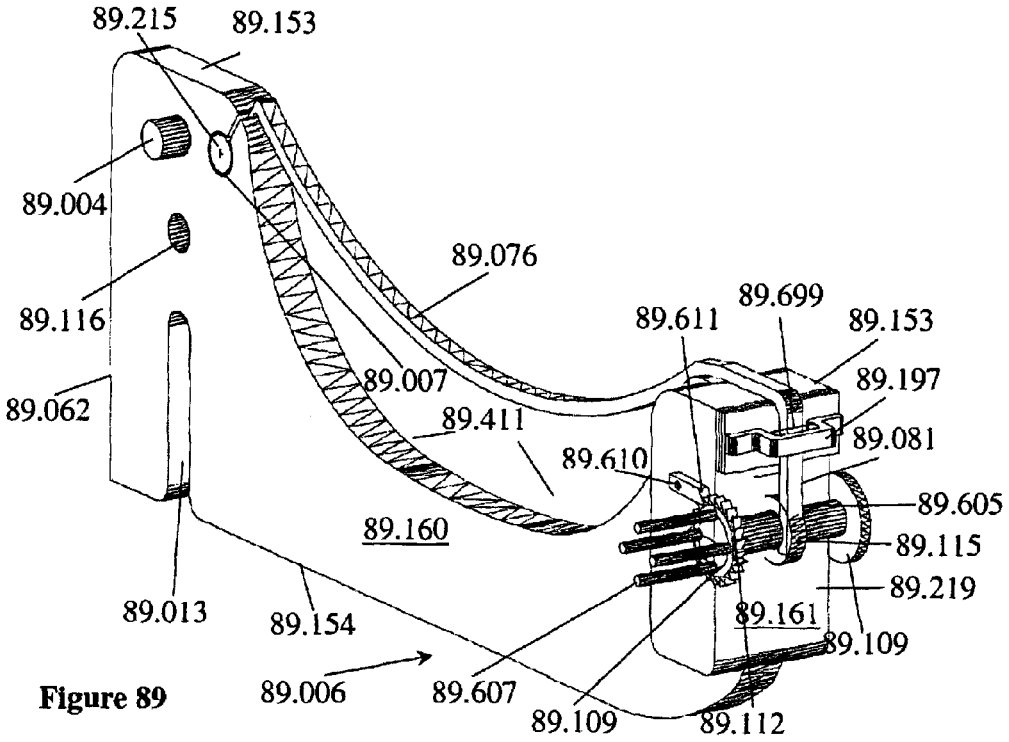
FIG. 89 is a perspective view of the bracket of FIG. 88.

FIGS. 88 and 89 illustrate a bracket as in FIGS. 86 to 87 with a tightening barrel 88.605. The end of the strap 89.076 is fixed or engageable with the centre section 89.115 of the tightening barrel 89.605. The tightening barrel includes end flanges 89.109 that project partially over the side face 88.161, 89.161, that act as ratchet members. A pivoting locking member 88.610 is fixed to the side face 88.161, 89.161 at a pivot point 88.611, 89.611. The locking member 88.610, 89.610 engages with a toothed edge 88.112 of the end flange and has handles 88.607, 89.607. When the strap 89.076 is engaged with the tightening barrel 88.605, 89.605 the end flange 88.109 can be rotated causing the strap 188.076, 89.076 to roll up around the tightening barrel 88.605, 89.605, shortening the strap 88.076, 89.076 resulting in a loaded water craft sitting higher in the U shaped medial region 88.011, 89.011. One or both end flanges 88.109, 89.109 can include a toothed edge. And one or both side faces 88.161, 89.161 can include a locking member 88.610, 89.105. When engaged with a toothed edge 88.109, 89.109 of the tightening barrel the locking member 88.610, 89.610 acts to lock the strap 88.076, 89.076 in the rolled up position.

Figure 90:
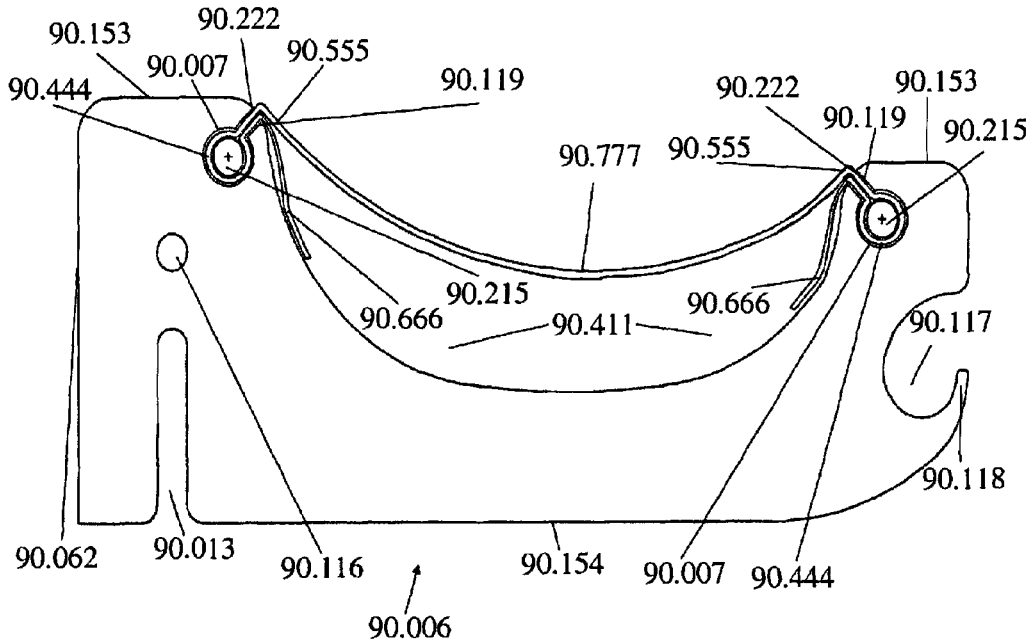
FIG. 90 is a side view of a bracket for supporting a watercraft illustrating a wrap around adjustable strap.
Figure 91:
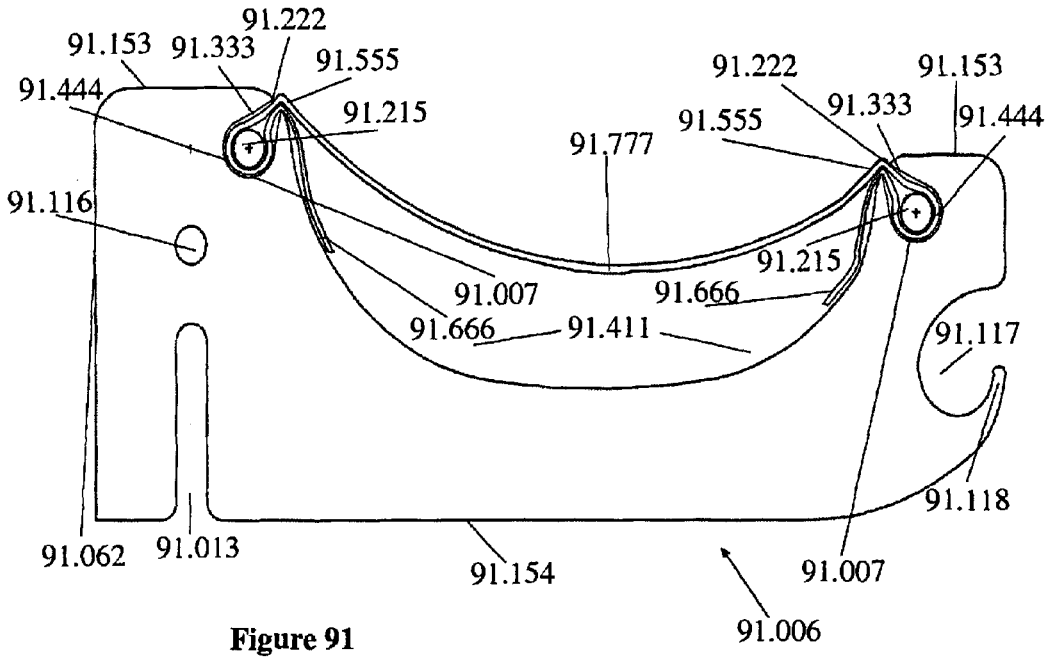
FIG. 91 illustrates the bracket of FIG. 90 with a tapered strap receiving slot.

FIGS. 90 and 91 illustrate a bracket 90.006 and 91.006 for supporting a watercraft as described above with a different strap arrangement. FIG. 90 illustrates a single piece adjustable strap 90.777 that will fit into the aperture 90.007 and slot 90.119 as described in the above embodiments such as in FIG. 79. The single piece adjustable strap enters the slot 90.119 at the opening 90.222 and then wraps around the engaging pin 90.215 and then exits the slot 90.119. The load bearing end 90.555 of the strap and the free end 90.666 of the strap when the bracket is unloaded can be lengthened or shortened to give the strap 90.777 different lengths across the middle section 90.411. When a watercraft is loaded onto the strap 90.777 the load bearing end 90.555 pushes down on the free end 90.666, effectively locking both in place, stopping both the load bearing end 90.555 and the free end 90.666 from being shortened or lengthened.

FIG. 91 illustrates a bracket 91.006 similar to that illustrated in FIG. 90. Instead of the generally straight slot 90.119 illustrated in FIG. 90 a tapered slot 91.333 extends into the aperture 91.007. This results in the same operation as described in FIG. 90 with the locking of the load bearing end 90.555 and the free end 90.666 being further localised at the opening 90.222. Other arrangements of the slot and opening can be used to aid in locking the strap in place when loaded.

Figure 92:
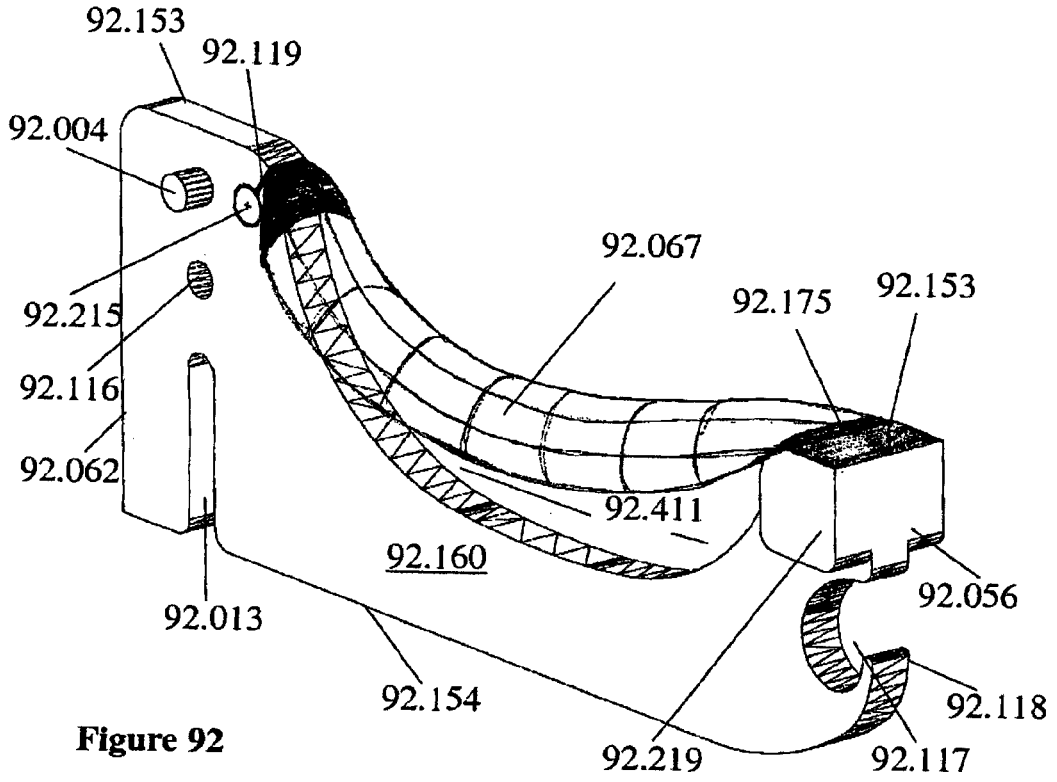
FIG. 92 illustrates a bracket for supporting a watercraft illustrating a bladder fixed to the bracket on one end, a top edge with a U shaped medial section and additional supporting aperture means in the front edge.

FIG. 92 illustrates a bracket 92.006 for supporting a watercraft with a U shaped medial region 92.011, supporting means 92.004 and an aperture 92.117 as described in the above embodiments. An inflatable bladder 92.167 is used in the same way as the strap described in the above embodiments. The bladder 92.167 is engaged with a strap engaging pin 92.215 in the same way as described for the strap in the above embodiments. Illustrated is the bladder 92.167 engaged with a strap engaging pin at only the end proximal the load bearing edge 92.062 but the bladder can be fixed to the top edge 92.153 in any of the manners described in the above embodiments. The bladder 92.167 is illustrated as being inflated allowing it to absorb more force than if it were deflated.

Figure 93:
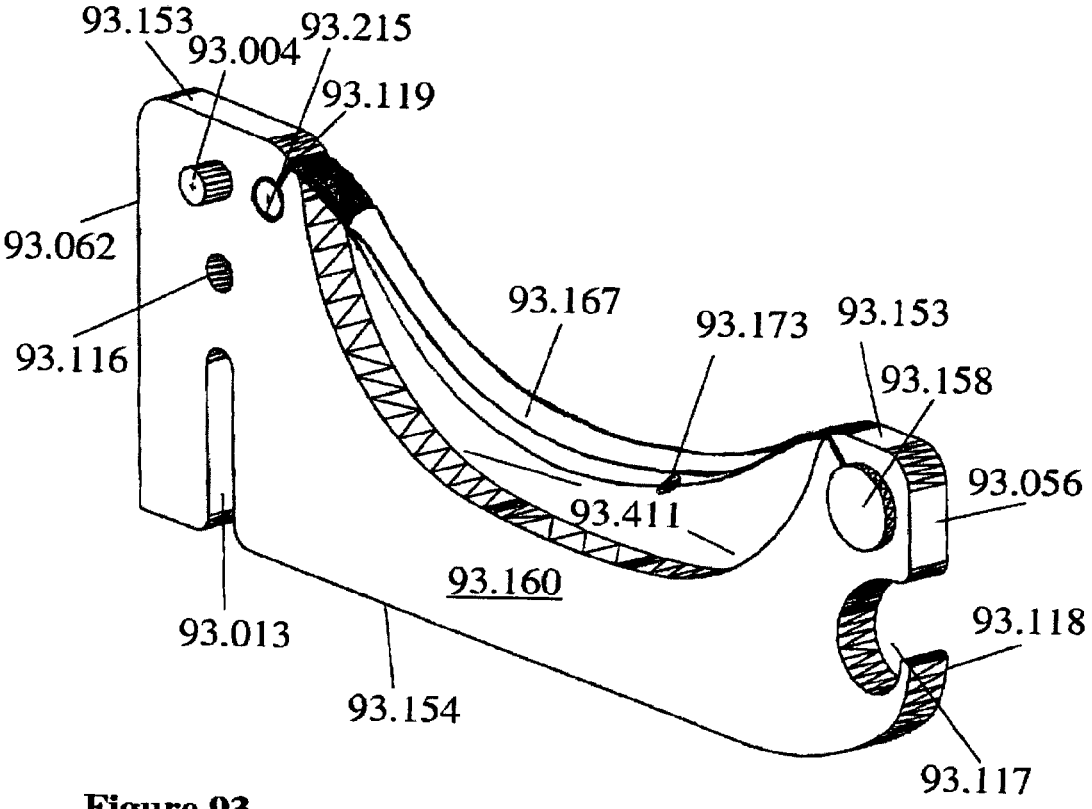
FIG. 93 illustrates a bracket for supporting a watercraft illustrating a removable deflated bladder with a valve and additional supporting aperture means in the front edge.

FIG. 93 illustrates a bracket 93.001 as in FIG. 93 where the bladder 93.167 is fixed at both ends of the U shaped medial region 93.011 with the use of strap engaging pins 93.215. The bladder 93.167 is illustrated as deflated and a valve 92.0173 can be used to inflate the bladder 93.167 with inflating material.

Figure 94:
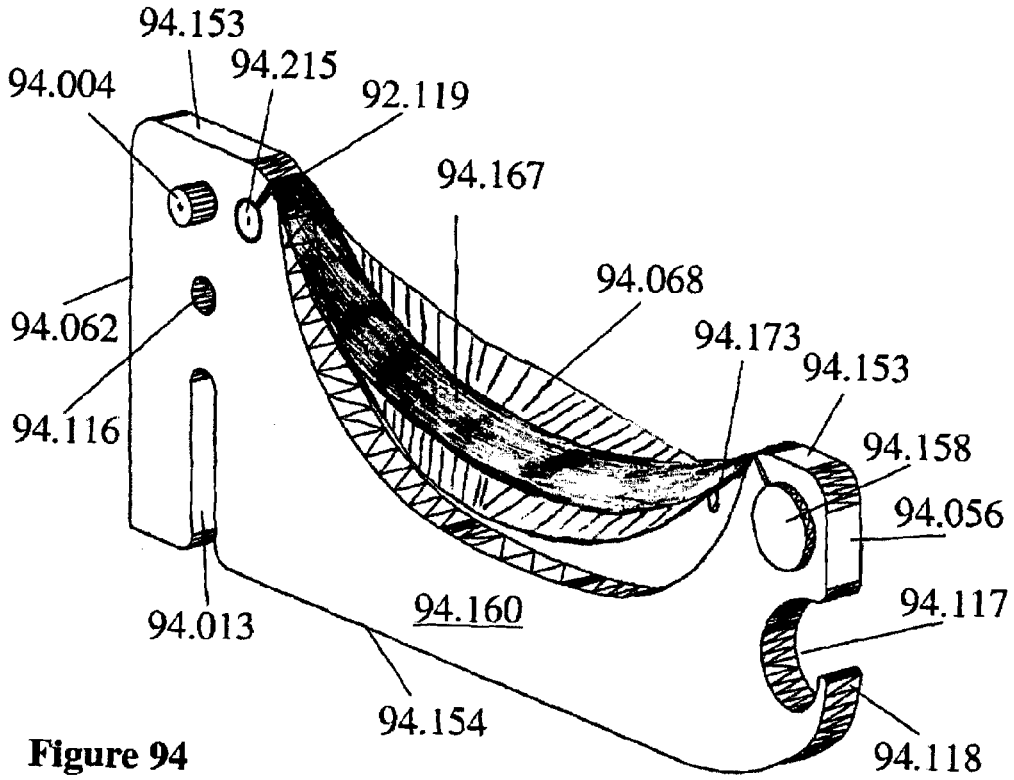
FIG. 94 illustrates a bracket for supporting a watercraft illustrating a removable deflated bladder with a valve, webbed siding and an additional supporting aperture in the front edge.
Figure 95:
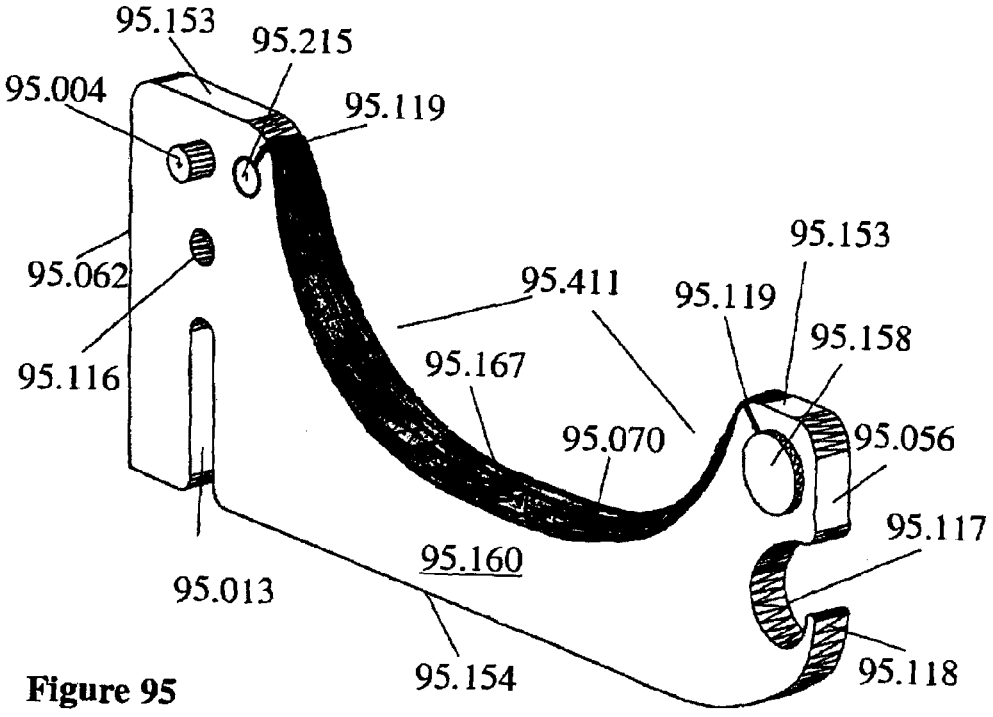
FIG. 95 illustrates a bracket for supporting a watercraft illustrating a bladder fixed to a U shaped top edge medial section and an additional supporting aperture in the front edge.

FIG. 94 illustrates a bracket 94.006 as in FIG. 91 where the bladder 94.167 overlies a webbing material 94.068, or includes it along its lengthwise edges. The webbing allows the bladder to support a larger surface area of the hull of the watercraft, better distributing the force applied to the bladder 94.167.

FIG. 95 illustrates a bracket 95.006 as in FIGS. 92 and 93 where the bladder 95.167 is fixed to the top edge of the bracket along the length of the U shaped medial region 95.011. In this arrangement the watercraft is able to sit as low as possible proximate to the top edge 95.062 along the length of the U shaped medial region 95.011. When inflated the bladder absorbs forces applied to the bracket from the watercraft.

Figure 96:
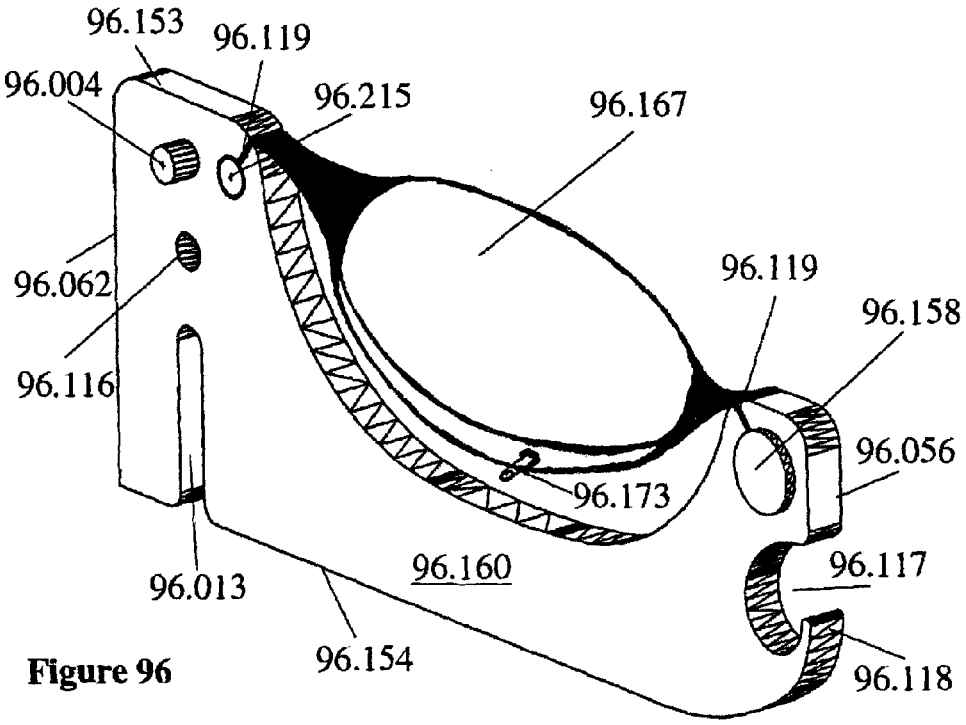
FIG. 96 illustrates a bracket for supporting a watercraft including an inflated bladder and an additional supporting aperture in the front edge.

FIG. 96 illustrates a bracket 96.006 as in FIGS. 92 and 93 where the bladder 96.167 is highly inflated.

The bladders described above can be inflated with air, water, any other appropriate shock absorbing gas or any other appropriate shock absorbing fluid.

FIGS. 97 to 101 illustrate a bracket 97.604 for supporting a watercraft that is angularly adjustable in a support member. The bracket 97.604 includes three support apertures, 97.193, 97.194 and 97.195 able to receive a support means like 97.691. Support aperture 97.691 engages a slot 98.005 in a support member 98.035 as in the above embodiments. The bracket 97.604 can be used without a pin being placed in apertures 97.193, 97.194 and 97.195. If one of the apertures 97.193, 97.194 and 97.195 receives a pin, the pin sets the angle at which the bracket 97.004 will sit, with each aperture 97.193, 97.194 and 97.195 providing a different angular position, or a range of angular displacement in relation to the back wall 98.064 of the support member 98.035. The end support 97.297 acts to restrain the watercraft when the bracket 97.004 is in an angled position.

FIGS. 97 to 101 illustrate the top edge 97.153 of the bracket 97.004 as being formed in the same shape as the hull 97.177 of the watercraft with which the bracket 97.004 can be used. For other hull shapes other profiles of bracket would be used.

Figure 98:
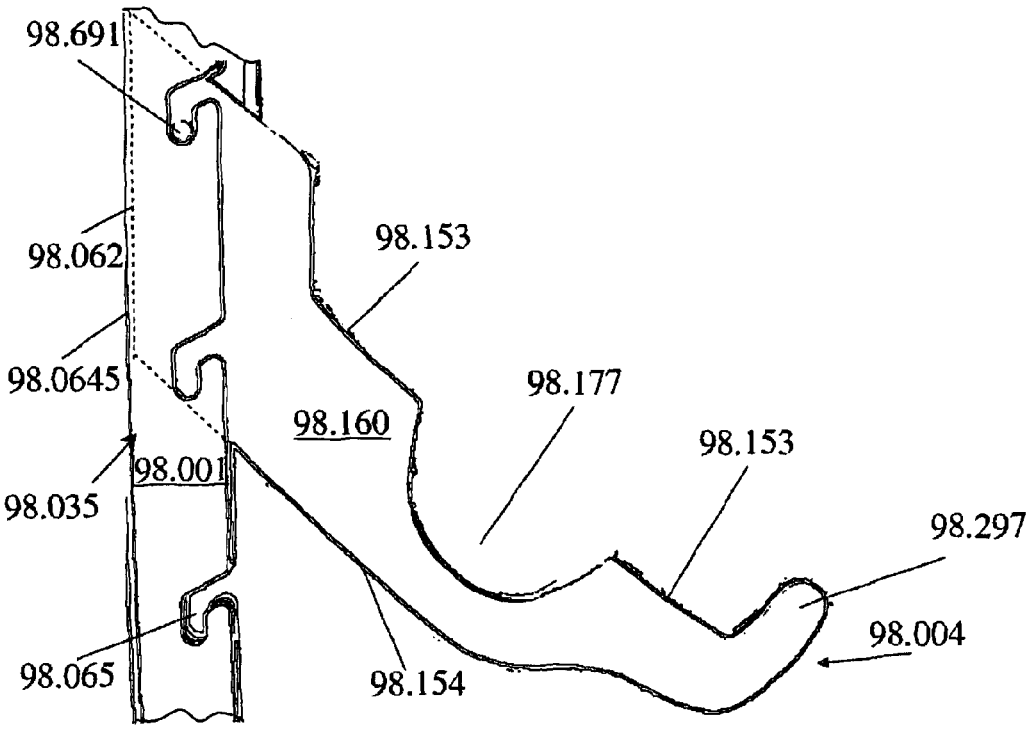
FIG. 98 illustrates an angled bracket support for supporting watercraft engaged with a supporting member with no angular displacement.

FIG. 98 illustrates when none of apertures 97.093, 97.094 or 97.195 are fitted with a support means 98.691. The load bearing wall 98.062 of the bracket experiences no angular displacement and acts as the load bearing point with support means 98.691. In this position less space is taken up in the direction perpendicular to the support member 98.035. The watercraft is held in place by the top edge 98.153 being shaped in the profile of the hull 98.177 of the watercraft and the end support 98.297.

Figure 97:
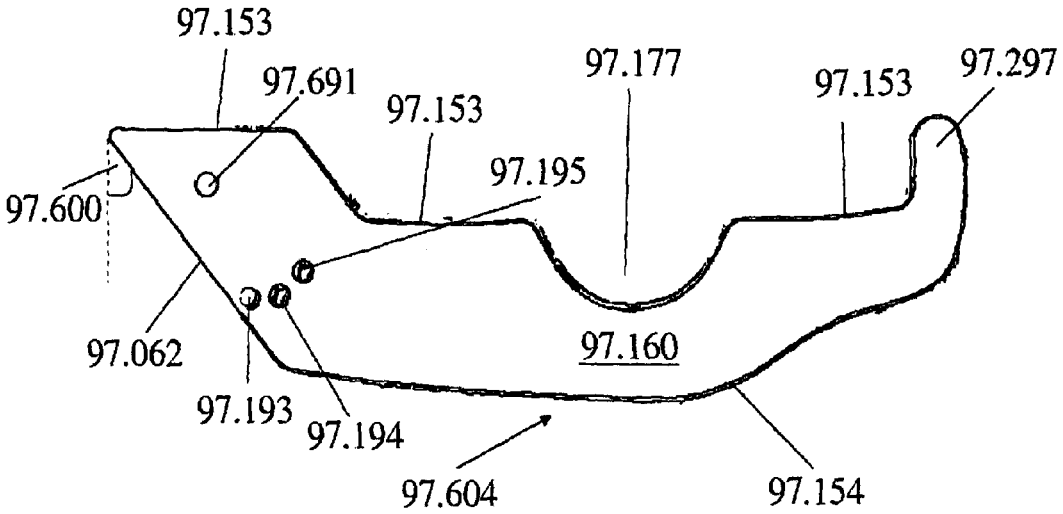
FIG. 97 illustrates a bracket support for supporting a watercraft including adjustable angular positioning and a top edge for contouring to the hull of the watercraft.
Figure 99:
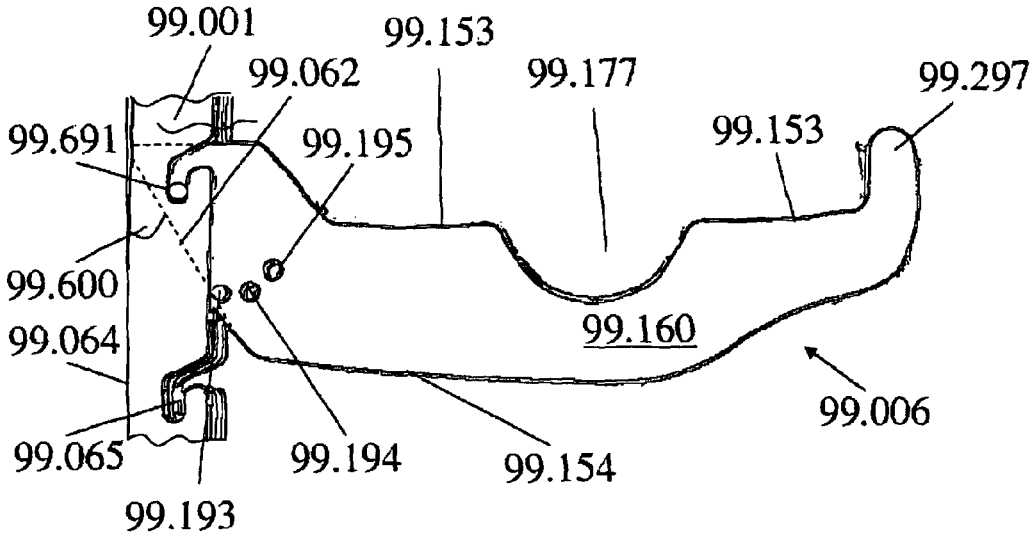
FIG. 99 illustrates an angularly adjustable bracket fixed in the position of greatest angular displacement.

FIG. 99 illustrates the bracket of FIGS. 97 and 98 where aperture 99.193 receives a support pin giving the bracket the maximum angular displacement 99.100 from the rear wall 99.064 of the support member 99.035.

Figure 100:
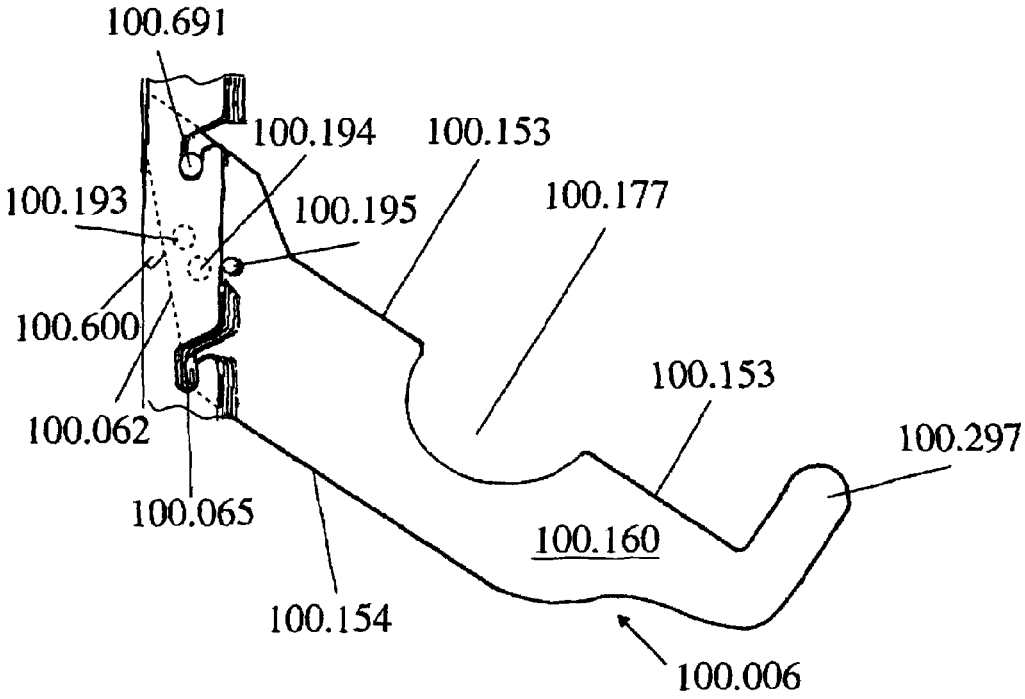
FIG. 100 illustrates an angularly adjustable bracket fixed in the position of minimal angular displacement using adjustment pegs, but further angular change, as depicted in FIG. 98 being possible.

FIG. 100 illustrates the bracket of FIGS. 97 to 99 where aperture 9100.195 receives a support pin giving the bracket minimum angular displacement 100.100 from the rear wall 100.064 of the support member 100.035.

Figure 101:
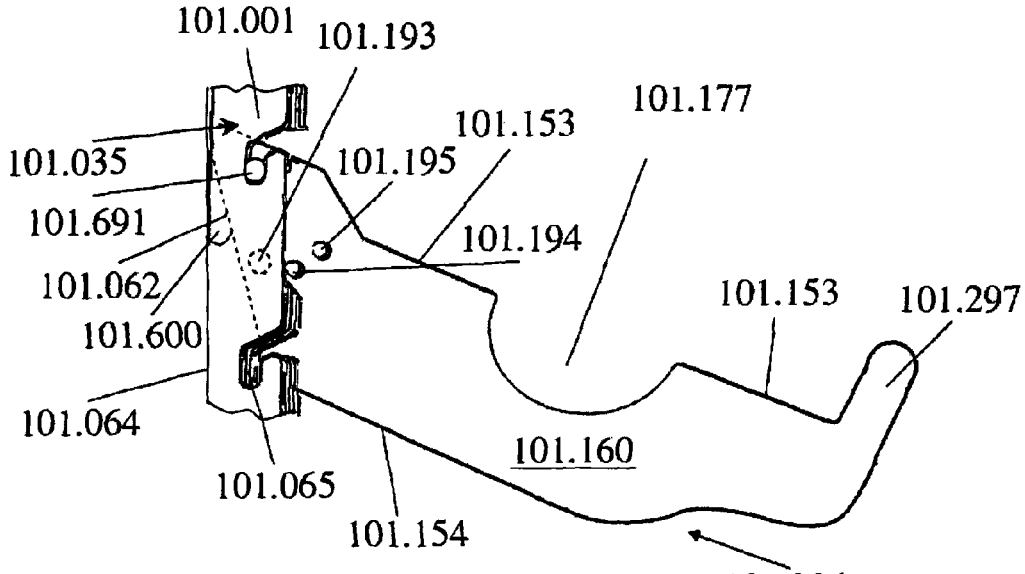
FIG. 101 illustrates an angularly adjustable bracket fixed in an intermediate position of angular displacement.

FIG. 101 illustrates the bracket of FIGS. 97 to 100 where aperture 101.194 receives a support pin giving the bracket an intermediate angular displacement 101.100 from the rear wall 101.064 of the support member 101.035.

The apertures 101.193, 101.194 and 101.195 are separated so as to give the different angular displacements discussed above. This separation in one embodiment can lie on the circumference of a circle.

Figure 102:
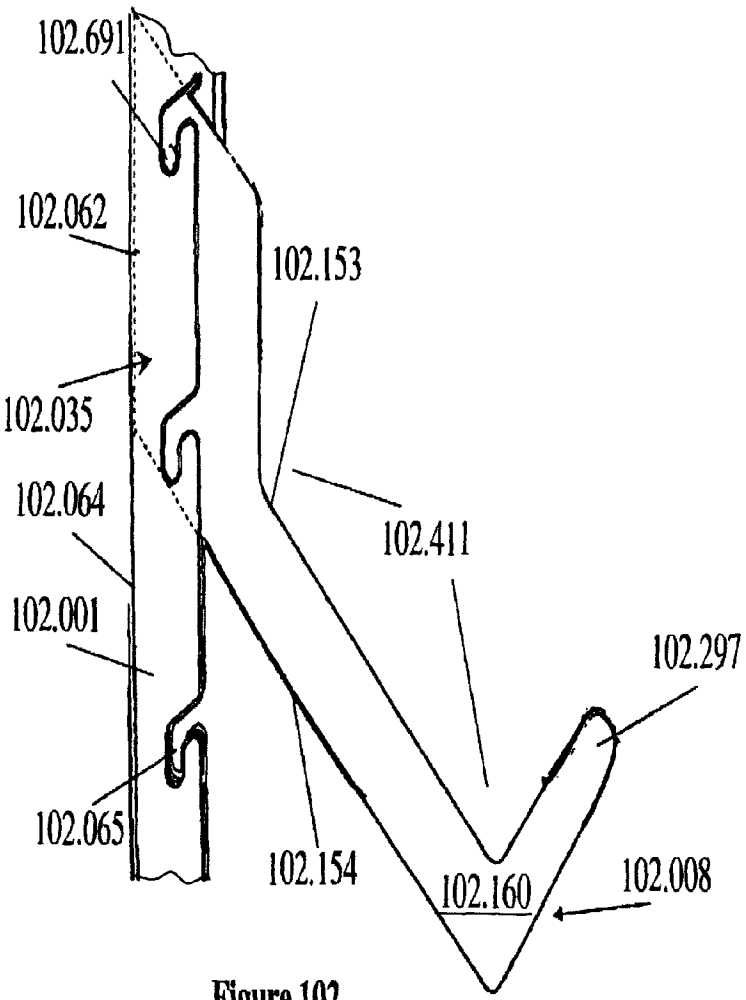
FIG. 102 illustrates a bracket support for supporting a watercraft without angular adjustment and a top edge with a U shaped or three sided recess medial region.

FIG. 102 illustrates an arrangement similar to FIGS. 96 to 101 with a bracket 102.008 that does not have a top edge 102.153 that contours to the hull of the watercraft. It has a somewhat U shaped medial region 102.011.

Figure 103:
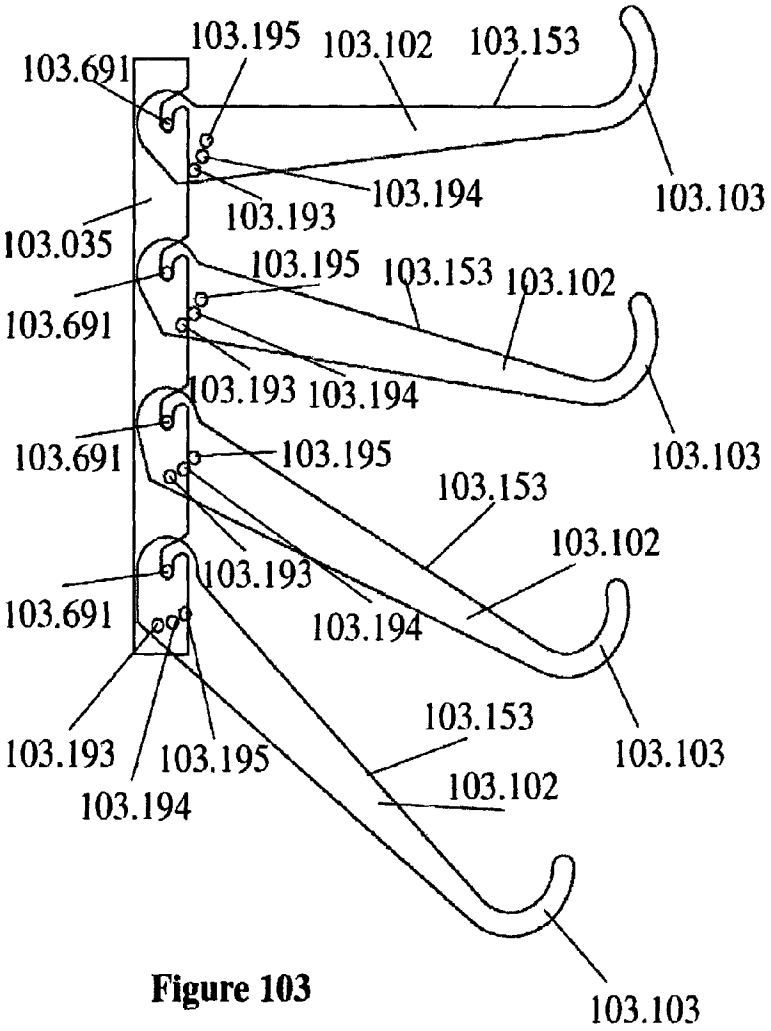
FIG. 103 illustrates a bracket support for supporting a watercraft in a variety of angular positions.

FIG. 103 illustrates the arrangement of FIGS. 96 to 102 where a bracket 103.102 has a flat top 103.153 and a hooked end section 103.103.

The brackets shown in FIGS. 76 to 103 are shown being used with the racking system of the previously described embodiments. However, it will be readily understood the bracket improvements in FIGS. 76 to 103 can be used with other bracket support systems, and are not restricted to the racking systems described above.

FIGS. 104 to 109 illustrate a support panel 104.700 that can be used as a wall or ceiling panel or floor panel. The panel 104.700 can be a substrate under a wall or ceiling panel or it can be a stand alone panel as will be described below.

The rear face 104.706 of the support panel 104.700 can lie against a wall or a ceiling or floor or it can be freestanding between a ceiling and a floor to form a vertically arranged panel or between two walls or two supports to form a hanging panel, or can be mounted to a base so as to form a a free standing panel.

The support panel 104.700 includes an array of apertures 104.704 which pass entirely through the thickness 104.710 of the panel 104.700 between the rear face 104.706 and the front face 104.708. The rear face 104.706 of the support panel 104.700 also has rear channels such as rebates or rebated grooves 104.702. The purpose of these rebated grooves will be discussed below.

The front face 104.708 might also include a groove or recess 104.718 (short and horizontal) and 104.720 (short and vertical) and recesses 104.713 (full panel length or width vertical or horizontal) and 104.716 (rectangular). In these grooves or recesses on the front face, the apertures 104.704 also pass through the reduced thickness 104.717 of the support panel 104.700 to the rear channel 104.702. Alternatively, the front channels or recesses can be formed by parallel ribs 104.799, in which case the thickness of the panel need not be reduced, however this is not as aesthetically pleasing or as easy to manufacture as channels or recesses formed by removing material.

Where the rear face 104.706 includes a rear channel 104.702, a bracket such as described below in FIGS. 110 to 131 can be positioned through the apertures 104.704 so that a hooked portion sits inside the channel or recess 104.702 as is described further below. Brackets or other support members and support structures when mounted in the apertures 104.704 in front face recesses 104.717, and of a width similar to the width of the recess 104.717, will be restricted in lateral movement by the channel side walls 104.712. Whereas the front face recesses 104.716, 104.718 and 104.720 are illustrative only and the shape of the recesses can be made to suit any attachment fitted to support panel 104.700. The function of the recesses 104.716, 104.718 and 104.720 is that they able to receive within them the periphery of a panel or an article or cabinet which is to be mounted by a bracket (as explained below) to the panel 104.700.

As an indication of the dimensions of the features on the panel 104.700 the apertures 104.704 have a height of 50 mm and a width of 25.5 mm, which has been selected so as to allow the portions 74.232 or 119.720 to readily pass through the aperture 104.704 while the portions 74.232 or 119.720 are generally parallel to the front surface of the panel 104.700. The rear channels or rebates 104.702 have a width of 26 mm while the walls of the channel or rebate are approx 4 mm in depth. The panel 104.700 is of the order of 2400 mm×1200 mm and of the order of 25 mm thick before the rear recess, channel or rebate is formed.

Figure 105:
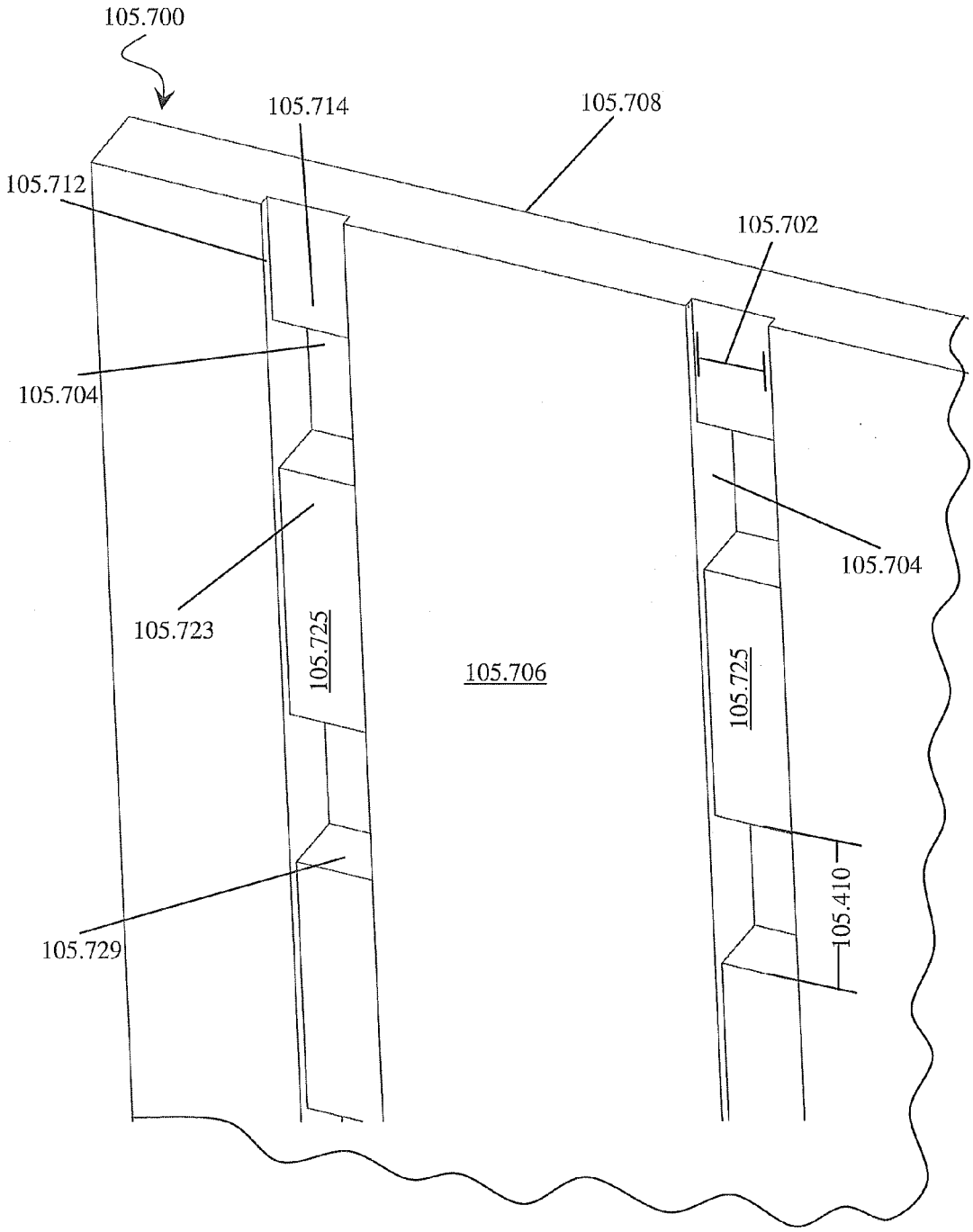
FIG. 105 illustrates a partial perspective view of the rear face of the support panel of FIG. 104.
Figure 106:
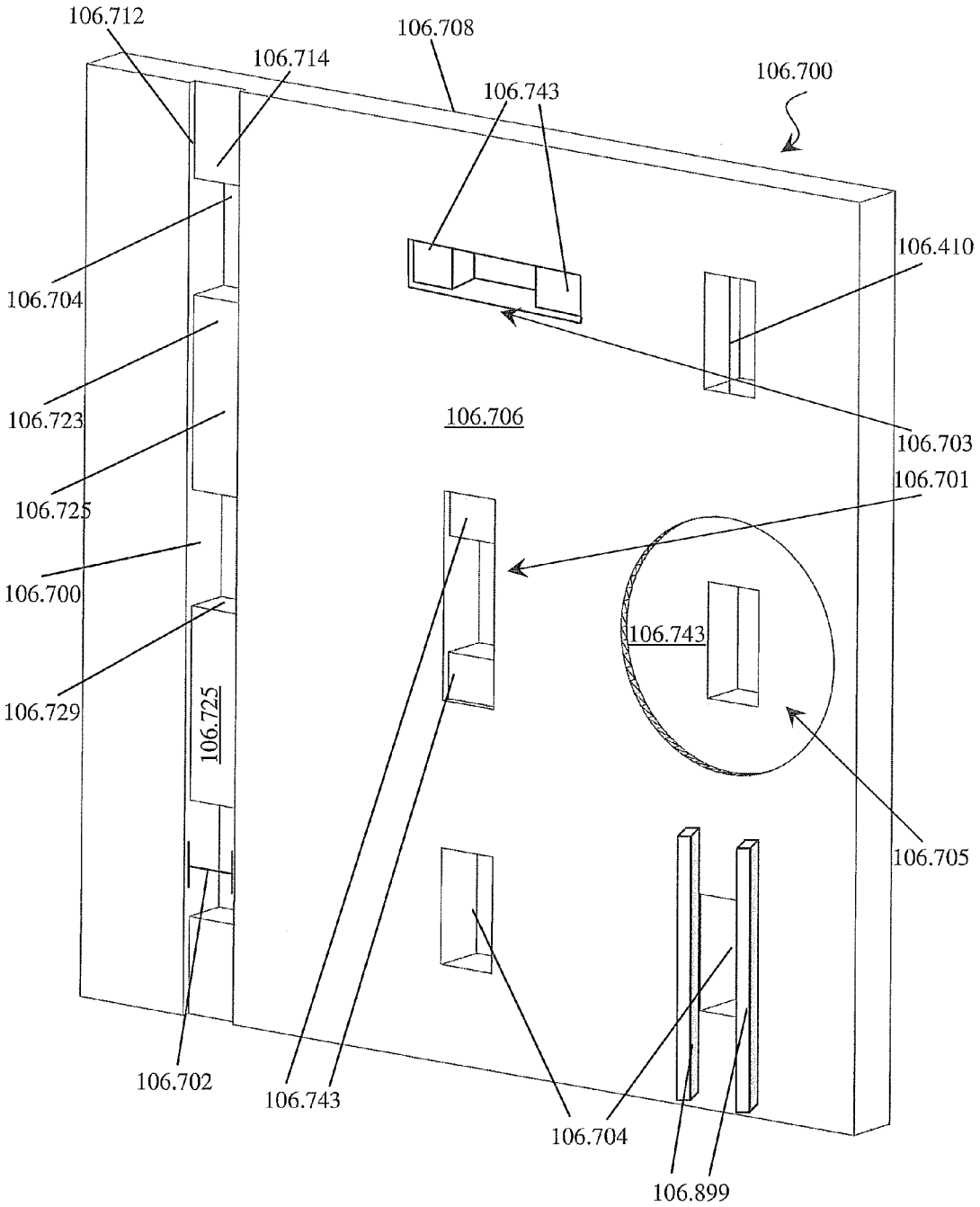
FIGS. 106, 107 and 108 illustrate a perspective view respectively: a rear face of a support panel showing a variety of rear face recesses for illustrative purposes, one with front face recesses, and one with rear channels and radiused aperture walls.

As illustrated in FIG. 105, the rear channels or rebate 105.702 can run the entire length of the support panel 105.700. The rear channel or rebate 105.702 has a base surface 105.225 which extends between apertures 105.704 and thereby provides a recess which intersects with the wall of the aperture at two opposed sides of the aperture. Further, when the support panel 105.700 is used as a wall the rear channel base surface 105.225 includes a region above and adjacent 105.714 the aperture and a region below and adjacent 105.723 the aperture 105.704. The reduced thickness through wall 105.729 abuts a support member's hanging arm as described below. The rear channels or rebate 105.702 can be limited to a region surrounding the apertures 105.704 as shown in FIGS. 106 at 106.701, 106.703 and 106.705. If the panel is made with a predetermined directionality the recesses can be located on one side only of the apertures. The profile of the rear face 104.706 recesses will depend on the type and orientation of the support member used.

The recesses 104.718 and 104.720 are offset or spaced from the apertures 104.704. A top or side member of an article, such as a cabinet, or shelf or other article of furniture or building element, can be inserted into the recess 104.718 or 104.720 which restricts lateral movement of the article. The top or side member of the article extends further than the other members of the support structure in the direction of the support panel 104.700.

FIG. 106 illustrates the rear face 106.706 of the support panel 106.700 with a variety of different rear recess profiles 106.702, 106.703, 106.701, 106.705 and 106.899 adjacent the respective apertures 106.704. It will be understood that during manufacture only one of these recess types would be selected, but if desired more than one could be used.

Rear channel 106.702 and recess 106.701 are used when the support member has a locking member in the direction of the channel 106.702 or recess 106.701. Recess 106.703 can be used when the foot print of the support member to be used is at right angles to rear channel 106.702 and recess 106.701. Recess 106.705 allows use of a support member that has a lock member that can be in any direction or more than one direction. The channel contains a rear channel base surface 106.725 and the rear recesses have rear recess base surfaces 106.743. If desired the rear channels or recesses can be formed by parallel ribs 106.899, in which case the thickness of the panel need not be reduced, however this is not as aesthetically pleasing or as easy to manufacture as channels or recesses formed by removing material.

Figure 107:
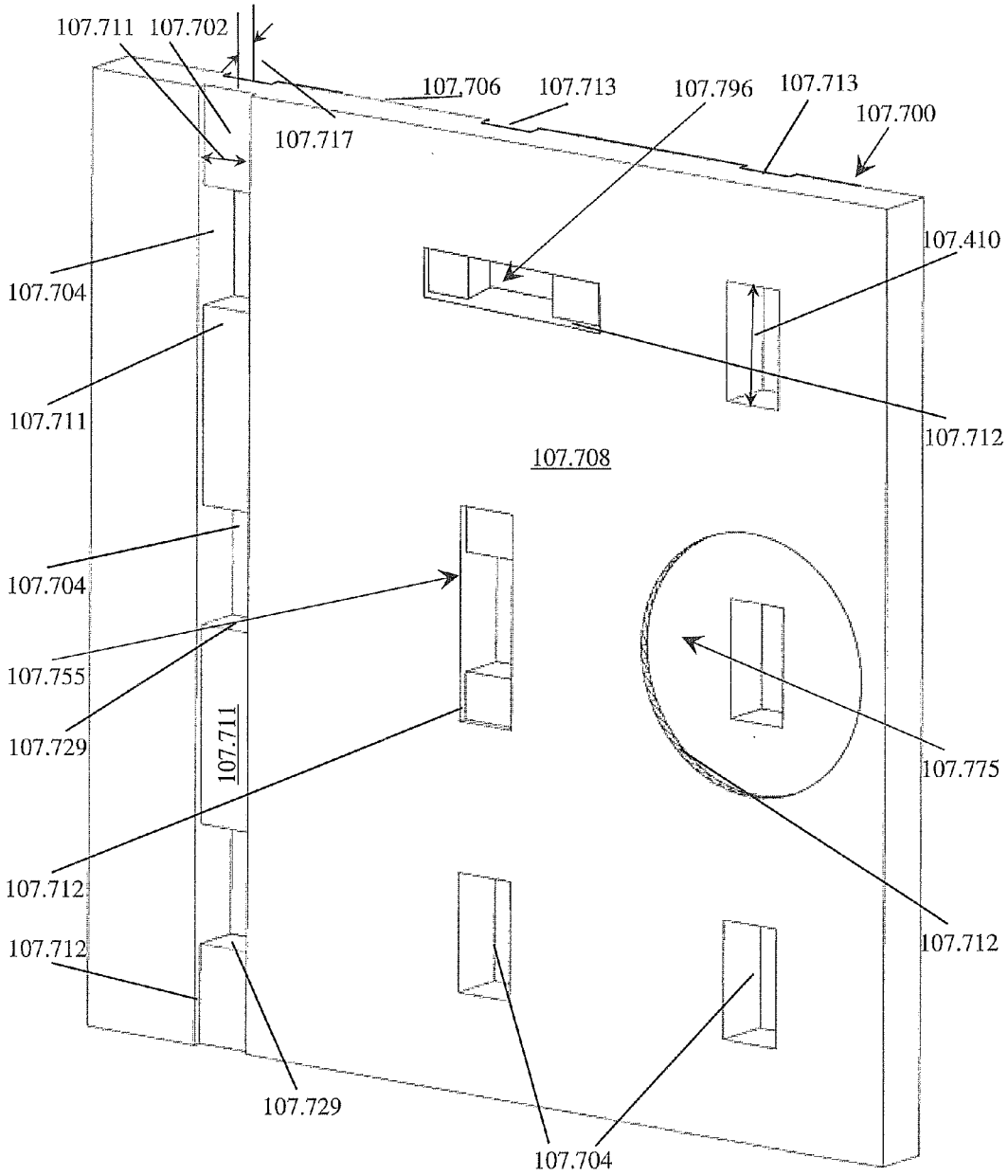

FIG. 107 illustrates a support panel 107.700 with both front channels 107.713 and rear recesses 107.796, 107.702, 107.755 and 107.775. The front recesses 107.713 are channel shaped with a base and two side, to receive shaped hanging units and will be such that they are restricted from lateral movement, or held more rigidly to the panel, by the regions 107.712. The thickness 107.717 of the support panel 107.700 is reduced between the front base surface 107.711 and the rear channel base surface 106.725, which will require a decrease in the length of arm of a bracket such as arm 119.722. While the panel 107.700 shows a rear face and the front face on the other side, it will be readily understood that the panel 107.700 could be used in reverse, that is the rear side used as the front side and the front side as the rear side. It will also be understood that in FIGS. 106 and 107 the variety of shapes an orientations of apertures are provided for illustrative purposes only, and generally one would be provided with one type and or orientation, or more if desired depending upon a customers requirements.

Figure 108:
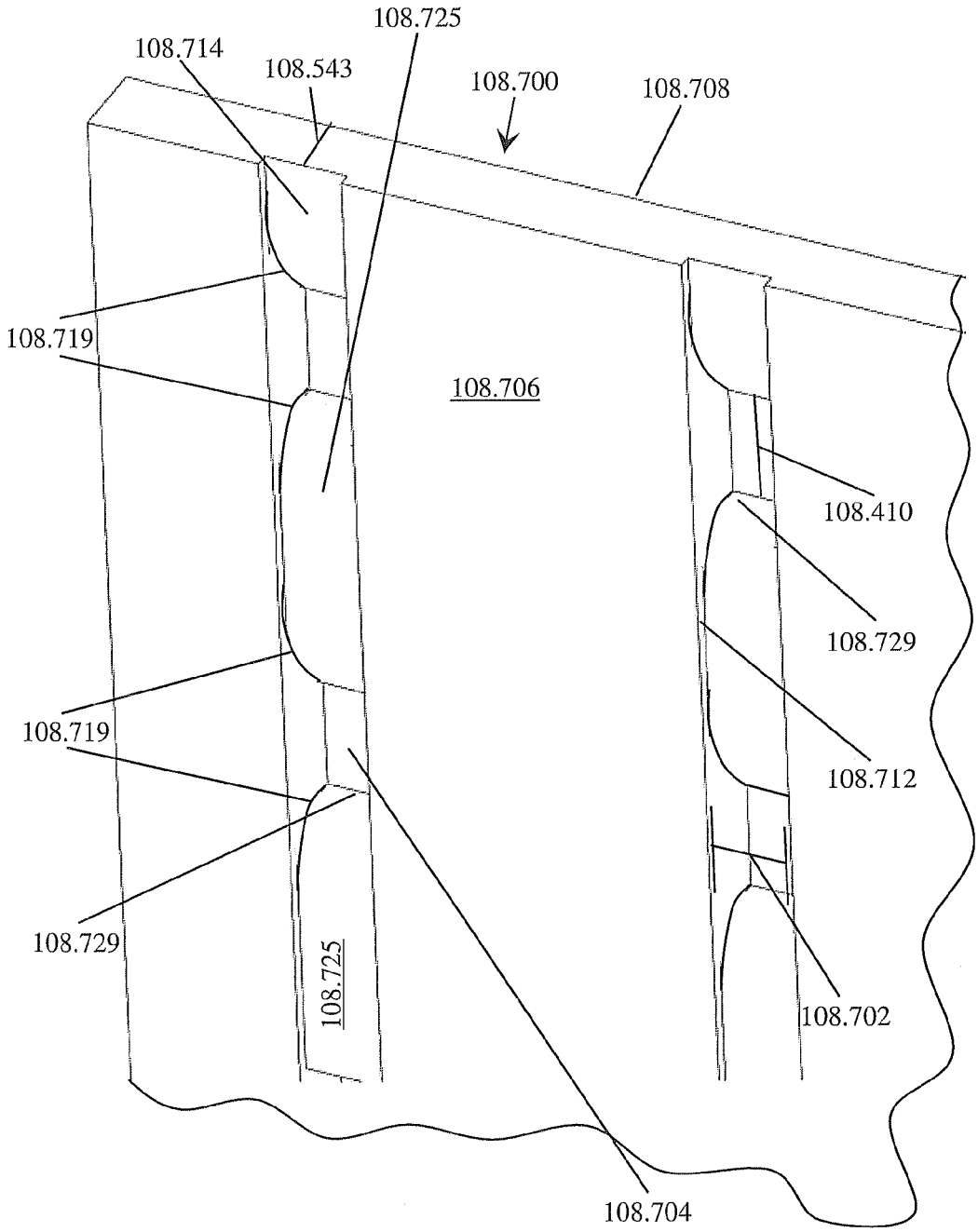

FIG. 108 illustrates a support panel 108.700 where the aperture 108.704 in the rear channel 108.702 includes a radiused edge 108.719 along its walls with reduced thickness 108.543. The rear of the panel illustrated in FIG. 108 is best used with a support member such as that illustrated in FIG. 114, where there are hook elements which require a degree of rotation. The radiused edge 108.719 curves from the reduced thickness wall 107.729 into the rear base surface 107.725. The radiused edges are located at opposed areas which lead into the aperture 108.704. When the support panel is placed against a wall the radiused edge allows an inserted support member to rotate, the arc of rotation moving towards the wall and still being able to be inserted into the channel 108.702.

Figure 109:
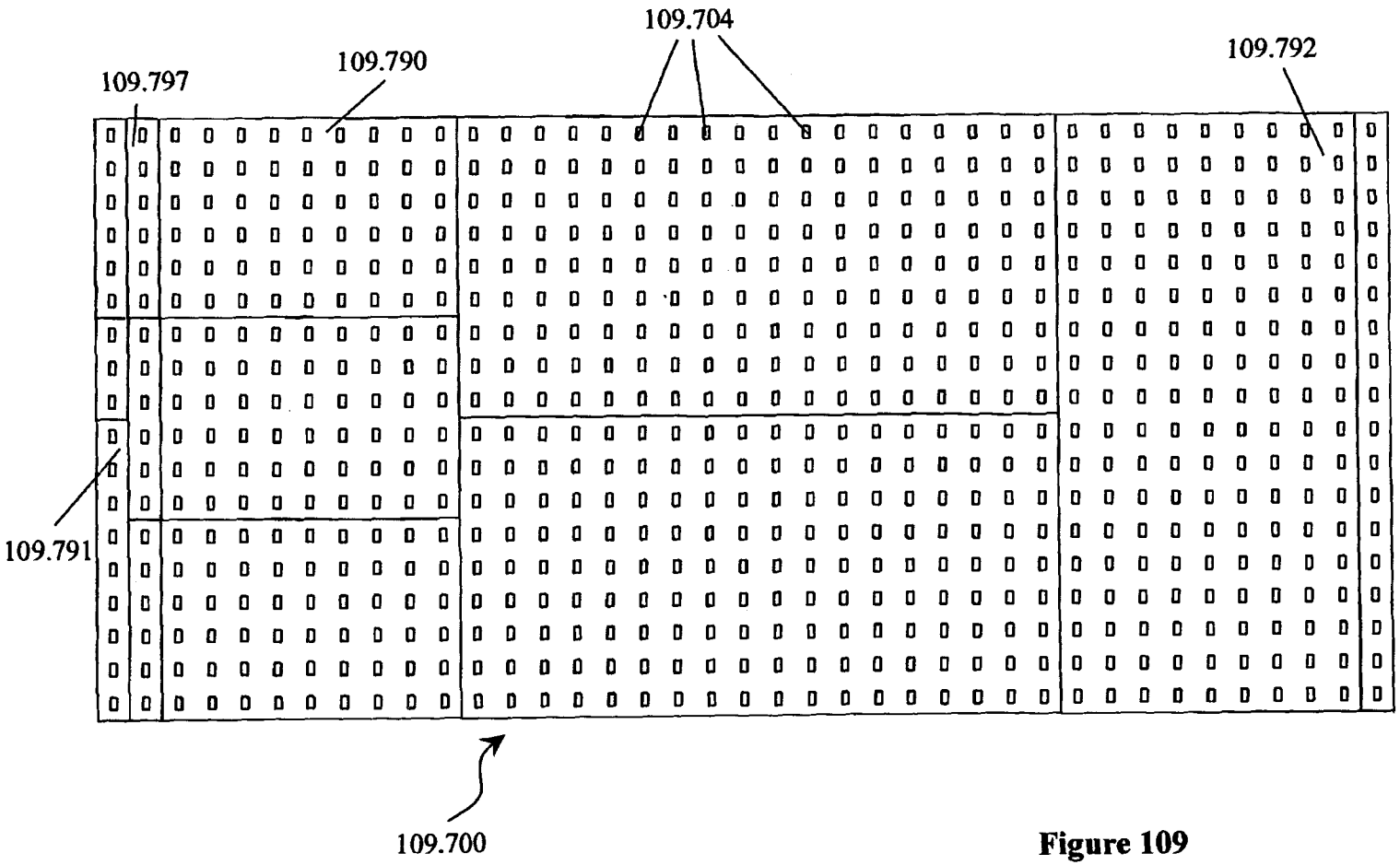
FIG. 109 illustrates front view of an assembly of apertured support panels located adjacent to each other where all apertures are in the same alignment.

FIG. 109 illustrates how a variety of different sized panels 109.790, 109.791, 109.793, 109.794, 109.785, 109.783 and 109.797 can be assembled and secured near to each other so as to form an array of apertures. The arrangements of apertures 109.704 shown in these Figures are only illustrative and a variety of different arrangements can be used to suit the desired location of a supported unit as would be readily understood by a skilled addressee. It will be noted that the horizontal spacing between the vertical edges of the panels and the apertures on respective panels are such that the resultant spacing between adjacent columns of apertures on adjacent panels is at the same spacing as adjacent columns on the same panel. Similarly with spacing between the horizontal edges of the panels and the apertures on respective panels are such that the resultant vertical spacing between adjacent rows of apertures on adjacent panels is at the same spacing as adjacent rows on the same panel.

The support panels can be made from any suitable material to carry the load and weight of articles which will be transmitted to the panel. For example if polymer panel, such as an expanded PVC sheet marketed under the name of NEMA is used, as this can be purchased in a variety of densities and grades, with different thicknesses and strengths, an appropriate grade, density and strength of sheet is selected depending upon whether the panel is to carry furniture such as cabinets or shelving, or whether it is to support a building elements such as stair treads or beams.

Figure 110:
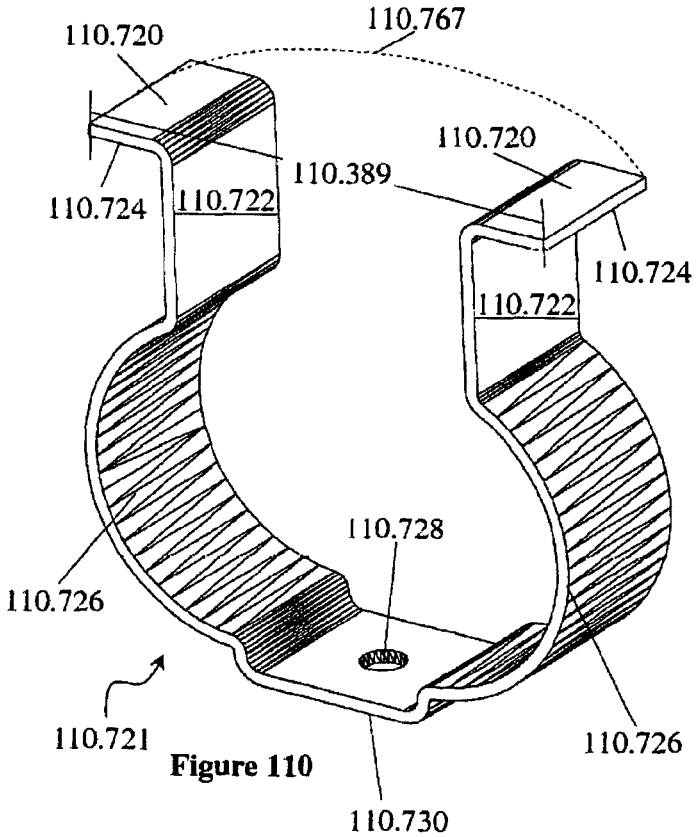
FIGS. 110, 111, 112, 113, 114, 115, 116, 116A, 117, 118 and 125 illustrate respectively: a bracket with outwardly curved hanging arm sections; the bracket of FIG. 110 with a bolt; the bracket of FIG. 111 with hanging bar and ring attachment; the bracket of FIG. 110 with a hanging bar and ring attachment; an X-shaped or pivoting bracket; a sliding double capped box section support member; a beam support member; another arrangement for a beam support member; the bracket used in of FIG. 116; the bracket used in FIG. 116A; a perspective view of an apertured panel secured to a ceiling location with brackets such as those of FIGS. 110 to 118 attached.

FIG. 110 illustrates a spring support member or bracket 110.721 for use with a support panel 104.700. The bracket 110.721 includes a base 110.730 having an aperture 110.728 that can optionally be threaded, radiused regions 110.726 that extend from the base 110.730, hanging arms 110.722 extending from the radiused regions distal to the base 110.730 and locking members 110.720 extending perpendicularly from the distal end of said hanging arms 110.722.

When engaging a support panel such as 104.700 the locking members 110.720 are brought closer together, against the bias provided by the radiused regions 110.726, thereby reducing the distance 110.389 between the outer extremities of hanging arms 110.722. When the distance 10.389 is less that the length of the aperture 104.410 the locking members 110.720 are inserted through the aperture 104.700. Once inserted through the aperture 104.704, the radiused regions 110.726 are released leaving the locking members 110.720 to rotate into engagement with the base of the rear channel 106.711 or base of the rear recess 106.725, so that the locking members 110.720 are positioned in the channel or recess and the arms 110.722 rest against or near to the opposed ends of the aperture 104.704, whereby the distance between the arms 110.722 is the same as the aperture length 104.410.

Figure 111:
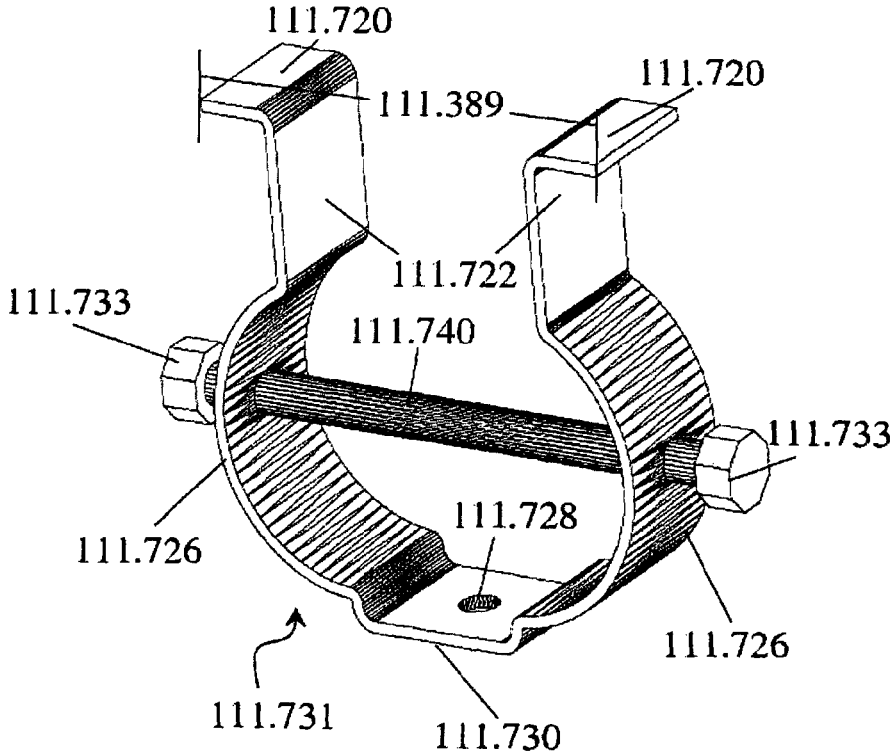

FIG. 111 illustrates a bracket similar to FIG. 110, with a spring support member 111.731 as illustrated in FIG. 110 however it differs in that a bolt 111.740 is fitted between the radiused regions 111.726. The bolt can be tightened and loosened with a nut 111.733 to alter the distance 111.747 between the hanging arms.

Figure 112:
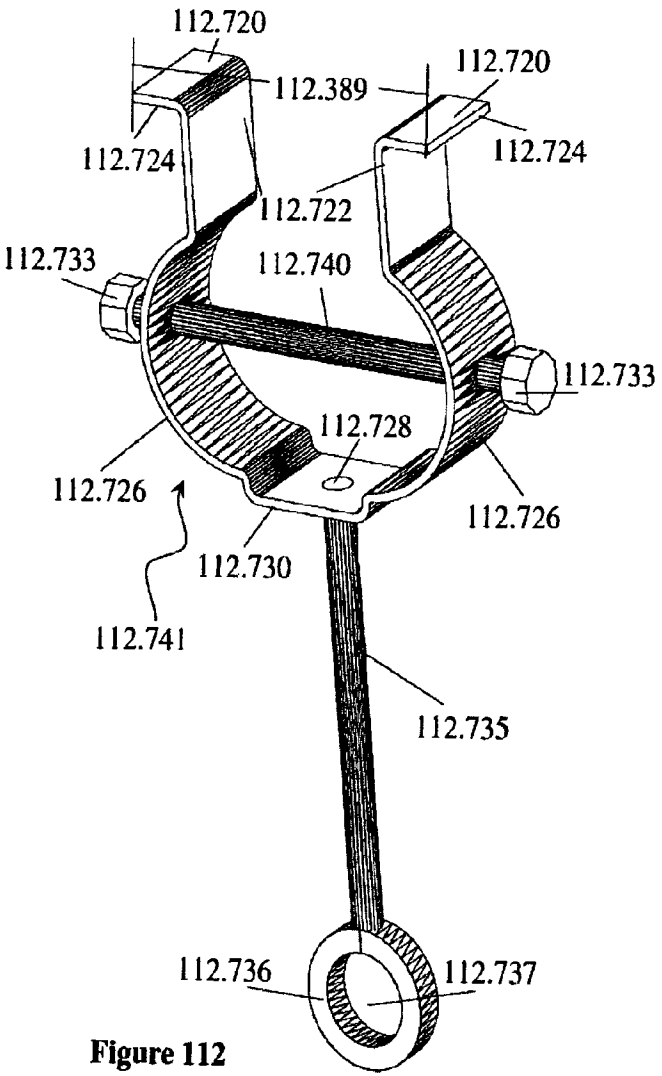

FIG. 112 illustrates the bracket of FIG. 111 with a bar 112.735 attached to the base 112.730 of the bracket 112.741. The bar 112.735 is fixed to the aperture 112.728 in the base 112.730 and can be screwed, clipped, pinned, riveted, or integrally formed with the aperture 112.728. The distal end of the bar 112.735 has a ring 112.936 with a ring aperture 112.737 to which other things can be attached.

Figure 113:
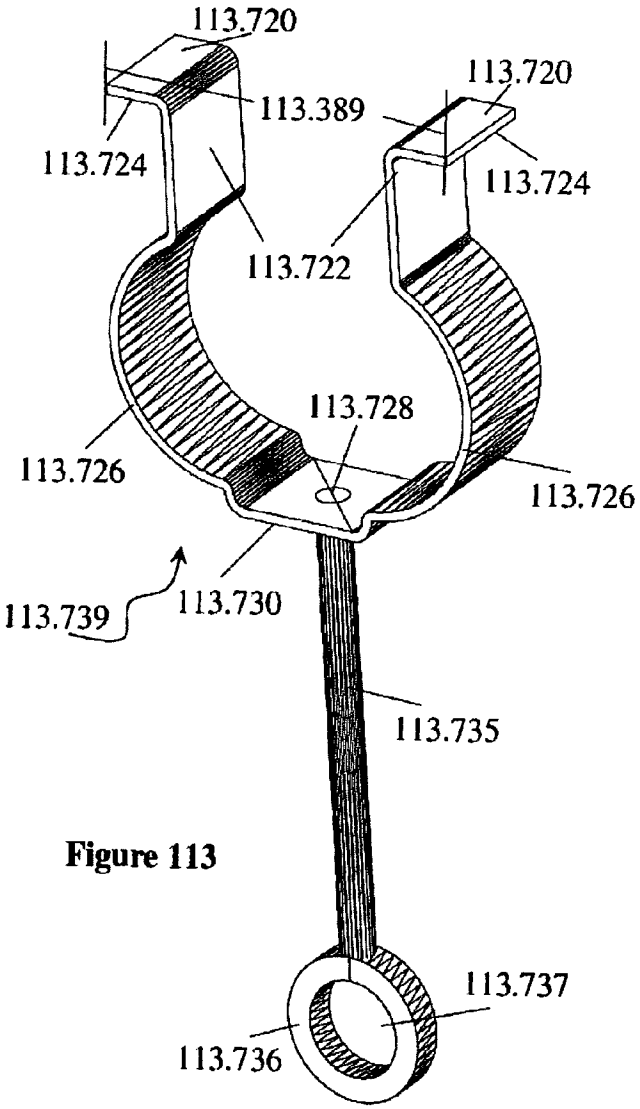

FIG. 113 illustrates a spring support member 113.739 similar to that of FIG. 110, which includes a bar or shaft 113.735.

Figure 114:
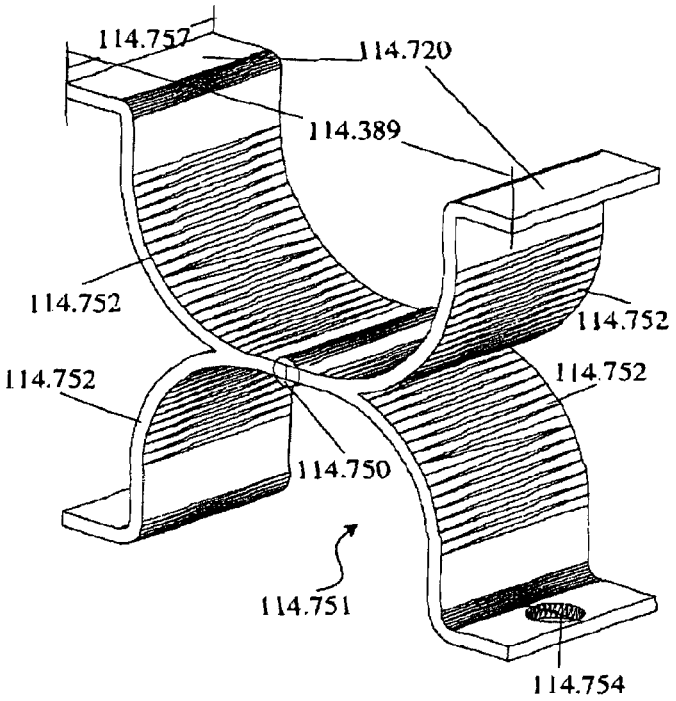

FIG. 114 illustrates an opposed U or X shaped bracket 114.751 with the profile of an inverted bowler hat on top of a bowler hat profile. The bowler hat profiles are attached along the crown of each bowler hat. The band regions 114.752 of each bowler hat terminates in the brim 114.720 regions. The brim region 114.720 of the inverted bowler hat profile operates in the same way as the locking member 110.720 as described above. Illustrated is a hinge 114.750 in the middle of the crown section that allows the distance 114.749 to be altered so that when reduced the brim or locking member 114.720 can pass through the aperture and abut the rear channel base surface 106.725 or rear recess base surface 106.743 in the same manner as discussed above in FIGS. 110 to 113. The support member 114.751 as being split at the hinge 114.750 so as to provide a hinge action whereby forces which draw the lower ends together will force the upper ends apart. Thus as load on the bracket produces this effect, the greater the load the greater will be the brackets engagement force with the panel.

Figure 115:
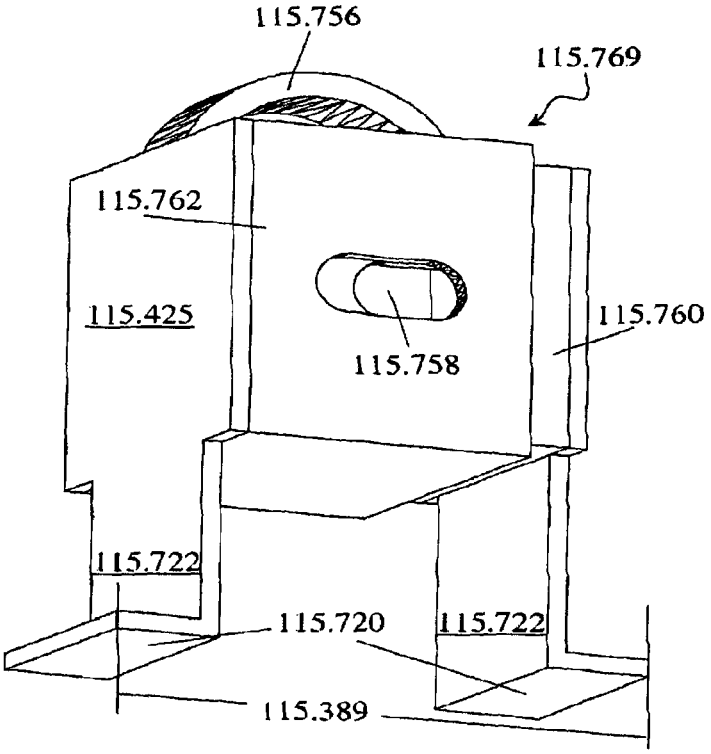

FIG. 115 illustrates an box shaped support member or bracket 115.769 made up of two box sections 115.762 and 115.760 capped on one end 115.425 and which telescope with respect to each other. Attached to one of the sections 115.762 or 115760 is a hook member 115.756 which can be used to suspend articles to be stored. The hanging arms 115.722 and locking members 115.720 operate in the same manner in respect to the support panel 104.700 as for the previously mentioned support members.

The smaller open box member 115.760 can slide within the larger open box section 115.762 to alter the distance 115.747 between the hanging arms. The slot 115.758 passes through two opposite faces of both open box sections 115.762 and 115.760 and are alignable. When the slots align the distance between the hanging arms 115.747 leaves the hanging arms abutting the walls of the aperture in the support panel with the distance equal to the length of the aperture 104.410 and the locking member abutting the rear channel base surface 16.725 or rear recess base surface 16.743. When in this position a pin, clip, bolt or other lock can be placed through the slots, preventing the distance 115.747 from altering. The hanging arms are illustrated as extending from the capped end 115.425 of the box section, but can be fixed at any point along the base of the box section with the slots 115.758 being placed at a appropriate position to allow the hanging arms 115.747 to be the correct distance apart. If desired, within the box sections 115.762 and 115.760 there can be located a compression spring so that the arms 115.722 are forced apart, and that an operator must compress the box sections against this bias.

Figure 116:
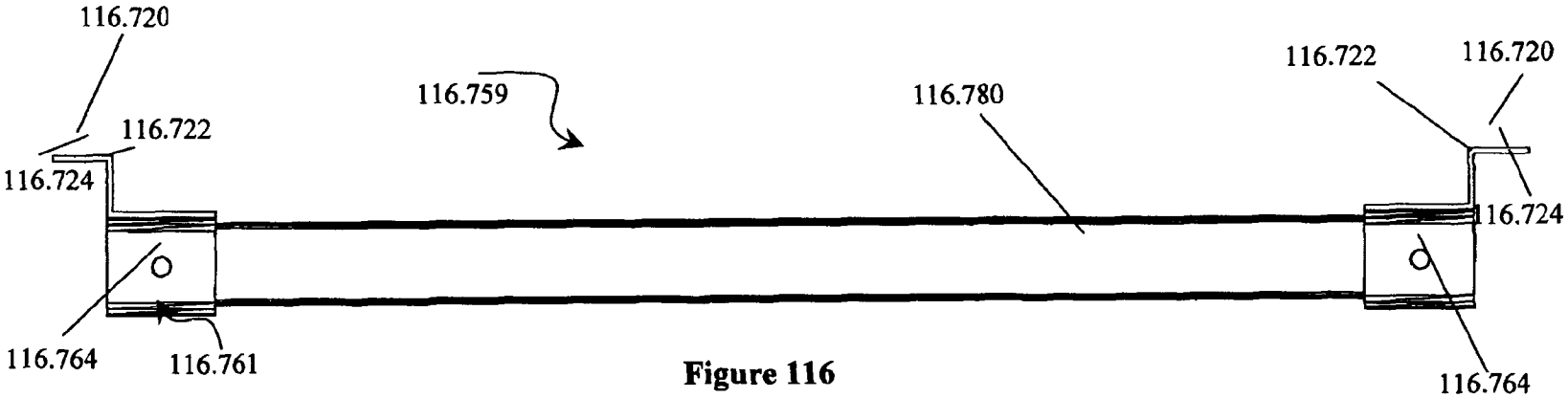
Figure 116A:
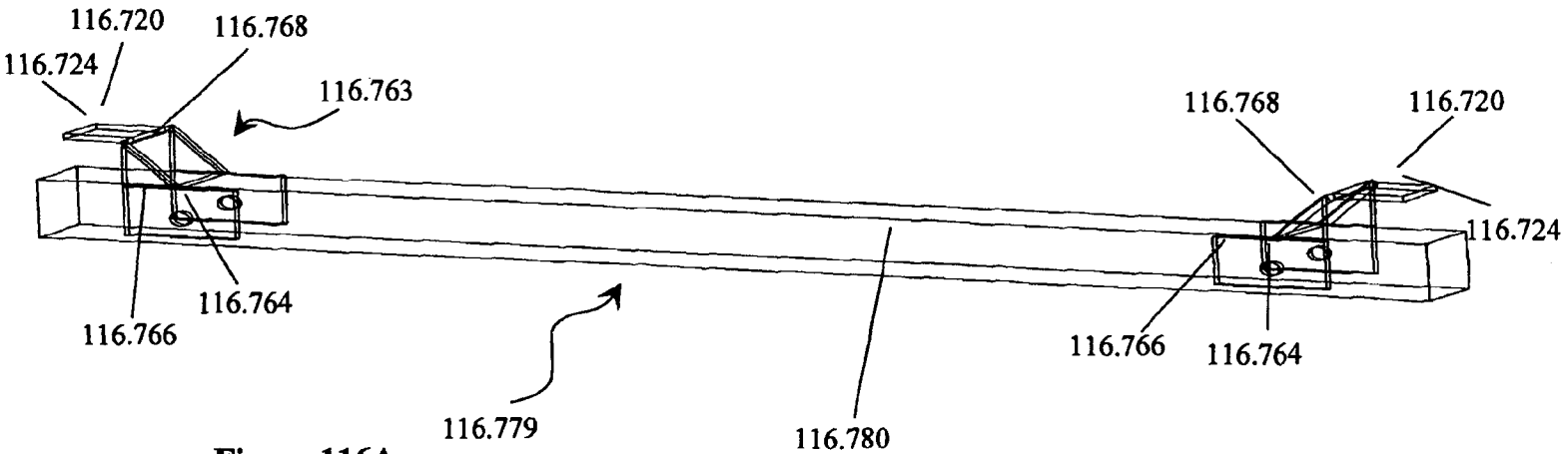
Figure 117:
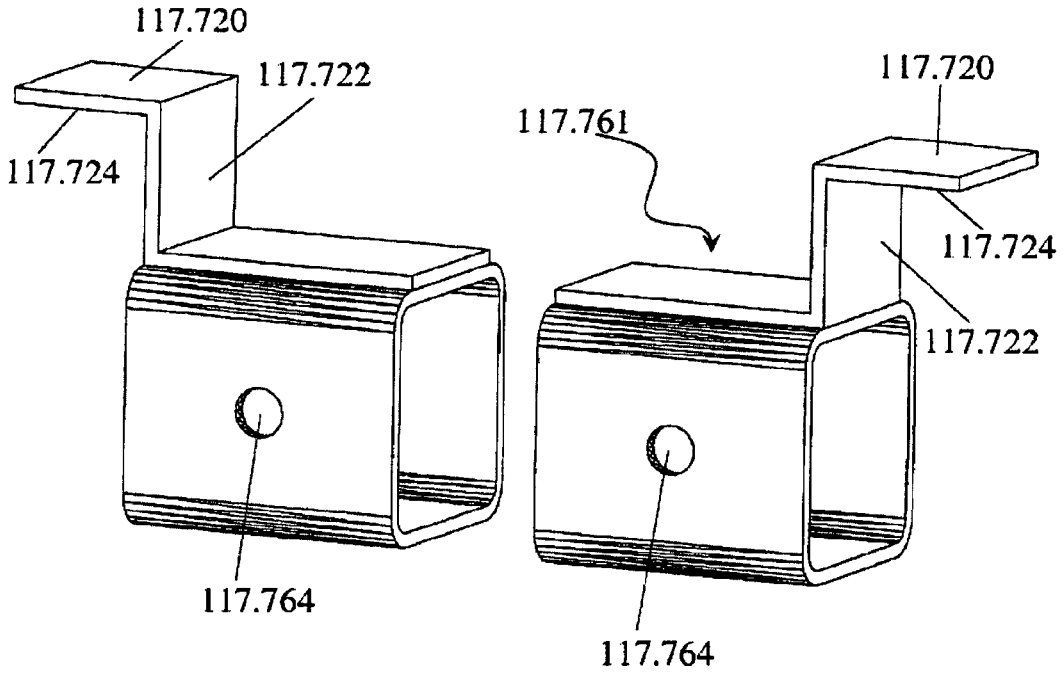
Figure 118:
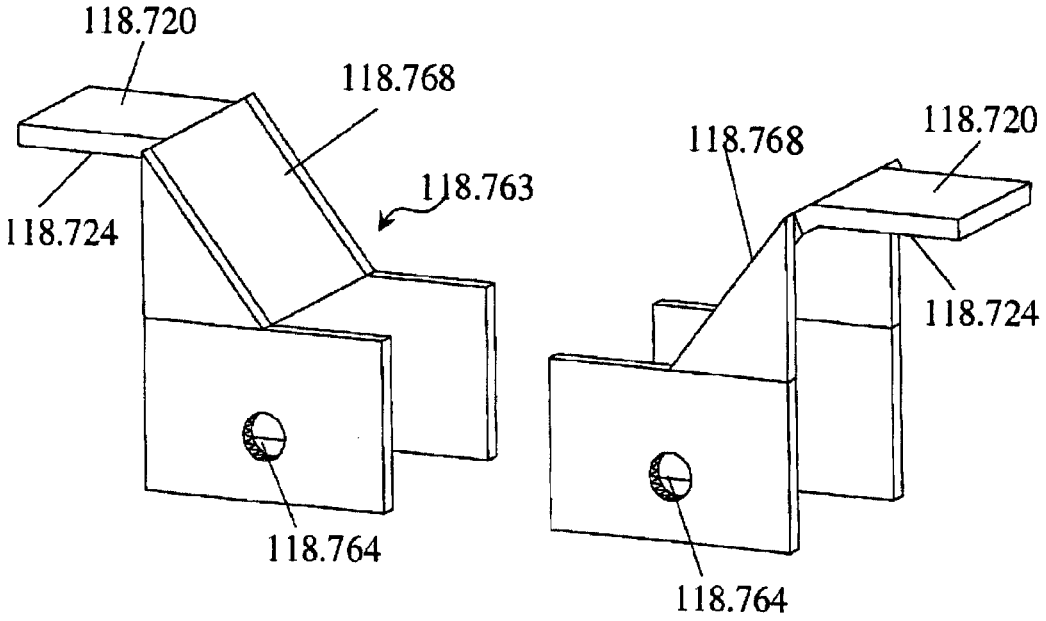

FIGS. 116 and 116A illustrate two beam support members 116.759 and 116.779. In FIG. 116A and 117 is illustrated a beam support member 116.759 where the beam 116.780 is inserted into two tube sections 116.761 at either end of the beam 116.780. The tube sections include a hanging arm 116.722 that can be inserted through an aperture in a support panel 106.704, and a locking member 116.720 to abut the rear channel base surface 106.725 or the rear recess base surface 106.743. The two tube sections 116.720 can be slide along the length of the beam until the desired position is located and then inserted and fixed in the apertures 106.704. the tube sections 116.761 can be open tubes in which cased the beam 116.780 can be any appropriate length, or they can be closed at their outside ends, in which case the length of the beam 116.780 will need to be set for the spacing of the tube sections 116.761. To lock the tube sections 116.761 in position along the length of the beam, locking aperture 116.764 can be used to insert a screw or bolt, screwing onto the beam locking the tube section 116.761 in place. The beam 116.780 can optionally have apertures along the length of it through which a screw or bolt can pass or a screw or bolt can friction lock against the face of the beam 116.780. FIGS. 116A and 118 illustrate an member 116.779 similar to the member 116.759 of FIG. 116, where a two plate section 116.763 is used instead of a tube section 116.761. The two plate section 116.763 uses a plate 116.766 on two opposite sides of the beam 116.780 connected by a angled hanging plate 116.768. The beam 116.780 can slide and be secured between the two plate sections 116.763 in the same way as in 116.759.

Figure 104:
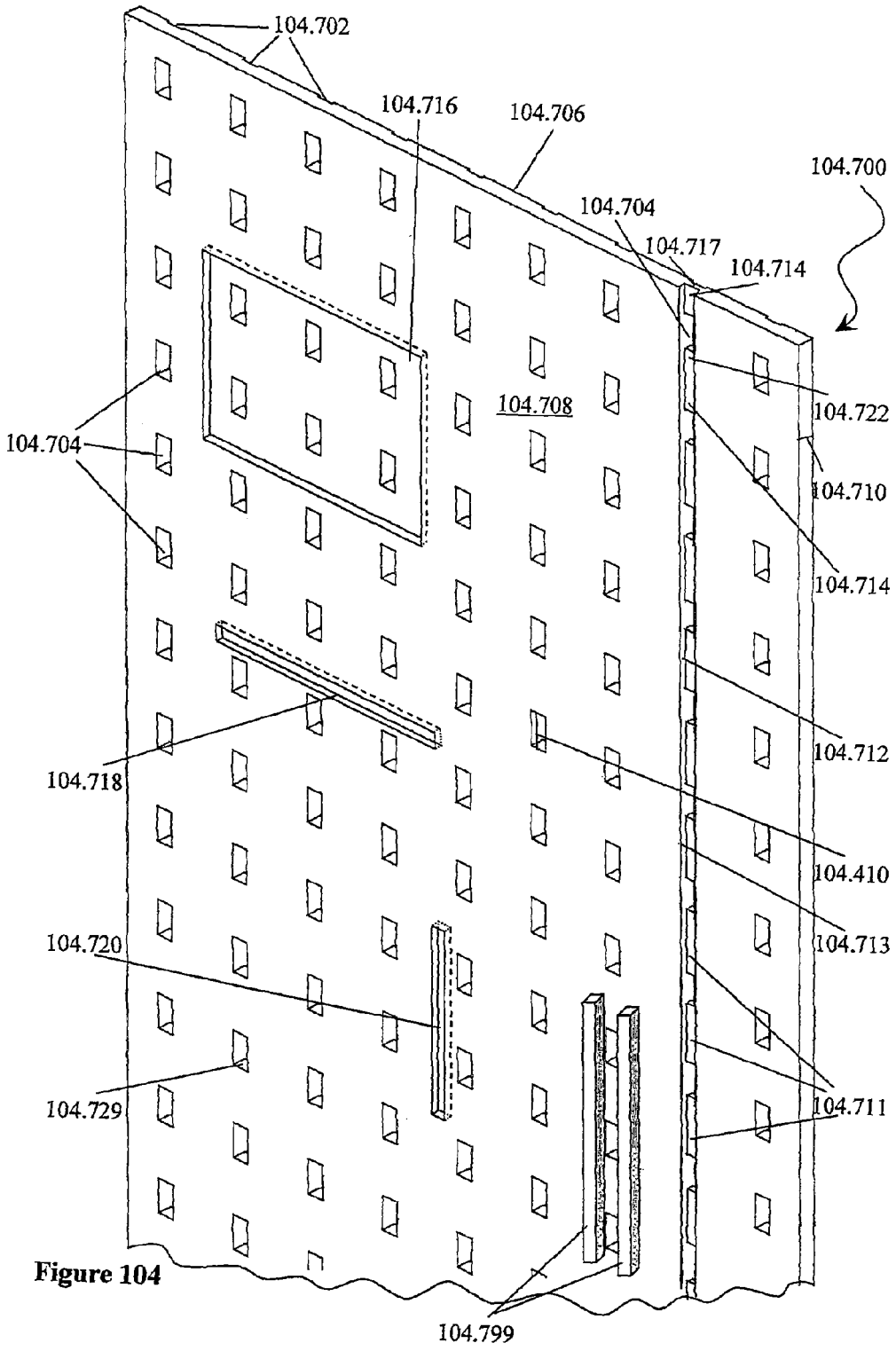
FIG. 104 illustrates a perspective view of an apertured support panel with rear channels and front recesses, and a variety of blind recesses for illustrative purposes only.
Figure 125:
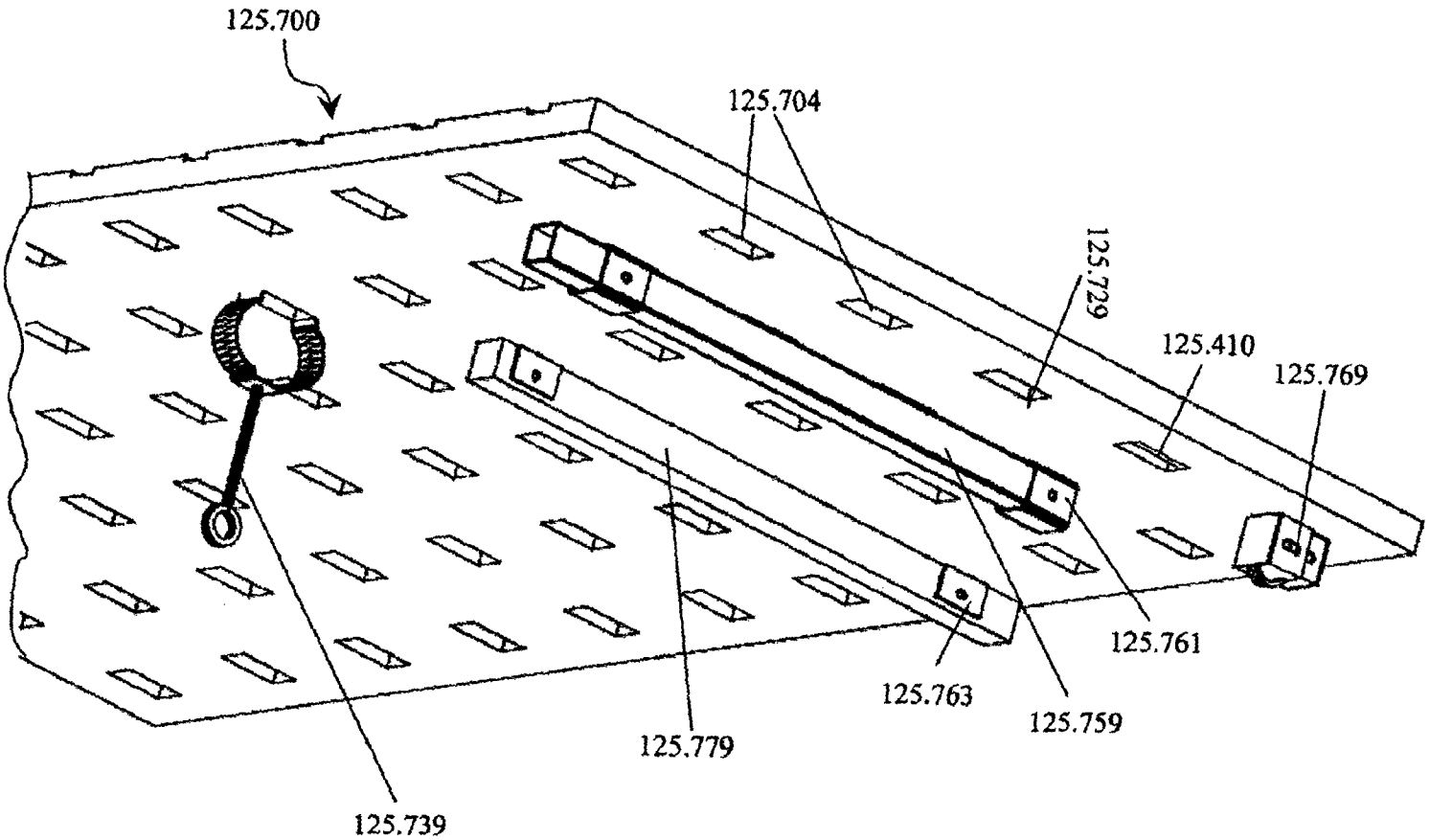

FIG. 125 illustrates the support panel of FIGS. 104 and shows how the brackets of FIGS. 113, 116, 117, 116A and 118 are mounted thereto via apertures 125.704.

FIGS. 119, 119A, 120, 120A, 123, 123A, 126, 126A and 124 is a hanging system 119.771 for supporting a variety of articles or support structures that are fixed to a beam 119.780. The articles can be a cabinets, shelves, drawers, cupboards, chairs, stools, vanities, wall units, stereo units or other furniture, or building elements such as beams or stair treads, or other articles such as art works to be mounted to a panel. A generally triangular shaped bracket supporting plate 119.770 includes a back surface 119.744 if made as a solid bracket or is two edges if fabricated from sheet material. The back surface 119.744 abuts the support panel 106.700 and transfers the load from the attached article. The upper surface of the bracket 119.770 includes a three sided cut-out or recess 119.322, with the middle side serving as a bearing surface to receive the load transferred by the beam 119.780, which can be received therein. This middle side also allows the beam 119.780 to translate along it as discussed below. The hanging arms 119.722 and locking member 119.720 operate in the same manner as described above. A lateral reinforcement or projection 119.786 is provided in the case where there is no front recess on the panels. This projection will sit in an aperture 106.704 below the aperture 106.704 in which the hanging arm 119.722 and locking member 119.720 engage with. The projection 119.786 prevents the lower end of the bracket moving laterally after assembly. If desired the projection 119.786 can be replaced by a second hanging arm and lock member similar to 119.722 and 119.720.

A machine screw or bolt 119.772 is used to alter the distance 119.784 which positions the support beam 119.780 relative to the bracket and the panel, allowing the article, which is attached to the support beam and held on the supporting plate 119.770, to be pushed with a compressive force against the support panel 120.700 and thus held tightly.

Figure 120A:
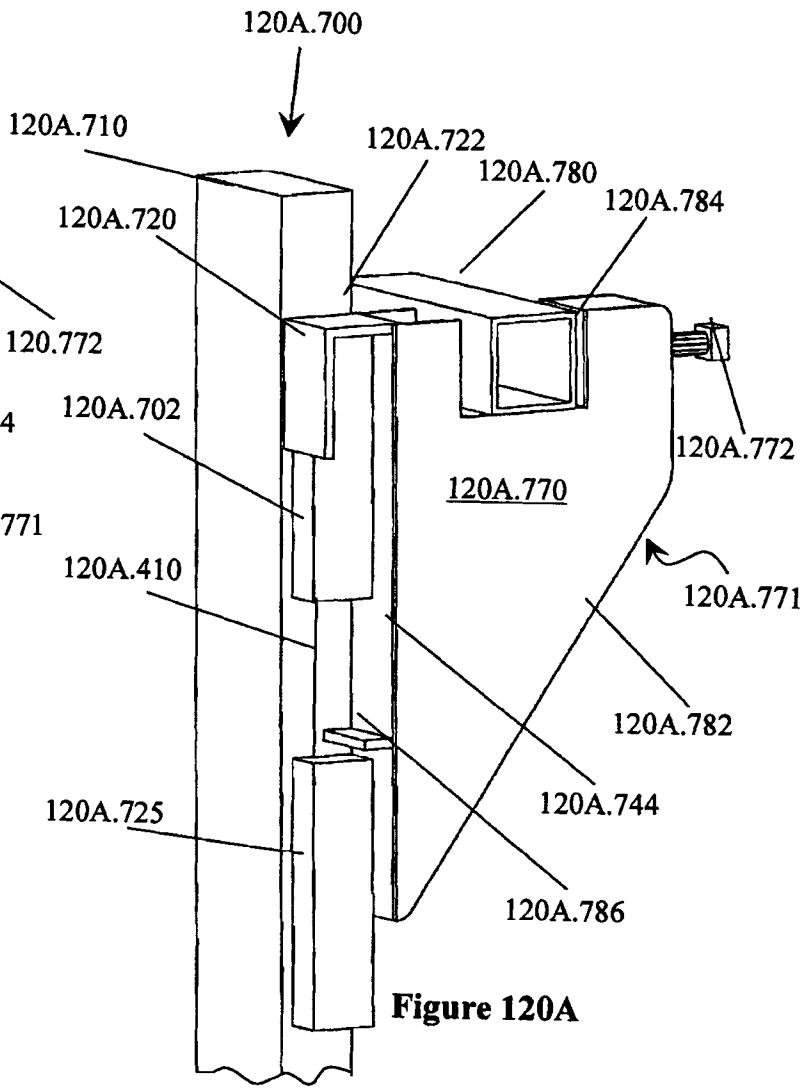
Figure 120:
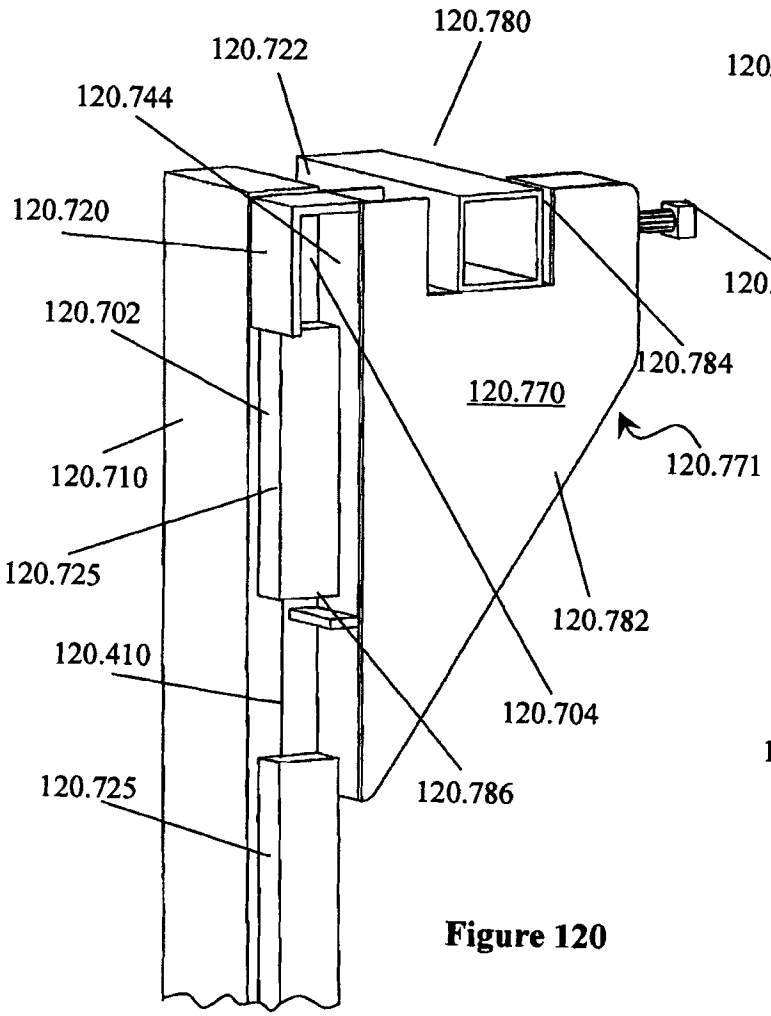

In FIGS. 120 and 120A, the support panel 120.700 is shown in cross section. In FIG. 120 is a partially assembled system, with the hanging arm 120.722 passing through the aperture 120.704 and abutting a wall of the aperture. The locking member 120.720 has also passed through the aperture 120.704 and is shown near to the rear channel base surface 120.725 and prior to engaging with the rear channel base surface 120.725. The projection 120.786 is shown in the upper portion of an adjacent. FIG. 120A a fully assembled system with the hanging system 120A.771 engaged with the rear channel base surface 120A.725.

The width and length of member 119.720 and of the hanging arm 119.722 is such that they fit reasonably snugly into the width of the rear rebate or recess 104.702 and the aperture 104.704. As the rebate 104.702 has side walls, the length of the member 119.720 will resist twisting of the bracket 119.771 relative to the panel 104.700 around an axis of rotation perpendicular to the panel 104.700, which is in addition to the resistance to such movement provided by the projection 119.786. Whereas the width of the arm 119.722 will assist in resisting twisting of the bracket 119.771 about a vertical axis. Further the distance 119.943 between the back edge/surface 119.744 and the inner face 119.724 of member 119.720, as illustrated in FIG. 119, is selected so that the arm 119.722 can enter the aperture 104.704 (as discussed below) and when the back edge/surface 119.744 is adjacent the front face of panel 104.700, then the inner face 119.724 of member 119.720 is clear of the base surface 105.725 of the recess/rebate 104.702.

Figure 123A:
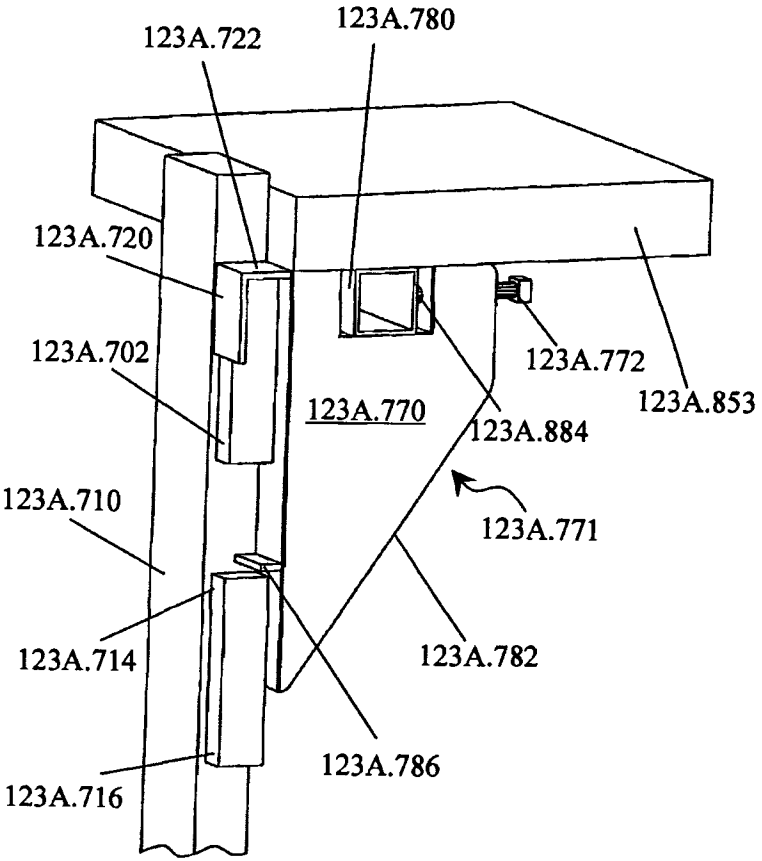
Figure 123:
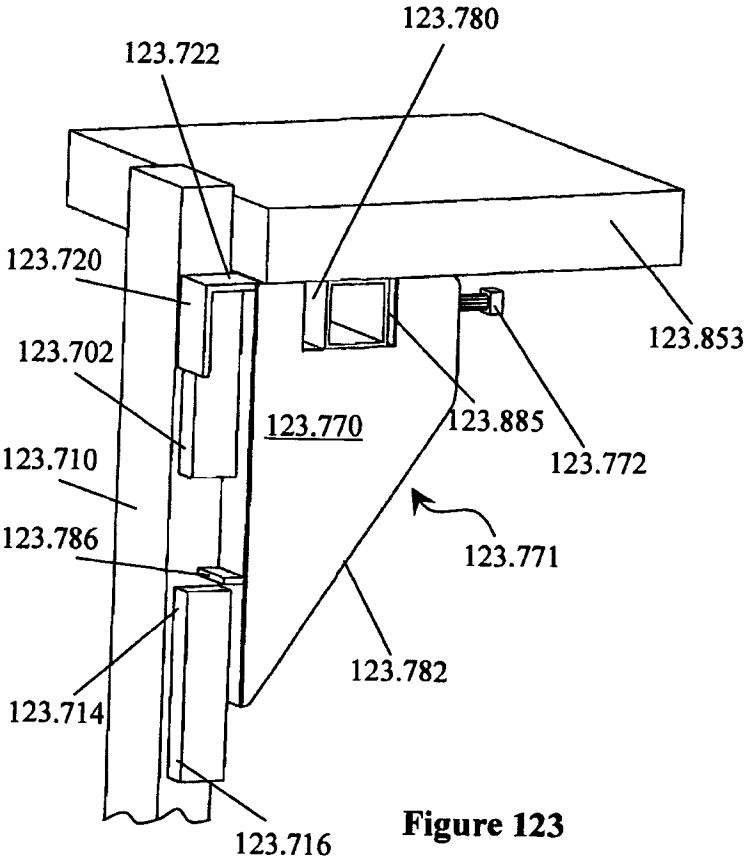
Figure 126A:
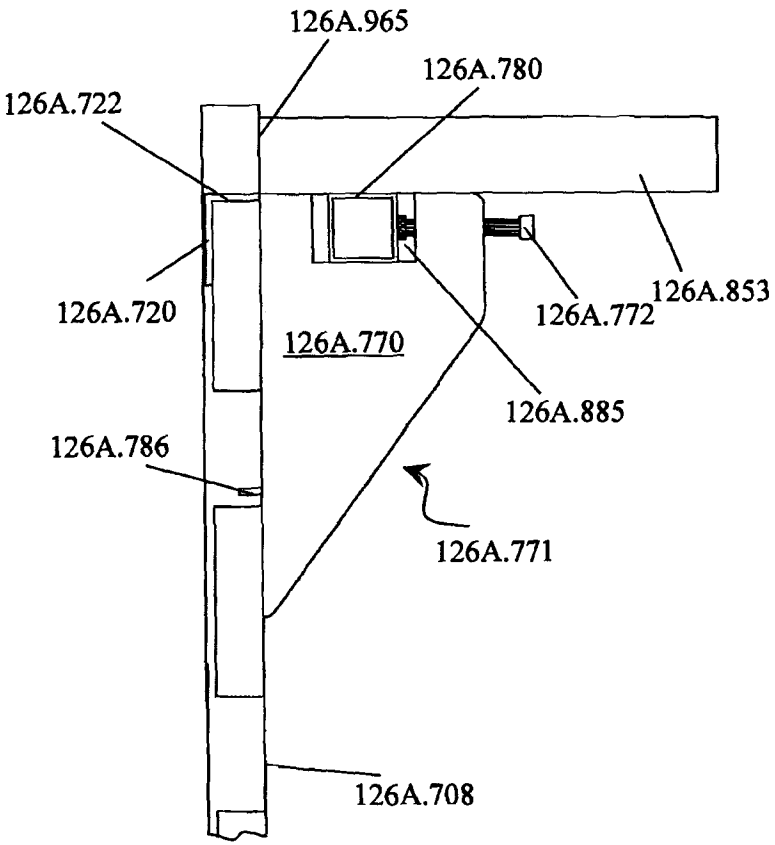
Figure 126:
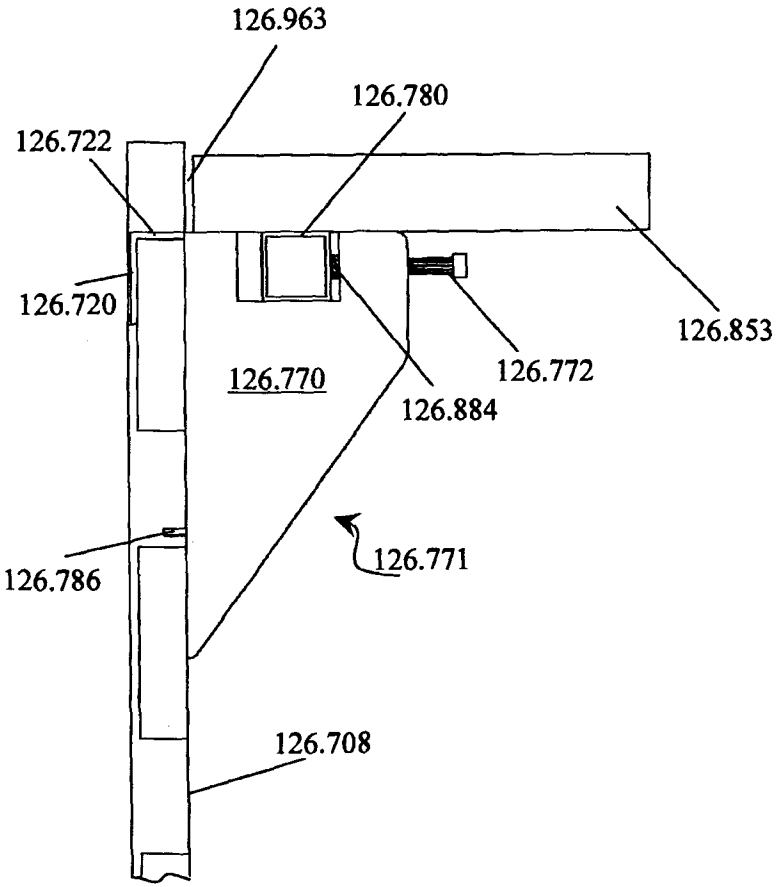
Figure 127:
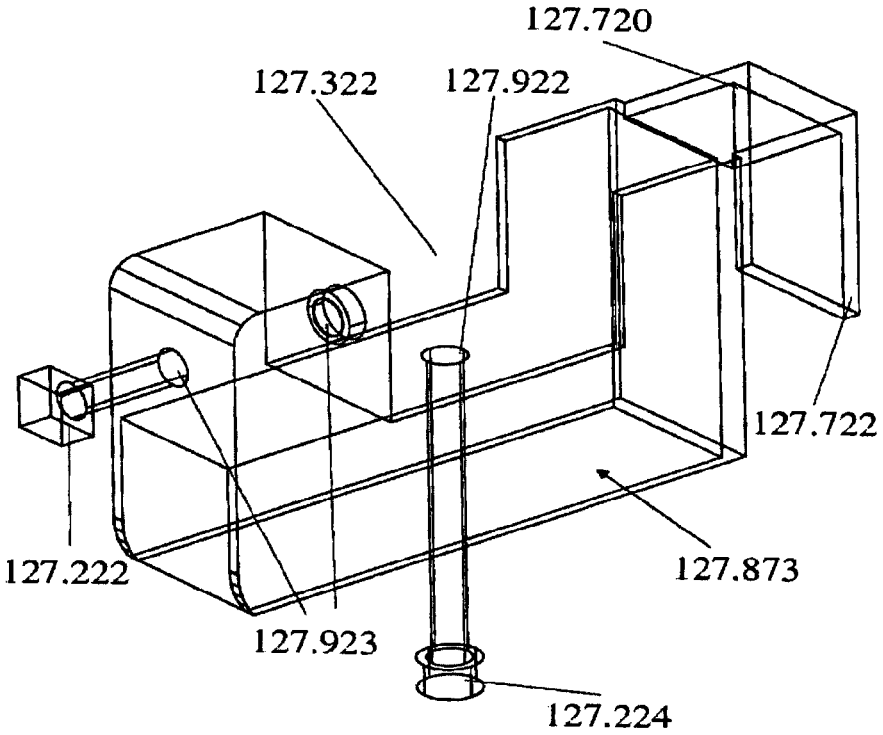
FIGS. 127 to 131 illustrate respectively another bracket system in front perspective, front perspective with beam,; side view with beam; and cross section view of assembly with a panel.
Figure 128:
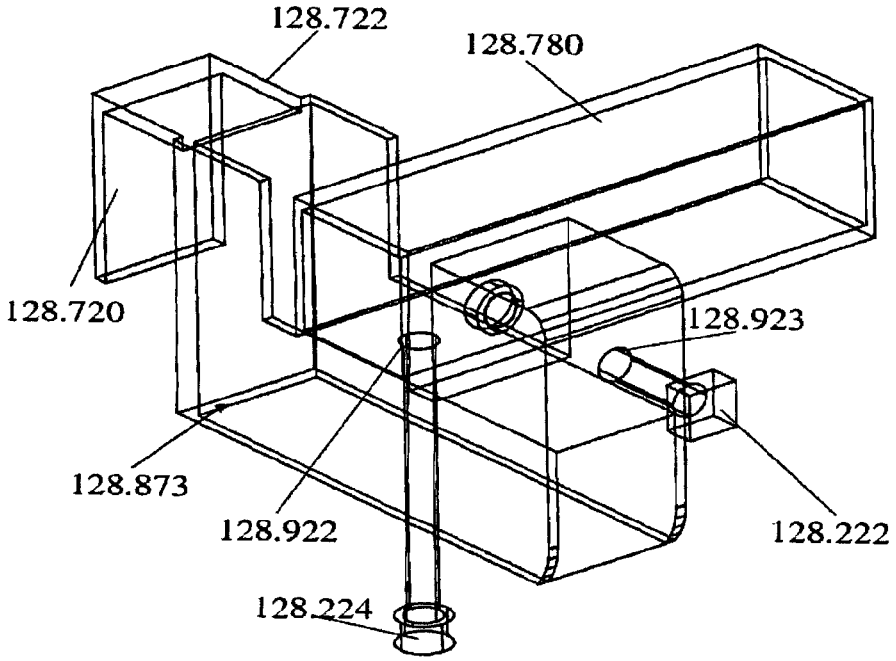
Figure 129:
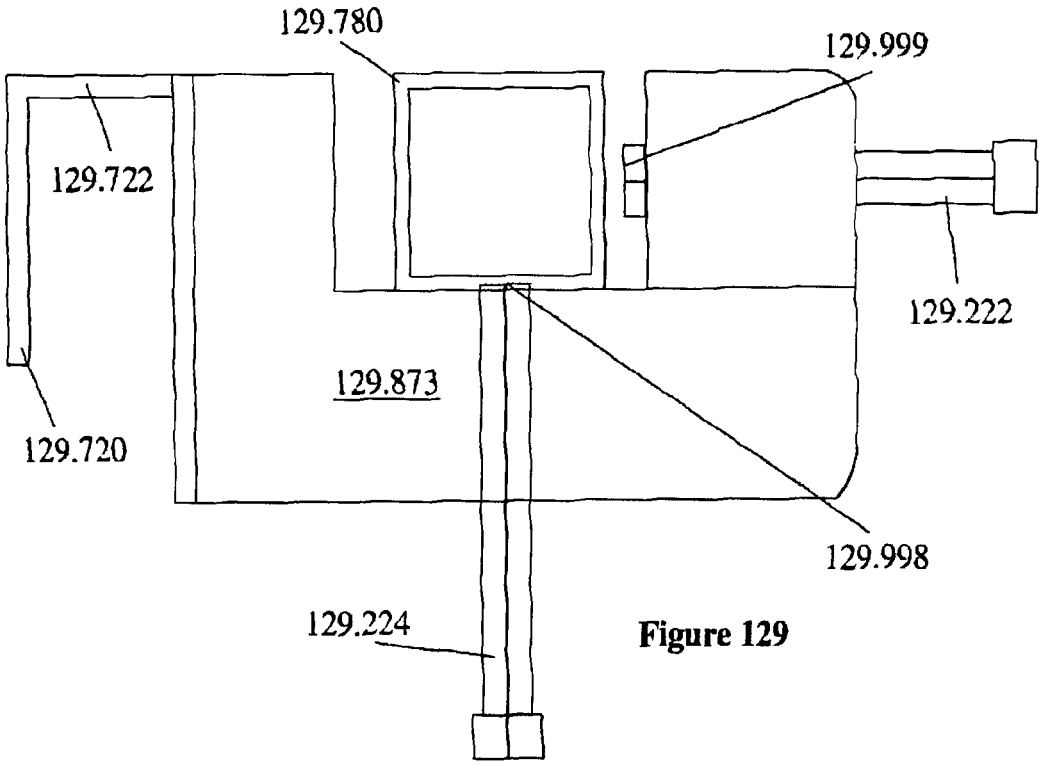

In FIGS. 123, 123A, 126 and 126A there is illustrated a shelf or portion of an article of furniture, or a building element 123.853 to which beam 123.780 is attached. FIGS. 123 and 126 illustrate the system before full assembly, in that the screw 123.772, 126.772 has not yet been tightened, that is gap 123.884, 126.884 is smaller than the gap 123A.885, 126A.885 respectively. By tightening the screw 123.772, the beam 123A.780 is moved toward the support panel and by this means the screw will apply a clamping force to keep the article 123A.853 secured to the panel 123A.700. If a front rebate, such as 104.718 is provided the edge of the member 123A.853 will be inserted into the rebate 104.718, and clamped therein by tightening the screw 123A.772. The action of tightening the screw also has 126A.772 also has the effect of applying an equal and opposite clamping force between the panel 126A.700 and the lock member 126A.720. These clamping forces and friction which results there from assists to prevent relative movement between the brackets 126A.771, the article 126A.853 and the panel 126A.700.

Figure 124:
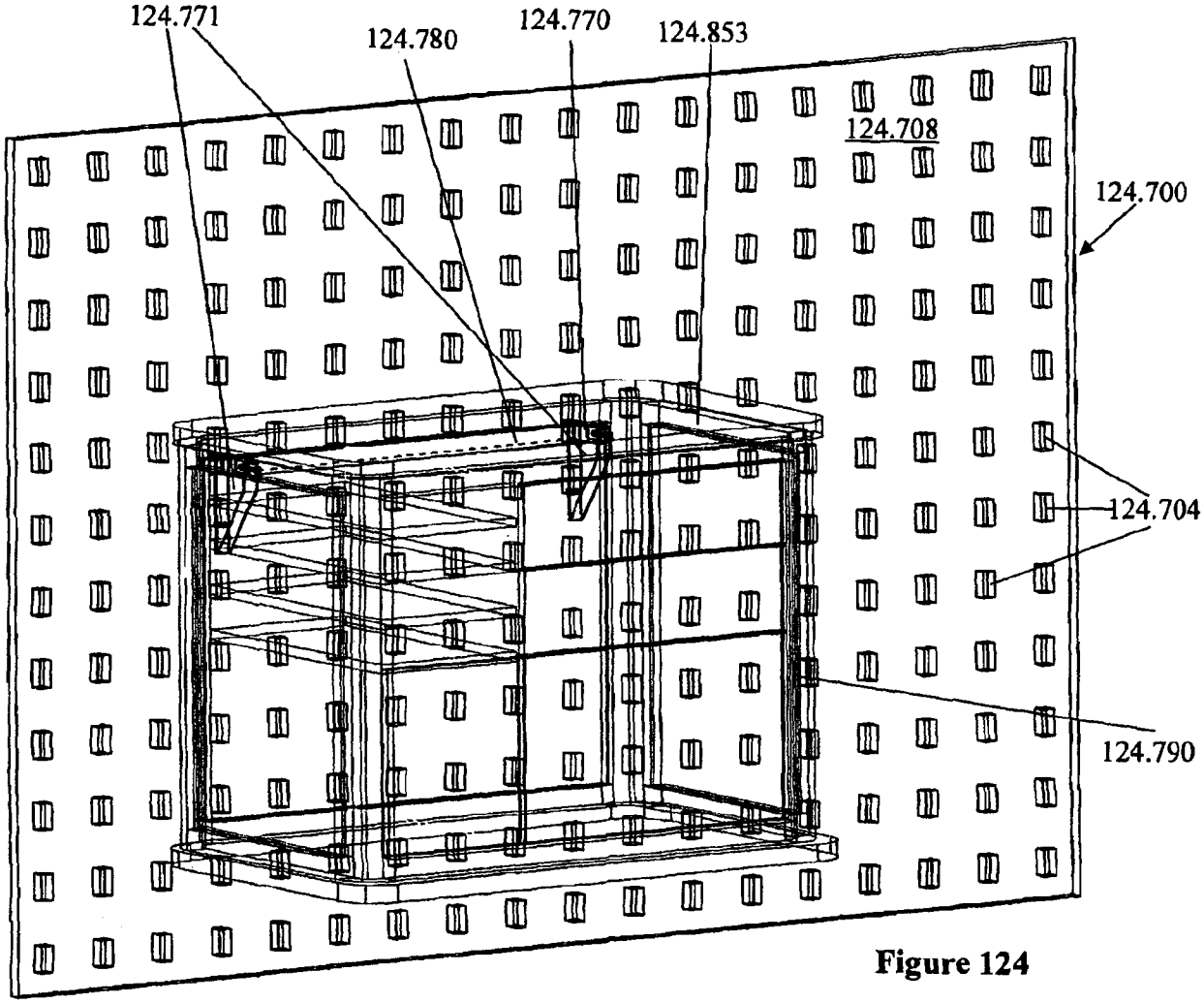

FIG. 124 illustrates the fully assembled system of FIGS. 119, 119A, 120, 120A, 123, 123A, in a wire frame view so that internal components can be viewed. In FIG. 124 the article is a bathroom vanity cabinet or unit or a cupboard which has the beam 124.780 built in or attached internally thereto to so as to be engaged with the brackets 124.771, with one each side of the cabinet. In a bathroom situation the panel 124.700 can make up whole wall surface to which tiles or other wall finishing material can be attached. Alternatively the panel 124.700 can be of a size more closely approximating the size of the cabinet and this is then secured to the wall members and the cabinet mounted thereon. A particular advantage of the system illustrated in FIG. 124, is that the brackets 124.771 do allow for considerable lateral adjustment of the cabinet 124.853 with respect to the brackets 124.771 and the panel 124.700.

Figures 119, 119A:
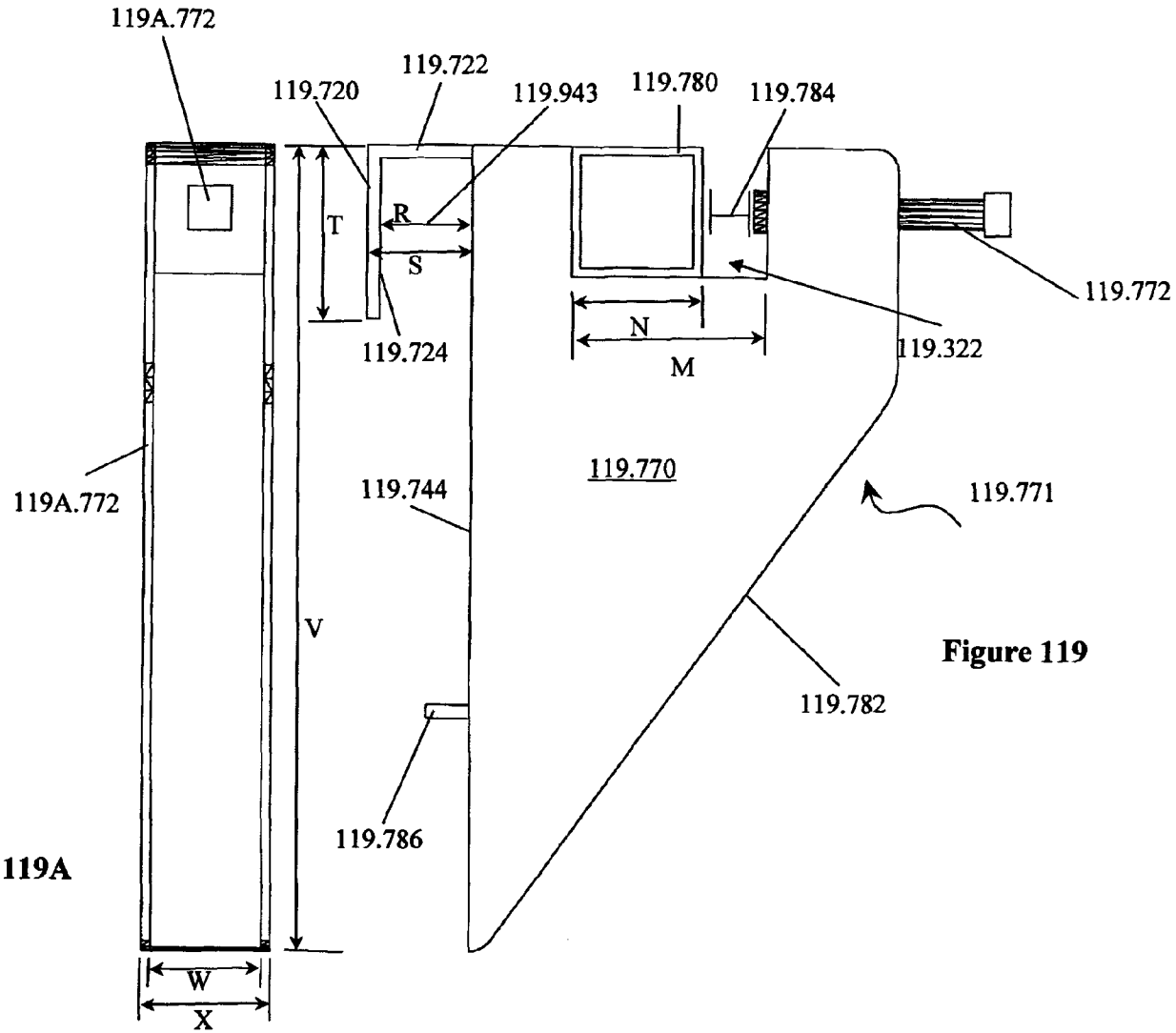
FIGS. 119, 119A, 120, 120A, 123, 123A, 124, 126, and 126A illustrate respectively: a side elevation of a bracket for use with an apertured panel; front elevation of apparatus of FIG. 119; a perspective view of apparatus of FIG. 119 in situ with a panel; perspective view of FIG. 120 where the bracket is engaged with the panel; a perspective view of an article partially assembled to the bracket of FIG. 119; a fully assembled article and bracket as in FIG. 123, a wire frame perspective view of an assembly a cabinet attached to a panel with bracket of FIG. 119; a side views of FIG. 123; and aside view of FIG. 123A.

Some typical dimensions, for illustrative purposes only, of the support of FIGS. 119 and 119A is that the height V is of the order of 185 mm, while length T of member 119.720 is of the order of 40 mm and the length S of the arm 119.722 is approx 24 mm. The width of the arm 119.722, into the peag of FIG. 119 is approx 25.5 mm. The width R of gap 119.943 is approx 21 mm, while the square beam 119.780 has a side length of approx 30 mm with the recess 119.322 has a width M of approx 45 mm and a height of approx 30 mm. As seen in FIG. 119A the overall width X of the bracket is 29.5 mm while the internal width W is approx 25.5 mm.

Figure 121:
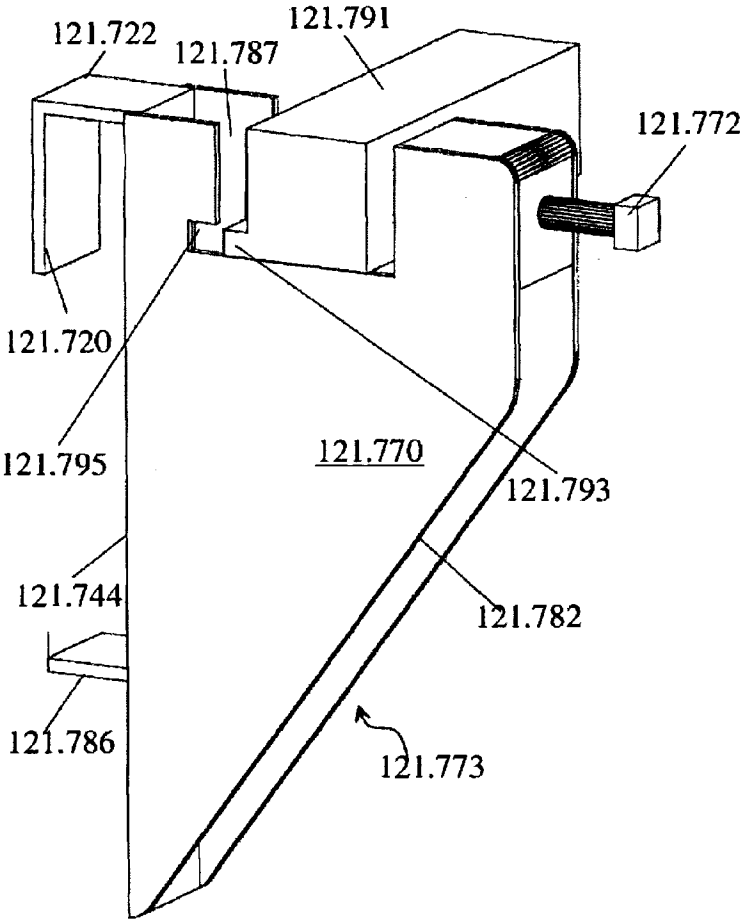
FIG. 121 illustrates a perspective view of the hanging support similar to FIG. 120, but modified to provide better interlocking and movement resistance.

FIG. 121 illustrates a system similar to that of FIGS. 119, 120 and 120A but differs there from by an additional laterally extending slot 121.795 in the support plate 121.770 for receiving a bottom protrusion 121.793 on a shaped or rebated beam 121.791. The additional slot 121.795, once a portion of the protrusion 121.793 has entered the slot 121.795, assists to prevent movement of the beam 121.791 out of the opening 121.787 or the bracket 121.770.

Figure 122:
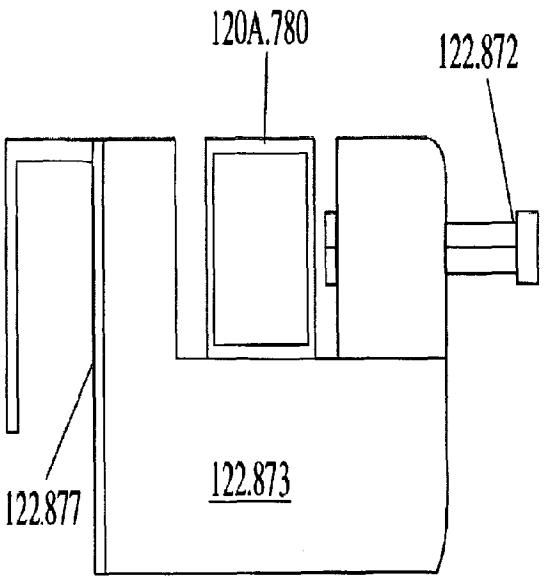
FIGS. 122 and 122A illustrates a side view and end view of an alternative profile of the hanging support of FIGS. 119 to 121.
Figure 122A:
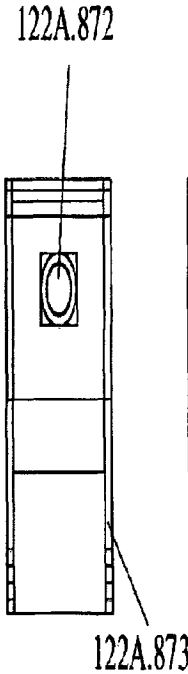

FIGS. 122 and 122A, illustrate a system where a bracket similar to that of FIGS. 119 to 121 is provided but has with a reduced length of back wall 122.877 and differently shallower support plate 122.873, which is of a rectangular shape, whereas previously a triangular shape was utilised. The system 123A.771 includes a grub screw 122A.977 and support plate 122.873. FIGS. 127 to 130 illustrate a wire frame representation of a hanging support or bracket 127.873 which is similar to that illustrated in FIGS. 122 and 122A with a recess 127.322 for receiving a beam on an article to be supported. A threaded hole 127.923 is located through the front edge and one side of the recess 127.322. Another threaded hole 127.922 is provided through the middle or base side of the recess 127.322. The holes 127.922 and 127.923 are threaded so that a bolt 127.222 can be inserted into hole 127.923 and another bolt 127.224, whose axis of rotation is at 90 degrees to bolt 127.772, can be inserted through the hole 127.224. In use the bolts 127.772 and 127.224 will be generally horizontal and vertical respectively. The bolt 127.224, in the example of the assembly of FIG. 125, can be used to provide levelling or a specified angle where required. The bolt 127.224 however will need to have its adjustment performed before the bolt 127.772 is tightened for the final securing of the assembly and the components.

Figure 130:
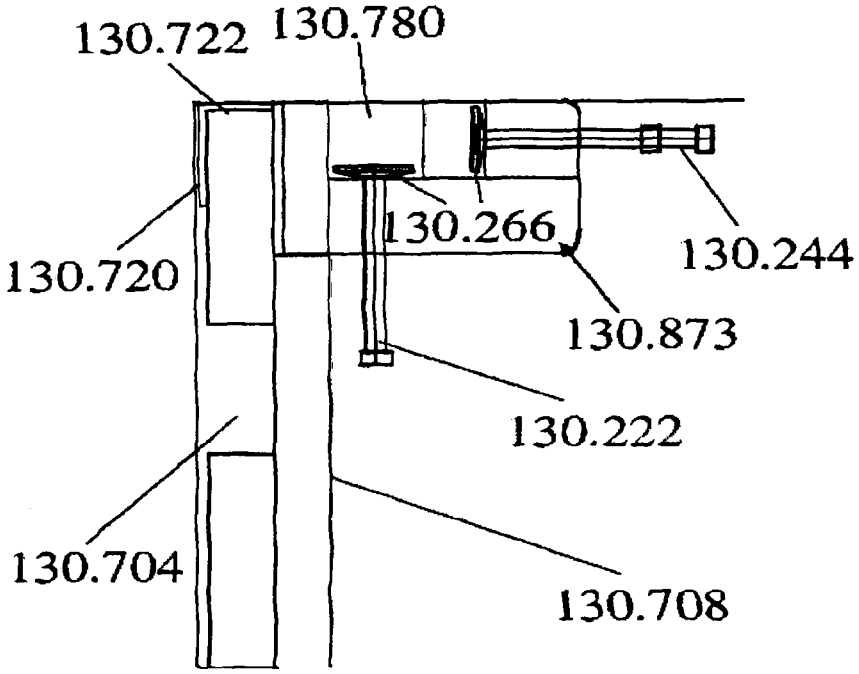

The bolts 129.224 and 129.772 can act as adjustment screws for both the vertical and horizontal position of the beam 129.780. These adjustment screws use their distal ends 129.999 and 129.998, which as illustrated in FIG. 130 can include pads 130.266 to create a greater surface area of contact between the beam 130.780 and the bolts 130.772 and 130.224. If needed they can be covered with cushioning material. The bolts can maintain their vertical or horizontal positions through resistance or clamping forces, or alternatively a locking lug nut or any other suitable means such as a chemical lock can be used. The bolts or threaded screw adjustment means can be replaced with a piston or other means to allow vertical and horizontal adjustment of the beam.

Figure 131:
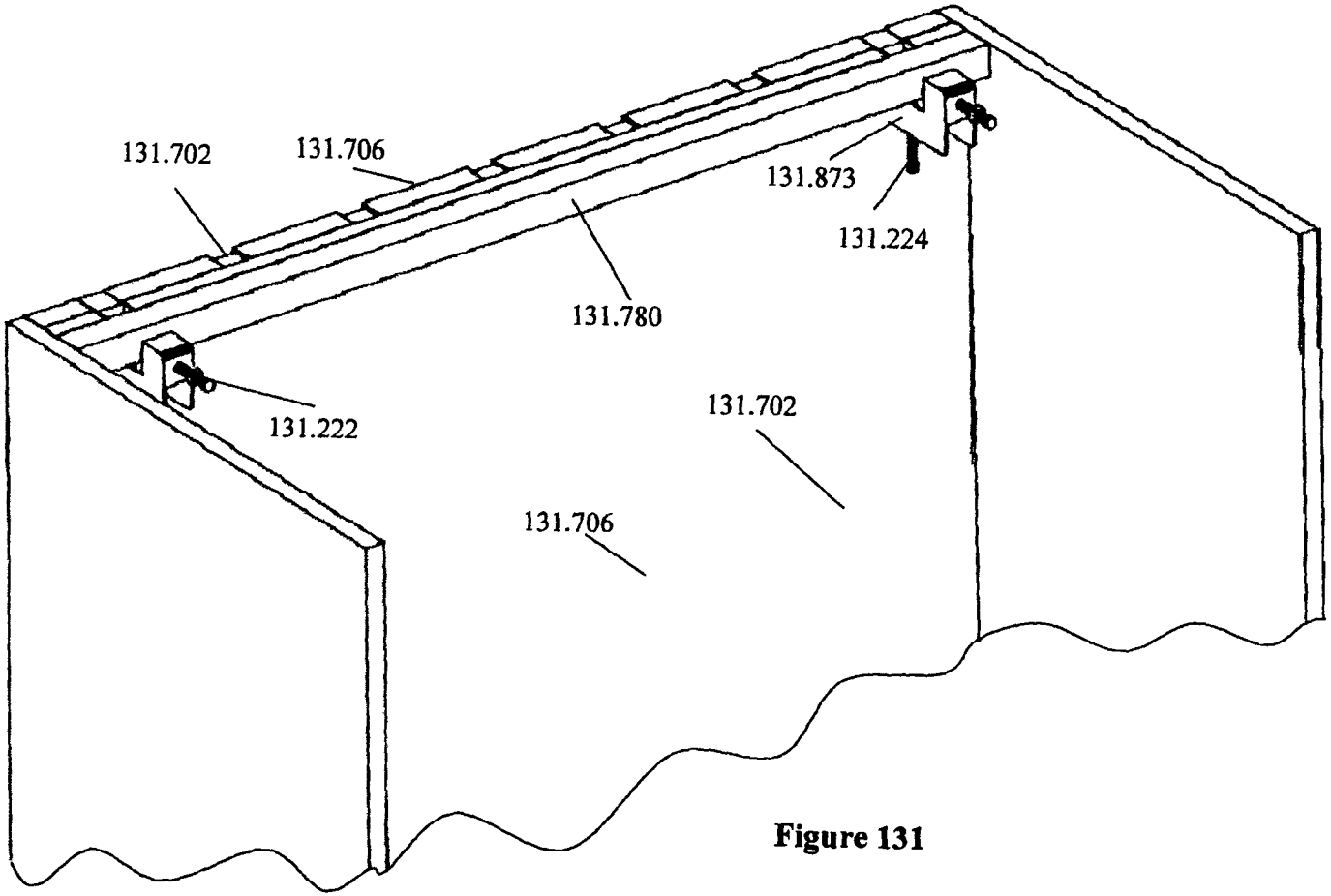

FIG. 131 illustrates a perspective view of a cabinet being mounted to a panel 131.700 (of FIGS. 104 to 109) by two hanging supports 131.873 of FIGS. 127 to 130 with vertical and horizontal beam adjustment. The hanging supports or brackets are mounted to the support panel as described above.

Figure 132:
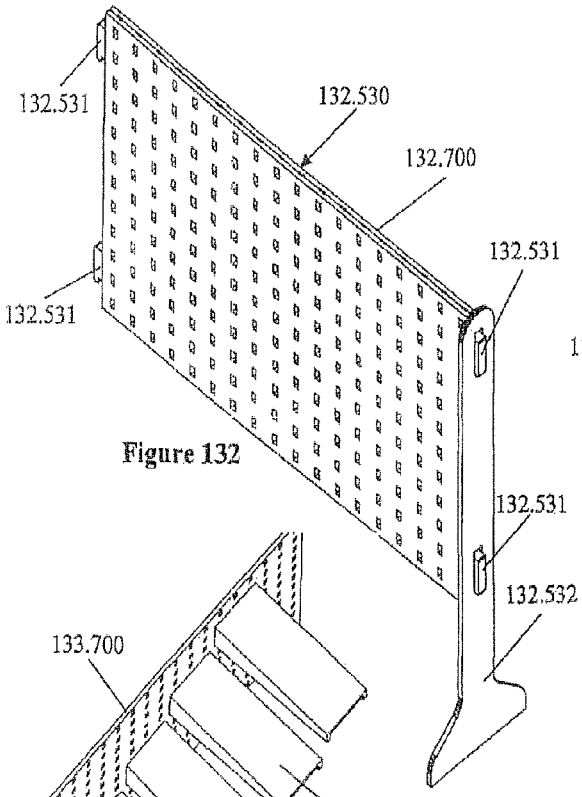
FIGS. 132 to 135 illustrate a perspective view of respectively: a partially assembled art screen; a cantilevered stair assembly; a stair assembly between two support panels; an underneath perspective view of FIG. 134.

In FIG. 132 is an art screen 132.530 screen in a partially assembled state. The screen 132.530 is made up of two panels like 132.700 positioned back to back so that the rear vertical recesses are aligned. If desired they can be misaligned thereby preventing the ability to see through the screen 132.530. A two mounting flanges 132.531are formed on the ends of each panel 132.700, so as to allow them to be easily assembled into slots on vertical supports 132.532. They will stay locked together by the effect of gravity on the panels. This allows for easy disassembly when needed. Art work can then be mounted as needed onto the art screen 132.530 at any desired location using the brackets described above. Alternatively or additionally shelves can be also mounted thereto for the display of sculptures, statues, pottery and other freestanding art work and the like.

Figure 135:
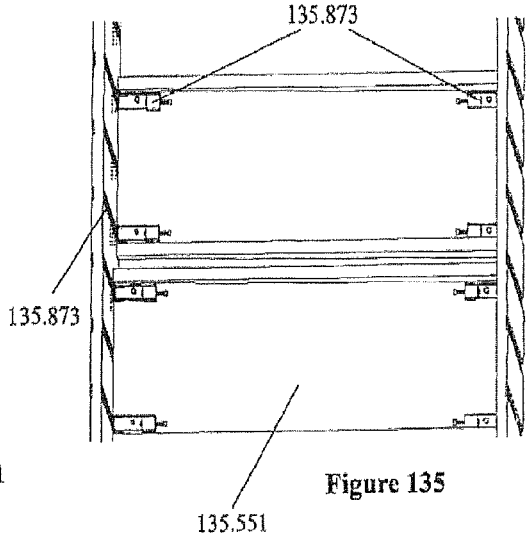
Figure 133:
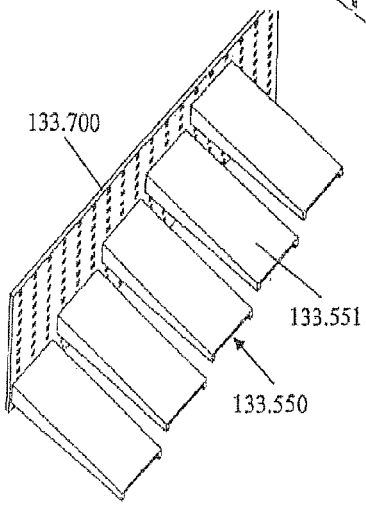
Figure 134:
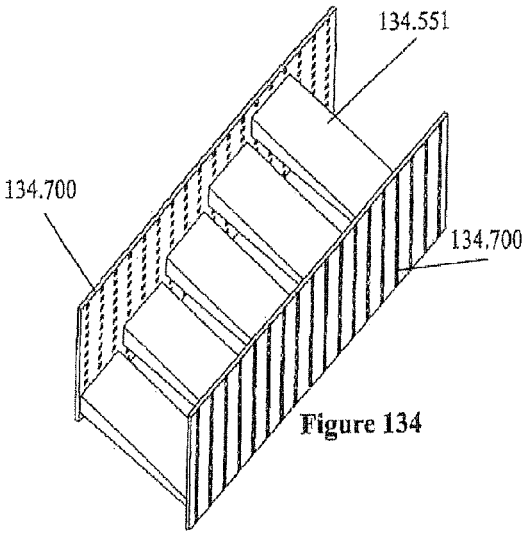

Illustrated in FIG. 133 is a stair case 133.550 made from a single side support panel 133.700 and stair treads 133.551 hung off the panel 133.700 by means of the brackets described above. While in FIGS. 134 and 135 is two side supported stair case formed from two panels 134.700 and stair treads 134.551 attached to both panels 134.700 by brackets 135.873 as described above. In this instance the stair treads 134.551 are in tension when assembled by the opposing brackets as illustrated in FIG. 135. By the use of front surface rebates (such as 104.712) the ends of the stair treads can be captured therein.

Illustrated in FIG. 136 is a dual hooked member 136.933 for screw or other attachment to a bracket, such as brackets of FIGS. 9, 11, 12, 41 to 44 for example. The member 136.933 provides two hanging arms 136.722 and two member 136.720, so that the member 136.933 can be passed into and secure a bracket into two adjacent apertures 104.704 on a sheet 104.700.

An advantage of the panel 104.700 having an array of apertures and rear located vertical channels or recesses is that the multiple array of apertures allows rearrangement of furniture or articles in a relatively simple manner, and if electrical equipment is involved the rear vertically extending channels allow cable to be passed from the top or bottom or entry or exit at some intermediate point to be readily performed.

The brackets described above with respect to FIGS. 104 to 135 can be manufactured by casting, or a combination of casting and fabrication from sheet material, or just by fabrication of sheet material, with such joining methods as welding or bolting being used if not integrally formed, or from steel or appropriate composite materials.

Where the term disc flange has been used to describe the flanges on the end of a bracket support flange it does not restrict the shape of the flange to being circular as depicted in the drawings. The disc flange can be of any profile that is larger than the aperture in the bracket support and the width of the flange slots.

The pin that is part of the bracket support is depicted as being cylindrical throughout the drawings but this does not limit the profile of the pin to being circular. The pin can be of a variety of profiles from polygonal struts to irregular shape profiles. Similarly with respect to the disc flanges which are shown circular or cylindrical, other shape could also be used such as square or square prism, rectangular or rectangular prism, regular and irregular polygons or polygonal prism.

The above racking systems, support panels and hanging systems can be manufactured from any appropriate material such as: Plywood in any sheet form inclusive of custom veneering and Laminates of any thickness; Melamines of all kinds that come in sheet form and various thicknesses; Particle boards; Medium density fibreboard or CRAFTWOOD (registered trade mark); NEMA (registered trade mark) expanded PVC panels; Aluminium both in sheet or custom box sections; Steel; Galvanized Steel; Stainless steel; Solid timber; Plastics and polymers; composite materials; Decorative Laminates as per LAMINEX (Registered trade mark) catalogues; Acrylic; Fibreglass; Glass; Kevlar; Polymers; Masonite; Metal of any kind; Recycled material; ABS; PVC; Blown PVC polymer; expanded PVC panels; Masonry sheeting; Acoustic sheeting; Concrete; or Dibond materials.

The elasticity and damping created by the construction of the support flange and the slots, the shape and length of the bracket, the provision of a slot in the rear of the bracket, and the construction and physical properties of the bracket support and its pin, together provide a form of "suspension" system which can assist in the protection of equipment to be stored on such a racking system. It will be readily understood that the dimensions and material properties of the materials used can be adjusted as required to deliver a desired level of elasticity and damping.

TABLE 1

| Material | Product | Tongue size | Length | Width | Height | Starting Height | 6.4 KG | End Height | Deflection |
|---|---|---|---|---|---|---|---|---|---|
| MDF | Long Straight Bracket | 200 | 1085 | 25 | 100 | 1161 | 1154 | 1161 | 7 |
| | M Straight Bracket | 200 | 950 | 25 | 100 | 1150 | 1147 | 1150 | 3 |
| | Large Kayak Bracket | 200 | 755 | 25 | 615 | 689 | 686 | 689 | 3 |
| | Surf Sid Bracket | 50 | 700 | 25 | 500 | 910 | 900 | 910 | 2 |
| | Fishing Bracket | 203 | 812 | 25 | 156 | 835 | 920 | 935 | 15 |
| | 8 Straight Bracket | 73 | 900 | 25 | 80 | 1335 | 1130 | 1335 | 5 |
| | 8 Straight w Dowel | 203 | 900 | 25 | 80 | 1367 | 1369.6 | 1367 | 7.5 |
| Name | Fishing Bracket | 56 | 890 | 25 | 155 | 967 | 943 | 967 | 24 |
| | Straight Bracket | 120 | 900 | 25 | 100 | 1019 | 1010 | 1019 | 9 |
| | Large Kayak Bracket | 120 | 730-840 | 25 | 100 | 561 | 551 | 581 | 10 |
| CD Plywood | Long Straight Bracket | 200 | 1085 | 25 | 100 | 764 | 753 | 764 | 11 |
| | Straight Bracket | 200 | 950 | 25 | 100 | 752 | 743 | 752 | 9 |
| | Large Kayak Bracket | 200 | 755 | 25 | 815 | 750 | 773 | 780 | 7 |

| Material | Product | 13.9 KG | End Height | Deflection | 18 KG | End Height | Deflection | 25 KG | End Height | Deflection |
|---|---|---|---|---|---|---|---|---|---|---|
| MDF | Long Straight Bracket | 1134 | 1161 | 27 | 1118 | 1161 | 43 | 1107 | 1161 | 54 |
| | M Straight Bracket | 1136 | 1150 | 14 | 1122 | 1150 | 28 | 1114 | 1150 | 36 |
| | Large Kayak Bracket | 677 | 689 | 12 | 675 | 689 | 14 | 862 | 689 | 27 |
| | Surf Sid Bracket | 901 | 910 | 9 | 908 | 910 | 4 | 904.6 | 910 | 5.5 |
| | Fishing Bracket | 902 | 935 | 33 | 902 | 935 | 33 | 891 | 935 | 44 |
| | 8 Straight Bracket | 1316 | 1306 | 19 | 1304 | 1335 | 31 | 1292 | 1335 | 43 |
| | 8 Straight w Dowel | 1346.6 | 1367 | 22 | 1336 | 1367 | 31 | 1322 | 1367 | 46 |
| Name | Fishing Bracket | 927 | 967 | 40 | 919 | 967 | 48 | 891 | 967 | 76 |
| | Straight Bracket | 972 | 1019 | 47 | 986 | 1019 | 54 | 949 | 1019 | 70 |
| | Large Kayak Bracket | 533 | 561 | 20 | 527 | 581 | 34 | 619 | 661 | 42 |
| CD Plywood | Long Straight Bracket | 741 | 763 | 23 | 724 | 761 | 40 | 700 | 760 | 61 |
| | Straight Bracket | 730 | 751 | 22 | 729 | 751 | 23 | 700 | 748 | 52 |
| | Large Kayak Bracket | 758 | 780 | 24 | 748 | 778 | 32 | 734 | 775 | 48 |

TABLE 2

| Material | Product | Tongue size | Length | Width | Height | Starting Height | 5.4 KG | End Height | Deflection | 13.8 KG |
|---|---|---|---|---|---|---|---|---|---|---|
| MDF | Long Straight Bracket | 200 | 1085 | 25 | 100 | 1062 | 1052 | 1062 | 10 | 1045 |
| | Straight Bracket | 200 | 960 | 25 | 100 | 1052 | 1048 | 1052 | 6 | 1041 |
| | Large Kayak Bracket | 200 | 755 | 25 | 615 | 1015 | 1212 | 1015 | 3 | 1008 |
| | Surf Sid Bracket | 50 | 700 | 25 | 300 | 889 | 686 | 689 | 3 | 684 |
| | Fishing Bracket | 203 | 812 | 25 | 156 | 1089 | 1025 | 1089 | 64 | 1082 |
| | Straight Bracket | 73 | 910 | 25 | 60 | 1340 | 1333 | 1340 | 7 | 1326 |
| | Straight w Dowel | 203 | 910 | 25 | 60 | 1360 | 1356.5 | 1360 | 3.5 | 1348 |
| Name | Fishing Bracket | 88 | 890 | 25 | 155 | 867 | 951 | 967 | 16 | 937 |
| | Straight Bracket | 120 | 900 | 25 | 100 | 1019 | 1009 | 1019 | 10 | 992 |
| | Large Kayak Bracket | 120 | 730-840 | 25 | 100 | 561 | 552 | 581 | 9 | 540 |
| CD Plywood | Long Straight Bracket | 200 | 1085 | 25 | 100 | 1084 | 1059 | 1084 | 5 | 1051 |
| | Straight Bracket | 200 | 950 | 25 | 100 | 1054 | 1049 | 1054 | 5 | 1045 |
| | Large Kayak Bracket | 200 | 755 | 25 | 615 | 799 | 796 | 799 | 3 | 793 |

| Material | Product | End Height | Deflection | 18 KG | End Height | Deflection | 25 KG | End Height | Deflection |
|---|---|---|---|---|---|---|---|---|---|
| MDF | Long Straight Bracket | 1062 | 17 | 1039 | 1062 | 23 | 1032 | 1062 | 30 |

TABLE 2-continued

| | | | | | | | | | |
|---|---|---|---|---|---|---|---|---|---|
| | Straight Bracket | 1052 | 11 | 1038 | 1052 | 16 | 1031 | 1062 | 21 |
| | Large Kayak Bracket | 1015 | 7 | 1008 | 1015 | 9 | 1002 | 1015 | 13 |
| | Surf Sid Bracket | 689 | 6 | 683 | 689 | 6 | 681 | 689 | 8 |
| | Fishing Bracket | 1089 | 7 | 1080 | 1089 | 9 | 1077 | 1089 | 12 |
| | Straight Bracket | 1340 | 14 | 1322 | 1340 | 16 | 1310 | 1340 | 24 |
| | Straight w Dowel | 1360 | 12 | 1344 | 1360 | 16 | 1337 | 1360 | 23 |
| Name | Fishing Bracket | 967 | 30 | 927 | 967 | 40 | 901 | 967 | 68 |
| | Straight Bracket | 1019 | 27 | 977 | 1019 | 42 | 955 | 1019 | 64 |
| | Large Kayak Bracket | 581 | 21 | 533 | 561 | 20 | 518 | 581 | 43 |
| CD Plywood | Long Straight Bracket | 1064 | 19 | 1046 | 1064 | 18 | 1040 | 1064 | 24 |
| | Straight Bracket | 1054 | 9 | 1040 | 1054 | 14 | 1037 | 1054 | 17 |
| | Large Kayak Bracket | 799 | 6 | 790 | 799 | 9 | 784 | 799 | 15 |

Table one represents the data produced from a 100 mm drop test of a masses 5.4 kg, 13.8 kg, 18 kg and 25 kg onto the end of a bracket similar to that of FIG. 42, in twin support flanges of approximately 19 mm thick with a slot shape as illustrated in FIG. 1, with a measurement of the elasticity and damping being the amount of deflection the racking system generated.

Whereas in table two there is represented the data from static tests using the same masses and measuring deflection by applying the masses for a period of three minutes.

Each of the brackets yielded sufficient elasticity, suspension or damping qualities.

The above described rack systems, bracket systems and panel systems can be used with and to support, in addition to the items mentioned above, a variety of other things in commercial, industrial and domestic environments, for example: surf & sport storage such as SUPS, short boards, long boards, snowboards, skateboards, skis, stocks, water-skis, wakeboards, body boards, surf life saving rescue boards, canoes/kayaks, boats, dinghies, rubber—zodiacs, catamarans, outriggers, fishing/crab nets, fishing rods, fishing basket, paddles, oars, bikes, scooters, scuba tanks, beach umbrellas, gym equipment, footballs, baseball bats, basketball/ring hoop, roller blades, roller skates, helmets, goggles/face mask/snorkel, flippers, wetsuits, toys and marine equipment; or in building applications such as cabinets of all sorts, vanities, electrical switch boards, school work shops, office joinery, bench tops, hospital furniture, kit homes, project homes, demountable buildings, mining, tool sheds, garages, general hosing, hotels, pubs and clubs, flood prone areas, surf clubs, sporting clubs, lockers; or in the home or commercial premises for storing: linen, rugs, curtain rods, curtains, rolls of fabric, canvas, laundry basket, clothes lines, pegs, window frames, pc/hard-drive/monitor, flat screen TVs, lap tops, luggage, suitcases/briefcases, suit bags, handbags; or hardware, garden tools, equipment & automotive: power tools, electrical cords, ropes, two ropes, cables, soil (bags), potting mix, timber, nails, vice, tool kits, block & tackle, shovels/spades, paint cans, paint brushes, building materials, wub, garden hose, hose reel, inner tubes, tyres, lawn mower, whipper snipper, chain saw, barbecues, gas cylinder, garbage bins, step ladder, locks, outboard motors, car seats/mats/head rests, wind screens, roof racks, bike racks, packaging equipment, tents; or kitchen equipment: kitchen equipment such as kitchen appliances, saucepans, glass ware, wine racks, crockery, cutlery, fruit & veg, picnic baskets, esky; or other—electronics, clothing, medical items such as speakers, records, camera equipment, DVDs, books, magazines, jewellery, make up, hangers, parkers, gumboots, shoes, stationary, artwork, sculpture, craft supplies, candles, mannequins, scales, birdcages, pet supplies, golf bags/clubs, hospital sundries, surgical equipment, medical supplies, optical supplies, keys.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A support panel having a front face and a rear face and a plurality of apertures extending through said support panel between said front face and said rear face; said rear face including a respective recess adjacent to a respective one of said plurality of apertures, said respective recess having a base surface which in side view is located between said front face and said rear face, wherein said base surface of said respective recess is bounded by at least one sidewall extending inward from said rear face, and wherein said base surface of said respective recess intersects with a wall that extends forward toward said front face and that defines said respective one of said plurality of apertures.

2. A support panel as claimed in claim 1, wherein:

said respective recess is located relative to said respective one of said plurality of apertures in one of the following locations: on one side of said respective one of said plurality of apertures; on two sides of said respective one of said plurality of apertures; on opposed sides of said respective one of said plurality of apertures; in a line on opposed sides of said respective one of said plurality of apertures; fully surrounds said respective one of said plurality of apertures; in a circle around said respective one of said plurality of apertures.

3. A support panel as claimed in claim 1, wherein:

said respective recess is in the form of a rebate and is formed as a channel formation having opposed side walls that extend from the base surface.

4. A support panel as claimed in claim 1, wherein:

said plurality of apertures are provided in the form an array of rows and columns, and wherein said respective recess is a rebated channel having opposed side walls, wherein said rebated channel interconnects aligned one of said plurality of apertures.

5. A support system comprising:

a support panel having a front face and a rear face and a plurality of apertures extending through said support panel between said front face and said rear face, said rear face including a respective recess adjacent to a respective one of said plurality of apertures, said respective recess having a base surface which in side view is located between said front face and said rear face, wherein said base surface of said respective recess is bounded by at least one sidewall extending inward from said rear face, and wherein said base surface of said respective recess intersects with a wall that extends forward toward said front face and that defines said respective one of said plurality of apertures, wherein said support panel is configured to be secured to a plate member; and a support member having a body and at least one support hook which has a first portion to engage an edge of a given one of said plurality of apertures, said body extending away from said first portion, said support hook having a second portion which extends from said first portion so as to form a gap or slot between said body and said second portion to receive a part of said support panel adjacent said given one of said plurality of apertures, said second portion in use being adapted to be generally parallel to a rear surface of said support panel, wherein said second portion of said support hook is configured to pass through said given one of said plurality of apertures such that when said first portion has been positioned against a wall of said given one of said plurality of apertures said second portion is located adjacent a rear surface of said support panel and adjacent said plate member;

wherein said given one of said plurality of apertures of said support panel defines an opening that is completely surrounded by at least one inward facing wall and the first portion and second portion of the hook are configured such that both the first and second portions of the hook pass through the opening of said given one of said plurality of apertures in use and the second portion of the hook engages the rear surface of the support panel adjacent said given one of said plurality of apertures in use.

6. A support system as claimed in claim 5, wherein:

said base surface is spaced from said plate member and provides a location into which said second portion is inserted in use.

7. A support system as claimed in claim 6, wherein:

said first portion is of a length from said body to said second portion so that when a rear surface of said body is against the front surface of said support panel then said second portion will be able to enter said respective recess.

8. A support system as claimed in claim 7, wherein:

said first portion extends generally perpendicularly from said body of said support member and said second portion extends generally perpendicularly from said first portion.

9. A support system as claimed in claim 5, wherein:

said respective recess is located relative to said respective one of said plurality of apertures in one of the following locations: on one side of said respective one of said plurality of apertures; on two sides of said respective one of said plurality of apertures; on opposed sides of said respective one of said plurality of apertures; in a line on opposed sides of said respective one of said plurality of apertures; fully surrounds said respective one of said plurality of apertures; in a circle around said respective one of said plurality of apertures.

10. A support system as claimed in claim 5, wherein:

said respective recess is in the form of a rebate and is formed as a channel formation having opposed side walls and a base.

11. A support system as claimed in claim 5, wherein:

said support member includes at least one element selected from the group consisting of (i) said at least one support hook being two support hooks, (ii) said at least one support hook being two support hooks configured to respectively pass into respective ones of said plurality of apertures in said support panel, (iii) said at least one support hook being a single support hook and there is also present a stabilizing projection, and (iv) said at least one support hook being a single support hook and there is also present a stabilizing projection, wherein said single support hook and said stabilizing projection are configured to respectively pass into respective ones of said plurality of apertures in said support panel.

12. A support system as claimed in claim 5, wherein:

said support member includes a recess to receive one of the following: a structural member; a beam; a bracket; a part of or attached to one of a piece of furniture, a cabinet, a vanity cabinet, a cupboard, a shelf, a dressing table, a seat, a chest of drawers, a chair, a work bench, a building element, a stair tread, a beam, an art work.

13. A support system as claimed in claim 12, wherein:

said support member includes at least one element selected from the group consisting of (i) an element configured to secure said structural member onto said support members, (ii) an element configured to secure an article attached to the structural member with respect to said support panel, and (iii) an element configured to secure said support member to said support panel.

14. A support system as claimed in claim 12, wherein:

said support member further comprises at least one element selected from the group consisting of (i) an element configured to move or secure said structural member in a horizontal direction, (ii) an element configured to move or secure said structural member in a vertical direction, (iii) an element configured to move or secure said structural member in both a vertical direction or a horizontal direction, and (iv) an element configured to lock position of said structural member relative to said support member.

15. A support system as claimed in claim 5, wherein:

said support member includes two support hooks which move towards each other so that said support hooks pass through respective ones of said plurality of apertures of said support panel.

16. A support system as claimed in claim 15, wherein:

said support member further comprises at least one element selected from the group consisting of (i) a securing member passing through said two support hooks to move said support hooks relative to each other, (ii) said two support hooks comprise a first support hook provided on a first portion being insertable into a second portion on which is provided a second support hook, and wherein said first and second portions are adapted to move with respect to each other, (iii) said two support hooks are configured to pivot with respect to one another;

(iv) a tubular portion to receive a structural member, (v) a support to receive a bracket, and (vi) at least one support hook including outwardly radiused or curved regions.

17. A support system as claimed in claim 5, wherein:

said at least one support hook engages said respective recess or said respective one of said plurality of apertures to thereby resist twisting forces applied to said support member.

18. A support system as claimed in claim 17, wherein:

said first portion of said support hook engages sides of said respective one of said plurality of apertures to provide said support member with resistance against twisting around an axis generally parallel to said second portion.

19. A support system as claimed in claim 5, wherein:

said respective recess is formed by a rebate which extends between at least two apertures.

20. A support system as claimed in claim 5, wherein:

said given one of said plurality of apertures and said support hook are respectively dimensioned so that said support hook enters said given one of said plurality of apertures in a perpendicular direction relative to said front surface of said support panel.

21. A support system as claimed in claim 5, wherein:

said plate member comprise an element selected from the group consisting of (i) a rear panel or plate attached to a rear surface of said support panel, (ii) a wall to which a rear surface of said support panel is attached, and (iii) a wall member to which a rear surface of said support panel is attached.

22. A support system as claimed in claim 5, wherein:

said support member is a bracket.

23. A support system comprising:

a support panel having a front face and a rear face and at least one aperture extending through said support panel between said front face and said rear face, said rear face including a recess adjacent to said aperture, said recess having a base surface which in side view is located between said front face and said rear face, wherein said base surface of said recess is bounded by at least one sidewall extending inward from said rear face, wherein said base surface of said recess intersects with a wall that extends forward toward said front face and that defines said aperture, and wherein said support panel is configured to be secured to a plate member and said at least one aperture communicating from a front surface to a rear surface of said support panel; and a support member having a body and at least one support hook which has a first portion to engage an edge of said at least one aperture, said body extending away from said first portion, said support hook having a second portion which extends from said first portion so as to form a gap or slot between said body and said second portion to receive a part of said support panel adjacent said at least one aperture, said second portion in use being adapted to be generally parallel to a rear surface of said support panel, wherein said second portion of said support hook is configured to pass through said aperture such that when said first portion has been positioned against a wall of said aperture said second portion is located adjacent a rear surface of said support panel and adjacent said plate member;

wherein the aperture of said support panel defines an opening that is completely surrounded by at least one inward facing wall, wherein the first portion and second portion of the hook are configured such that both the first and second portions of the hook pass through the opening of the aperture in use, and wherein the second portion of the hook engages the rear surface of the support panel adjacent the aperture in use; and wherein said recess is located relative to said aperture in one of the following locations: on one side of said aperture; on two sides of said aperture; on opposed sides of said aperture; in a line on opposed sides of said aperture; fully surrounds said aperture; in a circle around said aperture.

24. A support system comprising:

a support panel having a front face and a rear face and at least one aperture extending through said support panel between said front face and said rear face, said rear face including a recess adjacent to said aperture, said recess having a base surface which in side view is located between said front face and said rear face, wherein said base surface of said recess is bounded by at least one sidewall extending inward from said rear face, wherein said base surface of said recess intersects with a wall that extends forward toward said front face and that defines said aperture, and wherein aid support panel is configured being adapted to be secured to a plate member and said at least one aperture communicating from a front surface to a rear surface of said support panel;

a support member having a body and at least one support hook which has a first portion to engage an edge of said at least one aperture, said body extending away from said first portion, said support hook having a second portion which extends from said first portion so as to form a gap or slot between said body and said second portion to receive a part of said support panel adjacent said at least one aperture, said second portion in use being adapted to be generally parallel to a rear surface of said support panel, wherein said second portion of said support hook is configured to pass through said aperture such that when said first portion has been positioned against a wall of said aperture said second portion is located adjacent a rear surface of said support panel and adjacent said plate member;

wherein the aperture of said support panel defines an opening that is completely surrounded by at least one inward facing wall, wherein the first portion and second portion of the hook are configured such that both the first and second portions of the hook pass through the opening of the aperture in use, wherein the second portion of the hook engages the rear surface of the support panel adjacent the aperture in use, and wherein said first portion of said support hook engages sides of said at least one aperture to provide said support member with resistance against twisting around an axis generally parallel to said second portion.

25. A support system comprising:

a support panel having a front face and a rear face and at least one aperture extending through said support panel between said front face and said rear face, said rear face including a recess adjacent to said aperture, said recess having a base surface which in side view is located between said front face and said rear face, wherein said base surface of said recess is bounded by at least one sidewall extending inward from said rear face, and wherein said base surface of said recess intersects with a wall that extends forward toward said front face and that defines said aperture, wherein a support panel having at least one aperture through said panel, wherein said support panel is configured to be secured to a plate member and said at least one aperture communicating from a front surface to a rear surface of said support panel;

a support member having a body and at least one support hook which has a first portion to engage an edge of said at least one aperture, said body extending away from said first portion, said support hook having a second portion which extends from said first portion so as to form a gap or slot between said body and said second portion to receive a part of said support panel adjacent said at least one aperture, said second portion in use being adapted to be generally parallel to a rear surface of said support panel, wherein said second portion of said support hook is configured to pass through said aperture such that when said first portion has been positioned against a wall of said aperture said second portion is located adjacent a rear surface of said support panel and adjacent said plate member;

wherein the aperture of said support panel defines an opening that is completely surrounded by at least one inward facing wall, wherein the first portion and second portion of the hook are configured such that both the first and second portions of the hook pass through the opening of the aperture in use, wherein the second portion of the hook engages the rear surface of the support panel adjacent the aperture in use, and wherein said at least one aperture and said support hook are respectively dimensioned so that said support hook enters said at least one aperture in a perpendicular direction relative to said front surface of said support panel.

* * * * *